US005805180A

United States Patent [19]

Ebisawa et al.

[11] Patent Number: 5,805,180

[45] Date of Patent: Sep. 8, 1998

[54] INK JET RECORDING APPARATUS WHICH PERFORMS SUCTION RECOVERY WITH A CAP AND METHOD FOR SAME

[75] Inventors: Isao Ebisawa, Yokohama; Atsushi Arai; Hisao Yaegashi, both of Kawasaki; Hidehiko Kanda, Yokohama, all of Japan

[73] Assignee: Canon Kabushiki Kaisha, Tokyo, Japan

[21] Appl. No.: 518,724

[22] Filed: Aug. 24, 1995

[30] Foreign Application Priority Data

| | | | |
|---|---|---|---|
| Aug. 26, 1994 | [JP] | Japan | 6-202415 |
| Aug. 26, 1994 | [JP] | Japan | 6-202579 |
| Aug. 26, 1994 | [JP] | Japan | 6-202595 |

[51] Int. Cl.[6] ..... B41J 2/165

[52] U.S. Cl. ..... 347/23

[58] Field of Search ..... 347/22, 23, 29, 347/30, 40, 44, 84, 85, 94, 95; 346/43, 139 R, 140.1

[56] References Cited

U.S. PATENT DOCUMENTS

| | | | |
|---|---|---|---|
| 4,965,608 | 10/1990 | Shinohara et al. | 346/1.1 |
| 5,021,809 | 6/1991 | Abe et al. | 346/140 R |
| 5,109,233 | 4/1992 | Nishikawa | 346/1.1 |
| 5,155,497 | 10/1992 | Martin et al. . | |
| 5,166,699 | 11/1992 | Yano et al. | 346/1.1 |
| 5,185,615 | 2/1993 | Koitabashi et al. | 346/1.1 |
| 5,289,207 | 2/1994 | Ebisawa | 346/140 R |
| 5,343,228 | 8/1994 | Takada | 347/29 |
| 5,367,325 | 11/1994 | Yano et al. | 347/17 |
| 5,485,187 | 1/1996 | Okamura et al. | 347/85 |
| 5,625,385 | 4/1997 | Suzuki | 347/24 |

FOREIGN PATENT DOCUMENTS

| | | |
|---|---|---|
| 0362897 | 4/1990 | European Pat. Off. . |
| 0427202 | 5/1991 | European Pat. Off. . |
| 452119B1 | 10/1991 | European Pat. Off. . |
| 0480473 | 4/1992 | European Pat. Off. . |
| 0589583 | 3/1994 | European Pat. Off. . |
| 0604942 | 7/1994 | European Pat. Off. . |
| 3335851 | 4/1984 | Germany . |
| 1-264853 | 10/1989 | Japan . |
| 4-128049 | 4/1992 | Japan . |
| 7-125263 | 5/1995 | Japan . |

*Primary Examiner*—Edward Tso

*Attorney, Agent, or Firm*—Fitzpatrick Cella Harper & Scinto

[57] ABSTRACT

An ink jet recording apparatus comprising a recording head having discharge ports for discharging the ink, an ink tank for storing said ink to be supplied to the recording head, and suction recovery means for stabilizing the ink discharge from the recording head, characterized in that the suction recovery means has a plurality of suction operations, which can be selected in accordance with the content of the discharge stabilization.

59 Claims, 35 Drawing Sheets

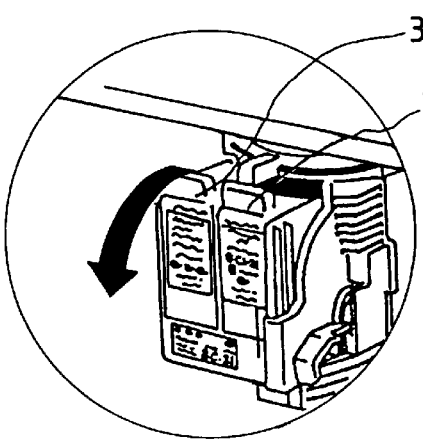
FIG. 14A(2)
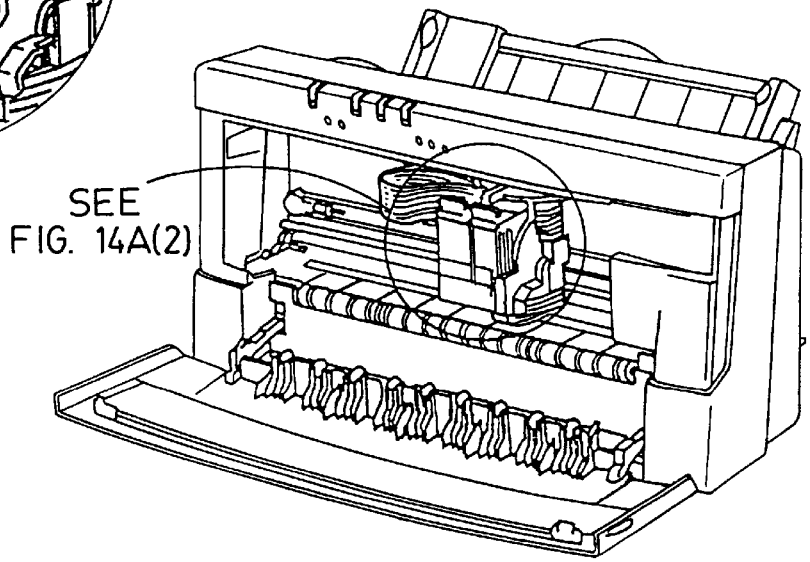
FIG. 14A(1)
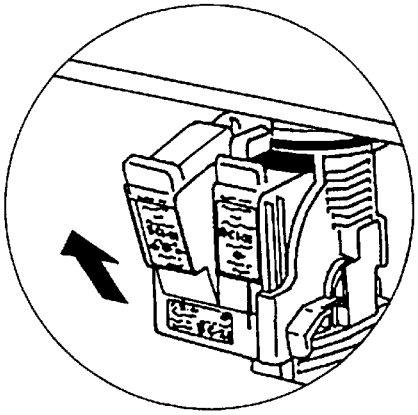
FIG. 14B(2)
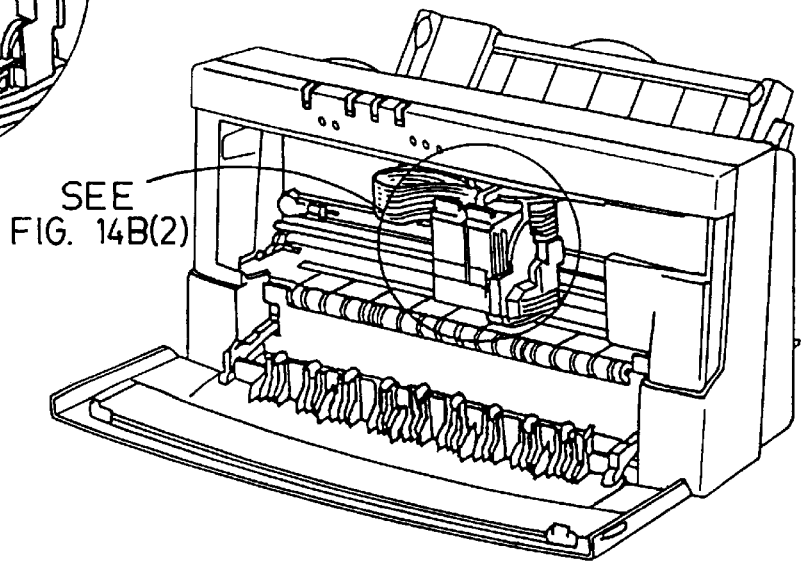
FIG. 14B(1)

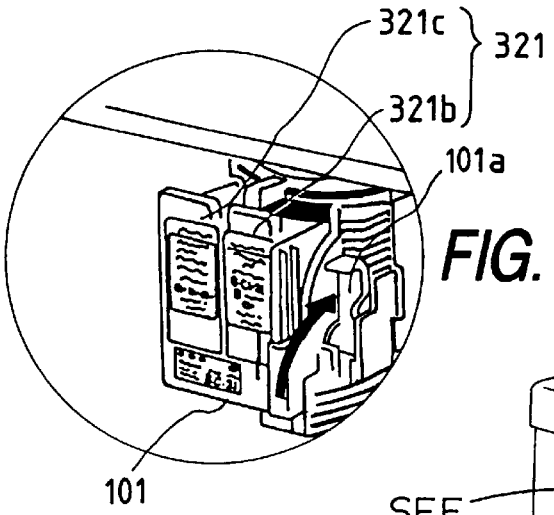
FIG. 15A(2)
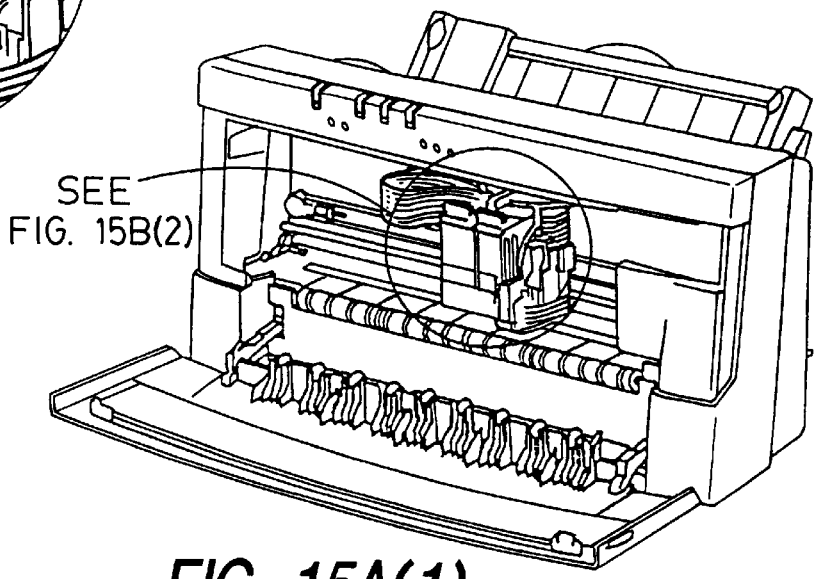
FIG. 15A(1)
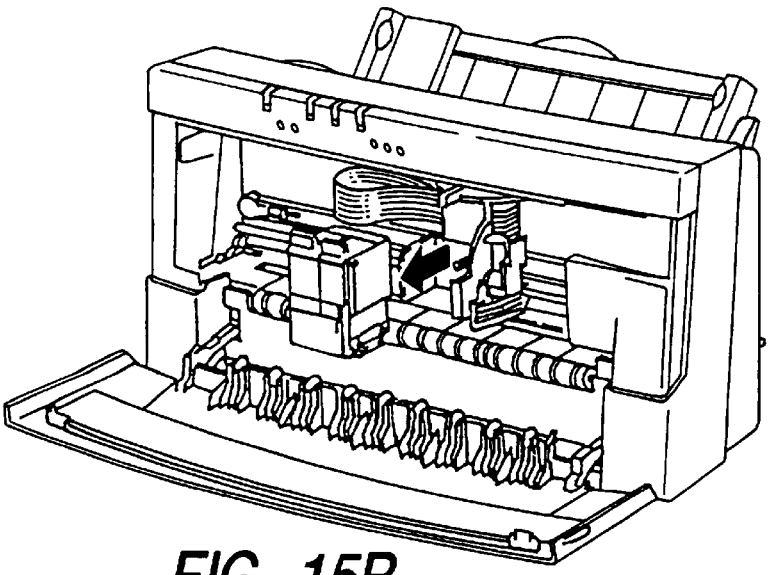
FIG. 15B

INK JET RECORDING APPARATUS WHICH PERFORMS SUCTION RECOVERY WITH A CAP AND METHOD FOR SAME

BACKGROUND OF THE INVENTION

1. Field of the Invention

The present invention relates to an ink jet recording apparatus and a recovery method thereof, and more particularly to an ink jet recording apparatus for performing the color recording and a recovery method thereof.

2. Related Background Art

The ink jet recording apparatuses are typically provided with a variety of mechanisms for maintaining the ink discharge condition excellent by preventing the viscosity of ink from increasing due to evaporation of water content of the ink at or around discharge ports where the ink makes contact with the air, or removing viscous ink or bubbles produced.

Therefore, this type of ink jet recording apparatus is provided with a capping mechanism for preventing evaporation of water content of the ink from the discharge ports by sealably enclosing (or capping) the face where the discharge ports of the recording head are provided while the recording is not performed to discharge ink droplets.

Also, in order to effect the stabler ink discharge, a so-called "predischarge" is conducted to renew the ink in the discharge ports not particularly involving recording by discharging the ink from all the discharge ports or the desired discharge ports of the recording head at a predetermined location periodically, such as during the recording operation, or the ink suction or ink pressurization is performed to expel the thickened ink or produced bubbles by sucking the ink on and within the discharge ports at the start of recording or at every desired time interval.

FIG. 36 is a perspective view illustrating the construction of a main portion of a conventional ink jet recording apparatus.

In FIG. 36, 921 is an ink jet recording cartridge (hereinafter simply referred to as a cartridge) integrally comprising a recording head having a nozzle portion for jetting the ink mounted on a carriage 922 and an ink supply unit having an ink tank for storing the ink and a supply passageway.

This cartridge 921 is detachably secured to the carriage 922 to use either a cartridge dedicated for Bk (black) ink recording or a cartridge dedicated for color ink recording by replacement. The carriage 922 and the cartridge 921 is electrically connected to a contact pad, not shown. 923 is an electrical substrate for controlling the ink discharge from the cartridge 921, and 924 is a flexible cable for connecting the electrical substrate 923 to the carriage 922. 925 is a sheet feeding motor, in which the recording sheet P can be conveyed in a direction of the arrow f as shown by a pair of rollers 926 by the driving of this sheet feeding motor 925. 927 is a roller for regulating the recording sheet P flat in cooperation with the rollers 926 and forming the recording plane for the recording cartridge 921.

928 is a carriage driving belt connected to the carriage 922, 929 is a motor for driving that belt in a direction of S as shown, and 930 is a pair of guide rails for the carriage 922. The carriage 922 is moved along the guide rails 930 in the direction of S as shown by the driving of the motor 929 to effect the recording on the recording plane.

The cartridge 921 is mounted on the carriage 922, which is driven along the recording sheet P in the direction of S as shown in FIG. 36 by the motor 929. The recording sheet P is conveyed in a direction of the arrow f as shown via the roller 927 by the driving of the sheet feeding motor 925. Thereby, the two-dimensional scanning by the recording head 921 can be effected. Then, the recording head 921 can perform the recording on the recording sheet P by jetting ink droplets under control of a control unit.

931 is a recovery device, opposed to the recording cartridge 921, for effecting the recovery operation of the recording cartridge 921 at a home position H of the recording cartridge 921. The recovery device 931 is comprised of a predischarge receiving portion 1311 for capturing ink droplets discharged at the predischarge as previously described to lead them to an ink reservoir (not shown), a wiping blade 1312 for wiping out ink droplets or foreign matter such as paper powder adhering to the discharge port face of recording head, and capping means 1313 having a cap for enclosing the discharge port face of recording head when the recording operation is not performed, or in the suction recovery operation.

The wiping blade 1312 and capping means 1313 are disposed movable back and forth with respect to the cartridge 921, and is capable of wiping or capping the discharge port face at desired timings. Also, capping means is connected to a suction pump (not shown) via a tube to be able to produce a negative pressure within the cap at desired timings.

A flowchart exemplifying a sequence of suction recovery operation in the recovery device as above constructed is shown in FIG. 37. If the suction recovery operation is instructed, the carriage 922 is moved to a home position (HP) (step S701), and the capping means covers the discharge port face to complete the capping (step S702). Next, the suction pump is activated to produce a negative pressure within the cap to suck the ink from the discharge ports to effect the suction operation, until the suction operation is completed by stopping the activation of suction pump at a predetermined timing (step S703).

Then, the cap in the capping means is separated away from the discharge port face, so that the interior of the cap is in communication with the atmosphere (step S704). Then, the suction pump is activated again to remove the ink within the pump, the tube and the cap (step S705). Then, the wiping blade advance to the discharge port face (step S706), and further the carriage 22 is moved in a direction toward the blade to allow the wiping blade to rub against the discharge port face to effect wiping to remove the ink adhering to the discharge port face (step S707).

Further, the carriage 922 continues to be moved in the same direction, and executes the predischarge upon reaching a position at which the discharge ports are opposed to the predischarge receiving portion, to expel the unnecessary ink or small bubbles out of the nozzles (step S708). By the suction recovery comprising such a series or a repetition of operations, the filling of the ink into the discharge ports, the removal of bubbles or unnecessary ink out of the ink flow passages, or the removal of foreign matter on the discharge port face, can be effectively made.

However, in recent years, the recording heads allows the discharge ports and the liquid channels in communication with them to be constructed quite finely and at high density, for which the prior suction recovery methods as heretofore used have become less effective in some cases.

FIGS. 38A and 38B are schematic views illustrating how the ink within liquid passageway is parted into a plurality of sections, as an example of the above cases. FIG. 38A is a typical view showing the constitution of cartridge 921, and FIG. 38B is a cross-sectional view of cartridge 921 taken along a plane V including an array of discharge ports, representing an ink filled state.

In FIG. 38A, 811 are nozzles each of which at the end is an ink discharge port, and internally provided with driving means for discharging each of the inks. 812 is a liquid chamber commonly provided to each nozzle (referred to as a common liquid chamber), and 813 is an ink flow passageway for connecting an absorbing member 814 containing the ink to the common liquid chamber 812.

In FIG. 38B, the solid painted portion indicates the ink filled state, wherein the ink is parted into four sections 813*a*, 813*b*, 813*c*, 813*d* in the figure.

With such a head in the ink filled state, it is impossible to continue the printing, for which the suction recovery is needed. FIG. 39 is a typical view showing the state of a head cartridge at the time of starting the suction. 1313 is capping means as previously described to produce a negative pressure $P_0$ within the cap. However, since the ink is filled within the nozzles and the common liquid chamber 812, the negative pressure reached at an adjoining gap is negative pressure $P_1$ smaller than $P_0$ due to a pressure loss caused by the resistance between the nozzle/common liquid chamber inner wall surface and the ink.

At a further adjoining gap is reached only a negative pressure $P_2$ further smaller than the negative pressure $P_1$ due to a pressure loss caused by the resistance of an ink region 813*a* with the flow passage wall. By repeating this, it follows that a negative pressure $P_4$ reached at a gap in the junction between the absorbing member 814 which is an ink supply unit and the flow passage is significantly smaller than the negative pressure $P_0$ within the cap. To effect the suction, this negative pressure $P_4$ must exceed the ink holding force of the absorbing member, and below it, the ink can not be filled even if the conventional suction recovery operation is repeated many times.

Conventionally, in order to avoid such an ink unfilled state, some considerations have been taken, including:

(a) Setting the suction negative pressure/suction amount large enough (b) Enlarging sufficiently the cross section of flow passage to reduce the pressure loss (c) Shortening sufficiently the length of flow passage to reduce the number of parted portions.

However, in the case of (a), there are some problems including the increased waste ink, or the larger pump, and in the case of (b), there are similar problems such as the increased necessary suction amount caused by the increased flow passage volume, which impeded the fabrication of an ink jet recording apparatus of small size, and with low running costs. Also, in the case of (c), the vibration due to ink flow within the ink absorbing member 814 and the supply passage affects the inside of the nozzles, and is more likely to cause a discharge failure, resulting in a problem of impeding the fast and high quality recording.

Furthermore, as the recent trends, there have been remarkable progresses in the respects of:

A. Finer nozzles intended to increase the recording resolution

B. Lower surface tension of the ink intended to enhance the ink drying rate, wherein owing to the increased pressure loss in the case of A, or the increased bubble production frequency in the case of B, the problem of the ink unfilled state caused by the ink split has become increasingly more important.

As above described, in the conventional suction recovery methods, it was difficult to construct an ink jet recording apparatus having small size, low operating costs, high speeds, higher quality, high resolution recording, and high rate fixing, while avoiding or resolving the ink unfilled state due to ink split.

The conventional suction recovery means for stabilizing the ink discharge for use with the ink jet recording apparatus as above described involves making a simple suction operation with one peak of suction negative pressure by placing a cap made of an elastic material such as rubber into close contact with the ink jet recording head having a number of ink discharge ports to cover the discharge ports, and reducing the pressure within cap by means of a suction pump.

However, where the ink can not be discharged due to bank of bubbles in the ink supply passage, common liquid chamber and liquid channels provided with discharging heaters within the recording head, or where the ink can not be discharged due to broken meniscus of the ink discharge port, the ink residing within the recording head may be drawn back to the ink tank, with some bubbles left on the wall surface, owing to a negative pressure (capillary force) of the absorbing member holding the ink.

With such suction recovery means having an operation mode in which the peak of suction negative pressure occurs once when the ink is in the undischarged condition, if the suction negative pressure is set low enough not draw bubbles together with the ink from the ink tank containing the absorbing member holding the ink, bubbles already residing within the recording head can not be removed, while if the suction negative pressure is set high enough to be able to remove bubbles already residing within the recording head, the negative pressure (capillary force) of the absorbing member holding the ink and the suction negative pressure becomes unbalanced to draw bubbles together with the ink, possibly resulting in a print failure such as undischarged due to bubbles.

In particular, in an ink jet unit of the recording head/ink tank integral type in which an ink tank is replaceable, because of poor contact between the absorbing member holding the ink and the filter in the ink tank immediately after replacing the ink tank, bubbles are taken inform the ink tank into the ink supply passage, the common liquid chamber and the liquid channels provided with the discharging heaters within the recording head, if the suction negative pressure is high. Also, as the ink remain within the ink tank decreases, the negative pressure (capillary force) at which the ink tank holds the ink increases, and is unbalanced with the suction negative pressure to easily draw bubbles together with the ink to cause such bubbles to be brought into the recording head. In this way, in the condition where numerous bubbles exist within the recording head, when a new ink tank having a great amount of ink remain is attached, it is difficult to remove bubbles within the recording head without taking in bubbles from the ink tank, with suction recovery means involving suction operation where one peak of suction negative pressure occurs, easily bringing about a print failure such as undischarged due to bubbles.

Also, in an ink jet unit having a color recording head in which a plurality of discharge ports through which different color inks can be discharged within the same head are arranged on the same plane or straight line, and a plurality of ink tanks storing different color inks to be supplied to the color recording head, the plurality of discharge ports with different color inks are subjected to suction recovery simultaneously with one suction cap made of elastic material such as rubber. Therefore, if the suction operation where the peak of suction negative pressure occurs once, set at a high suction negative pressure to allow removal of bubbles successfully, was performed, with an ink tank having greater ink consumption, the absorbing member holding the ink had increased negative pressure (capillary force), so that the mixed inks of different colors expelled into the cap when a simple suction operation was conducted flowed back through the ink discharge ports into the liquid channels and the common liquid chamber, further into the ink supply passage, resulting in significant color mixture in some instances. To resolve this color mixture, the predischarge, if conducted, may take large amounts of discharged ink and the time.

In the field of ink jet recording, in recent years, the ink jet units of the cartridge form in which a recording head and an ink tank are integrated have been utilized from the standpoints of smaller apparatus and maintenance free. Such an ink jet unit is detachably mounted on a scanning carriage provided in the recording apparatus, and if the ink in the ink tank is used up, the user can simply replace it with a new ink jet unit.

In recent years, however, the demands for the color image have been raised, and to satisfy the demands for the coloration by the ink jet unit as above described, there have appeared, for performing the color recording, an arrangement having the ink jet units for colors in parallel along a scanning direction on the carriage, and an arrangement having a color ink jet unit in which an ink tank for storing the inks of yellow, magenta and cyan and a head for discharging these inks are integrally disposed in parallel, and a separate ink jet unit for the black alone disposed on the carriage, for example.

Particularly, the apparatuses using a recording head of integral type of mounting a color head cartridge containing yellow, magenta, cyan and black inks have been proposed, but none of them have not been put to practical use, and the color head cartridge that has been practically used is simply of such a construction that a recording head cartridge for three colors of yellow, magenta and cyan (hereinafter Y, M, C) integrally, and a black (hereinafter BK) recording head cartridge are replaceably provided, and the recording is performed with either one on the carriage. Further, with such apparatus practically used, no suction recovery operation is performed upon replacement of the head cartridge.

Furthermore, the above color head cartridge has an ink tank for three color of Y, M and C integrally, and if the ink is used up, the head cartridge itself must be replaced.

In detachably mounting the color head cartridge of integral type for Y, M and C, or the BK head cartridge which is replaceable with each other on the recording apparatus main body, the suction recovery operation should be carried out to provided superior image reliability and stability. However, the suction recovery operation, if performed under the same conditions for the color head cartridge of integral type for Y, M, C or Y, M, C, BK and the BK head cartridge, will result in wasteful consumption of the ink, because the maximum recovery condition must be employed in both cases.

And it has been found that because of the use of the color head unit, it is difficult to prevent degradation or disorder of the printed image owing to color mixture between color nozzles.

SUMMARY OF THE INVENTION

It is an object of the present invention to provide an ink jet recording apparatus and a recovery method thereof, in which a plurality of different heads can be replaced and freely mounted or demounted, and wherein the recovery operation or the suction condition for the ink jet recording apparatus is made different from each other, while the color mixture between color nozzles in a color head unit can be prevented.

To accomplish such an object, the present invention provides an ink jet recording apparatus in which a plurality of types of heads or head cartridges can be replaced on the replacement position set along a main scan direction in the recording apparatus having a recording head detachably mounted at a predetermined position on a carriage, wherein a head, upon being mounted, is brought into contact with an electrical contact face provided on the carriage to identify the plurality of types of heads which are each provided with an ID of its own for the identification of head type, thereby setting the recovery condition or the suction condition in accordance with the head type as identified.

If the BK head cartridge is identified, the recovery condition I is selected to perform the suction operation, wiping operation, and predischarge corresponding to BK. Then, if the color head cartridge is detected to be mounted, the recovery condition II is selected to perform the color suction operation, wiping and color predischarge (for prevention of color mixture).

Also, if the color head cartridge is detected and further the replacement of ink tank is detected or predicted, the recovery condition III is selected to perform the tank replacement suction operation, color suction operation, wiping and color predischarge (for prevention of color mixture) for the optimization.

Thus, according to the present invention, the type of head or head cartridge is automatically discriminated to optimize the recovery operation, and thus prevent the wasteful ink consumption due to suction operation, or the color mixture of the color head, whereby the reliable and stable ink discharge can be effected.

It is another object of the present invention to provide an ink jet recording apparatus and a recovery method thereof which can secure the enough supply of the ink to the discharge ports by eliminating the ink unfilled state caused by the ink split.

To accomplish such an object, the present invention provides an ink jet recording apparatus comprising ink discharge means for discharging the ink to make the image recording, and suction means having a cap and a suction pump for sucking the ink within this ink discharge means to expel it outside, wherein there is provided a prior-to-suction predischarge recovery mode of operating said suction means after discharging the ink to the non-image area.

According to the present invention, an ink jet recording apparatus having an effective recovery method to resolve the ink split state can be constructed, whereby the ink jet recording apparatus can be made smaller and has low running costs, and can effect the fast, high quality and high resolution recording, with the fast fixing.

It is a further object of the present invention to provide an ink jet recording apparatus having an ink jet unit of the recording head/ink tank integral type in which an ink tank can be replaced, wherein bubbles can be extinguished from an ink supply passage, a common liquid chamber, and the liquid channels in which discharging heaters are provided, and wherein the ink jet unit comprising a color recording head having a plurality of discharge ports capable of discharging different color inks from the same head arranged on the same plane or straight line, and a plurality of ink tanks for storing different color inks to be supplied to the color recording head is provided with suction recovery means for preventing the color mixture after suction to always effect the stable recording without having a print failure.

Such ink jet recording apparatus of the present invention comprises a recording head having the discharge ports for discharging the ink, an ink tank for storing the ink to be supplied to the recording head, and suction recovery means for stabilizing the ink discharge from the recording head, characterized in that said suction recovery means has a plurality of suction operations, which can be selected in accordance with the content of the discharge stabilization.

Also, the ink jet recording apparatus of the present invention comprises a color recording head having a plurality of discharge ports capable of discharging different color inks arranged on the same plane or straight line, a plurality of ink tanks for storing the inks of different colors to be supplied to said color recording head, and suction recovery means for stabilizing the ink discharge from said color recording head with only one cap provided for the suction, characterized in that said suction recovery means makes the suction in such a way as to divide the motion of piston stroke in the suction operation into plural sections to intermittently perform the operation.

In the present invention, a plurality of suction operations in the suction recovery means should be made at different pressures in sucking the ink from the discharge ports, and it is more effective to perform two or more different types of suction operations consecutively. Furthermore, the suction operation is desirably continuously switched in succession from higher suction pressure to lower suction pressure, and preferably in accordance with the ink remain within the ink tank.

And in an ink jet unit having a color recording head having a plurality of discharge ports capable of discharging different color inks arranged on the same plane or straight line, and a plurality of ink tanks for storing different color inks to be supplied to the color recording head, the suction operation of the suction recovery means should be changed in accordance with the state of each color, and it is desirable to set the suction operation of suction recovery means with the minimum ink remain among the ink tanks for multiple colors.

In an ink jet recording apparatus using an ink jet unit of the recording head/ink tank integral type in which the recording head and the ink tank can be replaced at will, the use of said suction recovery means is very effective.

BRIEF DESCRIPTION OF THE DRAWINGS

FIGS. 14A(1) and 14B(1) are views showing how to demount an ink tank for the color head therefrom FIGS. 14A(2) and 14B(2) being close-up views of ink tanks.

FIGS. 15A(1) and 15B are views showing how to demount a color head from the carriage portion FIG. 15A(2) being a close-up view of ink tanks.

DETAILED DESCRIPTION OF THE PREFERRED EMBODIMENTS

Figure 1:
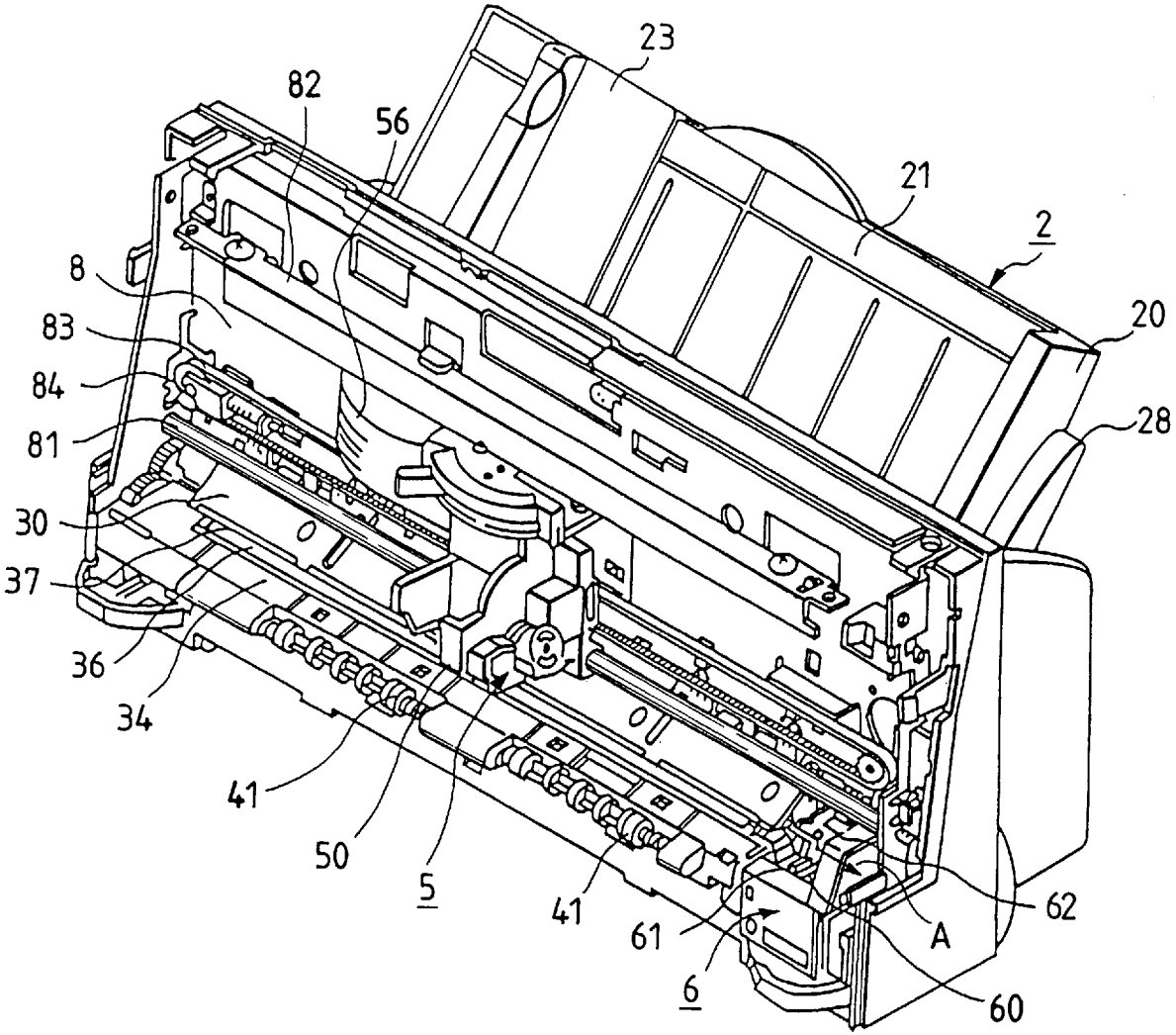
FIG. 1 is a perspective view for exemplifying the overall construction of an ink jet recording apparatus according to the present invention.

An ink jet recording apparatus according to the present invention is schematically shown in FIG. 1, and will be described below. FIG. 1 is a perspective view showing the overall construction of the recording apparatus. The recording apparatus is comprised of a sheet supply unit 2, a sheet feeding unit 30, 34, 36, 37, a sheet exhausting unit 41, a carriage unit 5, 50, and a cleaning unit 6, 60, 61.

A carriage portion 50 is provided with an electrical contact point for making connection with a head cartridge upon mounting the head cartridge. The electrical contact point is provided at the end of a flexible cable 56, the other end being attached to an electrical base board within a main body, not shown. The printing is performed by discharging the ink, while the carriage 50 is being reciprocated along a guide shaft 81 useful in reciprocally scanning in a direction perpendicular to a conveying direction (sub-scan direction) of the recording sheet.

A cleaning portion 6 has a pump 60 for the cleaning when a head cartridge 7 as shown in FIGS. 2A to 2D is mounted on the main unit, and a cap 61 for preventing drying of the nozzles of the recording head 7 and sticking of the dirt from the outside. Also, it is provided with a blade made of an elastic material for removing the dirt sticking to the nozzle portion of head or ink droplets adhering thereto after practicing the suction operation. The material of blade is preferably urethane rubber or HNBR rubber which is non-reactive to the ink and further non-hydrolytic to minimize the damage against the face plane of head.

Figure 2A:
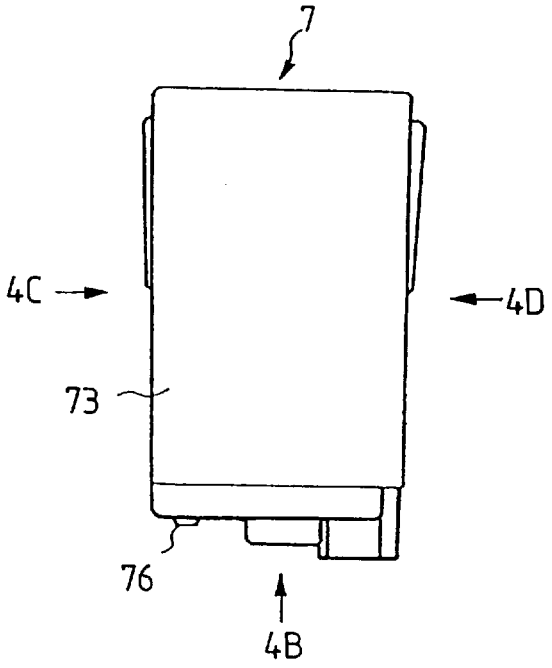
FIGS. 2A to 2D are views for illustrating the construction of a BK head according to the invention.
Figure 2B:
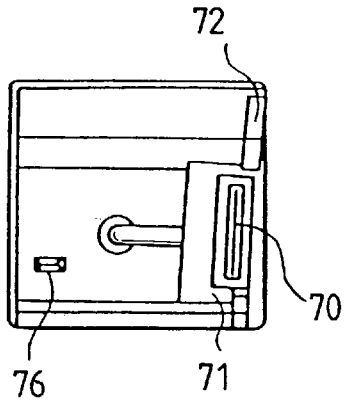
Figure 2C:
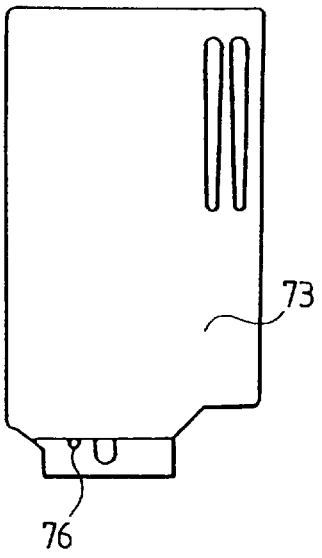
Figure 2D:
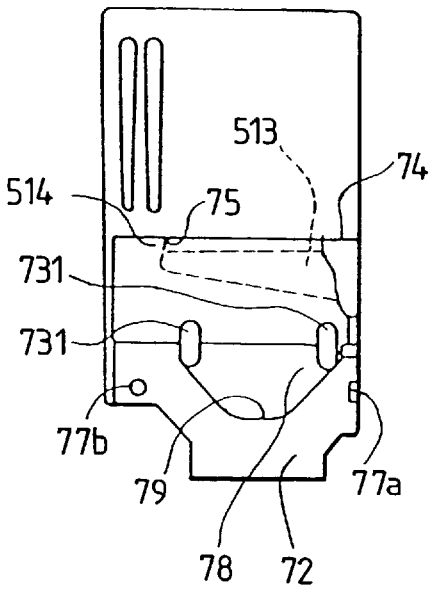

FIGS. 2A to 2D are views illustrating the appearance of a first BK head cartridge 7 (hereinafter simply referred to as a BK head) which is mounted on the recording apparatus (see FIG. 1) according to the present invention, in which FIG. 2A is a rear view, FIG. 2B is a front (or face plane) view as looked from the arrow 4B of FIG. 2A, and FIGS. 2C and 2D are side views as looked from the arrows 4C and 4D of FIG. 2A, respectively.

The BK head cartridge 7 is an easily replaceable ink jet recording head which is integrally constructed with an ink tank, the head portion having means capable of transferring heat by a heater or the like to the ink, this heat bringing about the film boiling in the ink, whereby the print image is formed on the recording medium by discharging the ink through the nozzles 70 of the recording head cartridge 7 with pressure changes produced by the growth of bubbles which this film boiling causes.

Specifically, the head 7 has discharge nozzles, with the ink discharge amount designed at about 90 ng/dot (1 ng=$1\times10^{-9}$ g), and the print drive frequency being 6 KHz. The ink used had the composition of exhibiting good print quality on the plain paper. Specific ink composition is listed in Table 1, but is not limited to those values.

TABLE 1

| BK ink composition | |
|---|---|
| BK dye | 3 parts |
| Glycerine | 5 parts |
| Ethylene glycol | 5 parts |
| Urea | 5 parts |
| Isopropyl alcohol | 3 quantities |
| Water | Remainder |
| PH conditioner | Slight amount |

Figure 3:
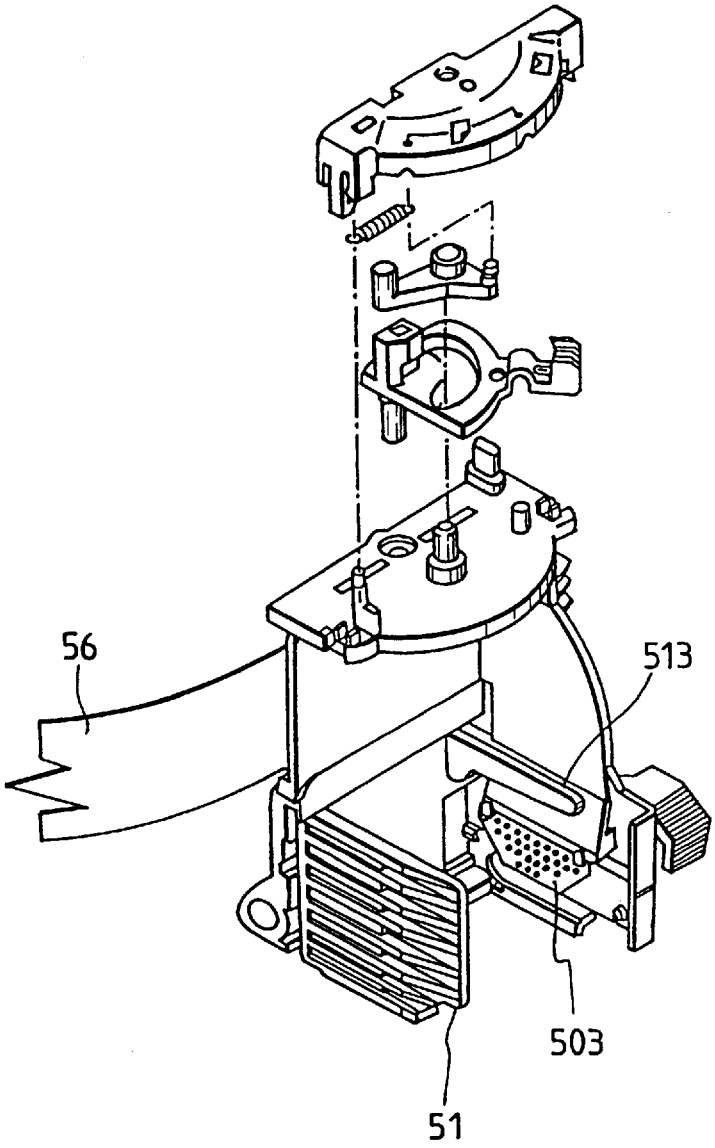
FIG. 3 is a perspective view of a carriage portion according to the invention.
Figure 4:
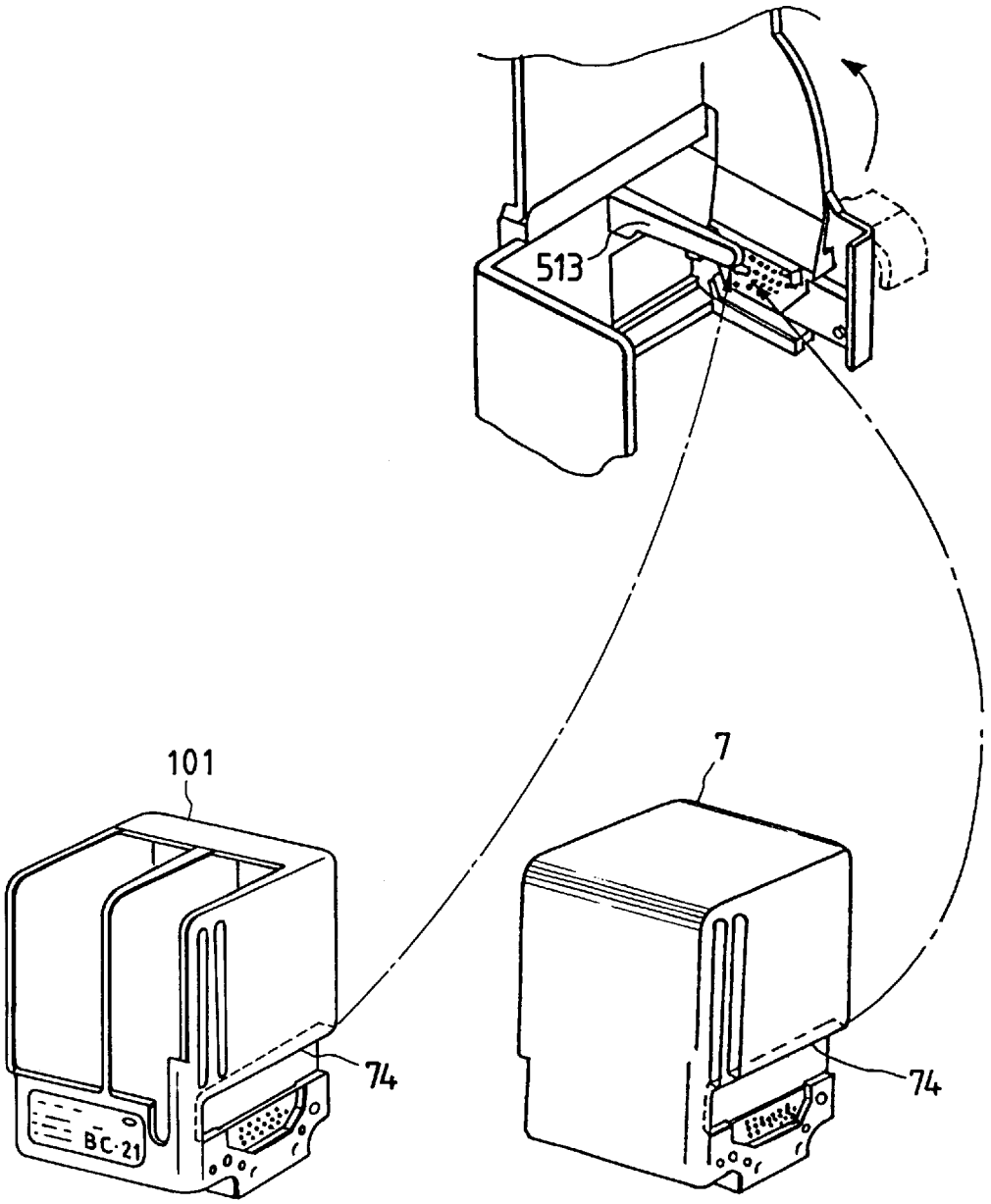
FIG. 4 is a perspective view showing how to mount a BK head or color head to the carriage portion.

FIG. 3 is an exploded perspective view illustrating the construction of the carriage portion 5 in detail, and FIG. 4 is a perspective view showing the mounting of the BK head cartridge 7 or a color head cartridge 101 as hereinafter described to the carriage portion 5.

Upon mounting the BK head cartridge 7 to the carriage portion 5, the electrical connection is made.

Figure 5A:
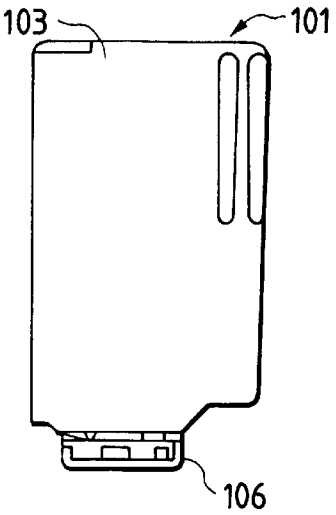
FIGS. 5A to 5E are views for illustrating the construction of a color head according to the invention.
Figure 5B:
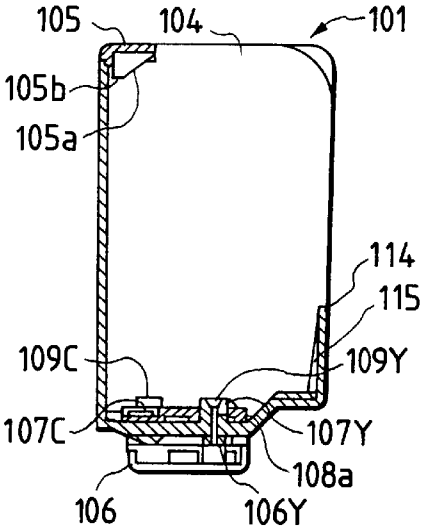
Figure 5C:
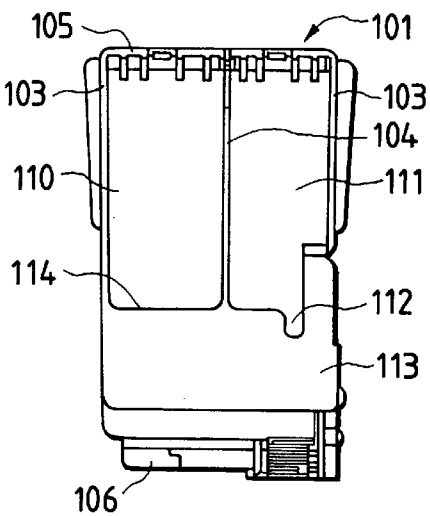

FIGS. 5A to 5E are views schematically illustrating the color head cartridge 101 (hereinafter also referred to as a color head). The head 101 is provided with ink tank mounting portions 110 and 111. As shown in FIGS. 5A, 5B and 5C, the color head comprises a front plate 113 for constituting a storage space of the ink tank together with a housing 103 having a pair of side plates and a back plate connecting the pair of side plates, and a middle plate 104 for dividing a space portion surrounded by these plates into two regions, divided spaces being a color ink tank mounting portion 110 and a black ink tank mounting portion 111.

On the bottom of the color head 101 are provided the ink introducing tubes 107 (Y, M, C, BK; M, BK not shown), which are inserted into the ink tank, for introducing the ink from the ink tank into a recording head portion 120 having the nozzles BK, C, M and Y (120BK, 120C, 120M, 120Y respectively), these introducing tubes extending a predetermined length into the mounting portions 110 and 111 so as to be insertable into the ink tank.

At the opening portions inside housing for the ink introducing tubes 107 disposed on the mounting portions 110, 111 on which the color ink tank and the black ink tank are mounted, there are provided filters 109 (Y, M, C, BK; M, BK not shown), as shown in FIGS. 5A to 5E, extending a predetermined length into the inside of the mounting portions 110 and 111 to be insertable into an ink supply port of ink tank.

Figure 5D:
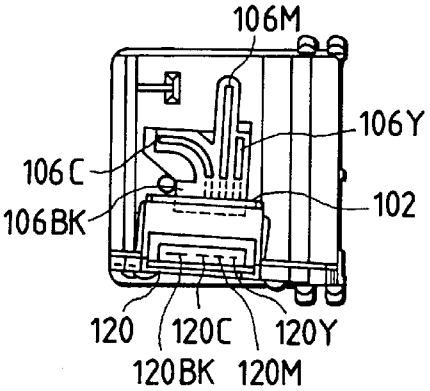
Figure 5E:
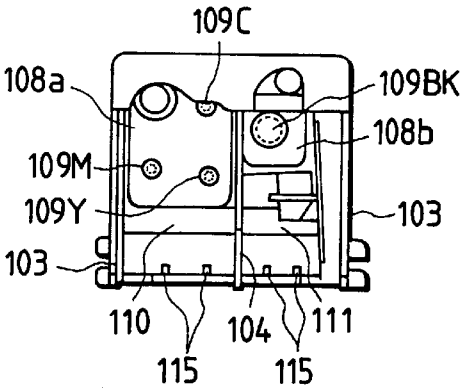
Figure 6A:
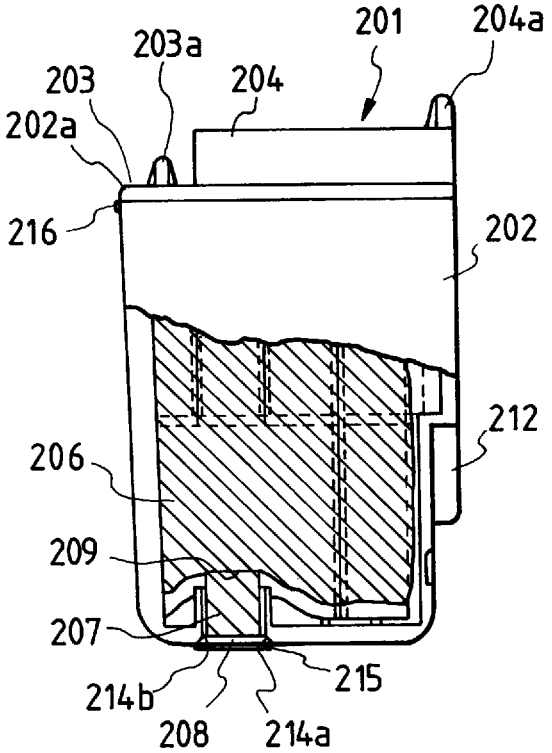
FIGS. 6A to 6D are views for illustrating the construction of a black ink tank for the color head.
Figure 6B:
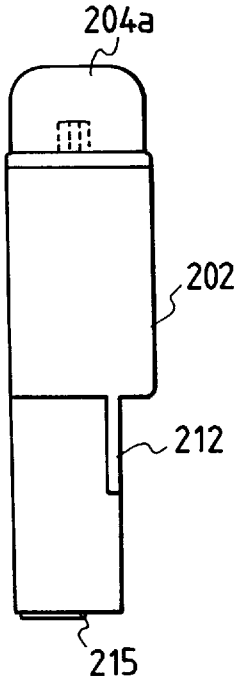
Figure 6C:
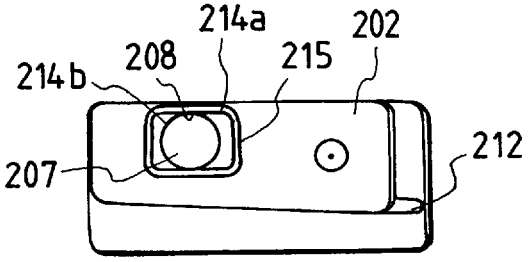
Figure 6D:
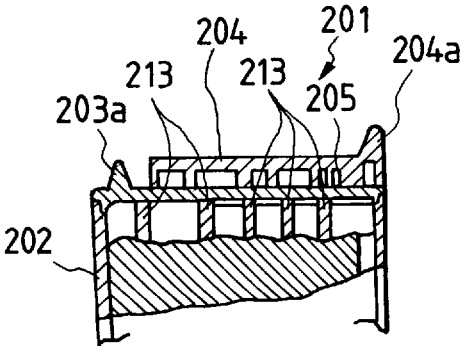
Figure 7A:
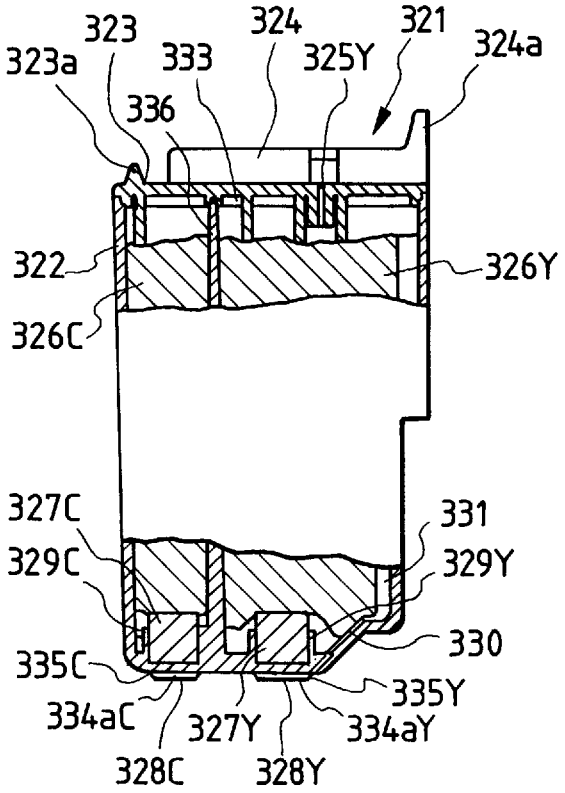
FIGS. 7A to 7D are views for illustrating the construction of a color ink tank for the color head.
Figure 7B:
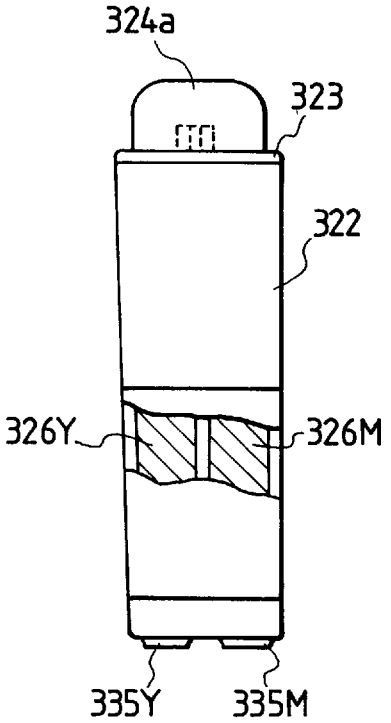
Figure 7C:
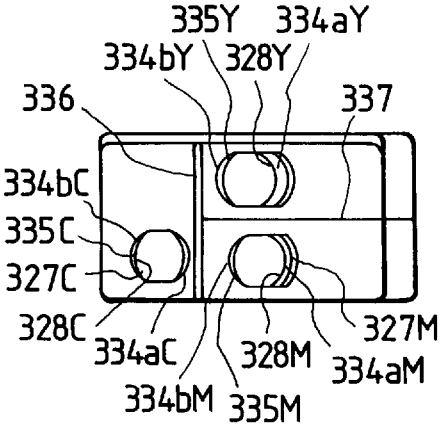
Figure 7D:
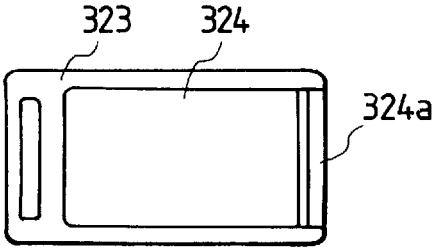

The ink supply tubes 106 (Y, M, C, BK) are provided on the bottom surface of the recording head from the ink introducing tubes 107 to the recording head, as shown in FIG. 5D.

Also, on the surface of the mounting portions where the ink introducing tubes 107 are disposed, elastic plates 108 (a, b) having a predetermined thickness are laid around the periphery of the ink introducing tubes 107. The elastic plates 108 (a, b) are abutted by ribs provided on the ink supply port of ink tank, to prevent the ink from leaking into the color head.

It should be noted that a notch portion 112 is provided at a position opposite a mounting portion 111 of the front plate 113, as shown in FIG. 5C. Into this notch portion is insertable a rib provided in the black ink tank for storing the black ink, designed to prevent false insertion of a color ink tank for storing yellow, magenta and cyan inks.

For the color head 101 as above constructed, an ink tank for storing the black ink is mounted on the mounting portion 111 and a color ink tank for storing yellow, magenta, and cyan inks is mounted on a mounting portion 110.

FIGS. 6A to 6D show the schematic constitution of a BK ink tank 201 for storing the black ink, i,e., a side view, a front view, and bottom side and top side views in cross section, respectively, with the part broken away. In the figure, 201 is an ink tank, 202 is a housing for ink storage, and 203 is a lid member having an atmosphere communicating opening 205. 204 is an upper member having a gripper portion 204*a* for use in mounting or demounting the tank. And on the bottom of the ink tank, there are provided an ink supply opening 208 into which an introducing tube 107 (BK) for the color head 101 is inserted, a rib 215 extending outwards around the periphery of the supply opening 208, and inclined portions 214*a* and 214*b* for the communication between the ink supply opening 208 and the rib 215.

Also, a rib 212 is provided on a part of the side face where the gripper portion 204*a* of the ink tank 201 is provided, preventing false insertion of ink tank 201, in cooperation with a notch portion 112 provided on the front plate 113 in the mounting portion 111 of the color head 101. Also, this rib 212 is also used as a guide for mounting the ink tank 201. 206 is an ink receiving member which is a porous member made of a material such as urethane, and 207 is an ink introducing member which is an ink holding member like a fiber bundle. 209 is a support member for supporting the ink introducing member 207 within the tank.

FIGS. 7A to 7D are schematic constitutional views illustrating a color ink tank. In this example, a color ink tank 321 for storing the inks of yellow (Y), magenta (M), and cyan (C) is constructed having the ink tanks storing those inks integrally. The construction is identical to that of the black ink tank as described in FIGS. 6A to 6D.

The color ink tank 321 is partitioned by partition members 336 and 337 of substantially T-character shape within an ink storing housing 322. The amount of the color ink to be stored within each ink tank as thus partitioned is designed to be substantially equal.

The constitution of this ink tank will be described below. The ink tank 321 comprises an ink storing housing 322, a lid member 323 for covering the housing 322 and provided with atmosphere communicating openings 325 (Y, M, C; M, C not shown), and an upper member 324 attached on top of the lid member 323 and having a space serving as a buffer chamber to prevent ink leakage through each atmosphere communicating opening 325 from passing outside, as well as one atmosphere opening hole at a position different from the positions of atmosphere communicating openings 325, and a gripper portion 324*a* for use in mounting or demounting the color head 101.

And on the bottom of the ink tank, there are provided ink supply openings 328 (Y, M, C) into which the introducing tubes 107 (Y, M, C) of the color head 101 are inserted, with ribs 335 (Y, M, C) projecting outwards around the periphery thereof, and inclined portions 334*a* (Y, M, C) for connecting the ink supply openings 328 (Y, M, C) to the ribs 335 (Y, M, C), respectively.

The ink tank 321 is mounted to the color head 101 by use of the rotational motion, and has inclined surfaces at slight angle on the side of 334*a* (Y, M, C) to prevent the ink supply openings 328 (Y, M, C) from abutting on the top end of the introducing tubes 107 to impede the smooth mounting.

The ink storing members 326 (Y, M, C) are received inside the ink tank 321, and the ink introducing members 327 (Y, M, C) are provided between the ink storing members 326 (Y, M, C) and the ink supply openings 328 (Y, M, C), respectively. And on the inner surface of support member 329 (Y, M, C) for supporting the ink introducing member 327 (Y, M, C) within the tank is provided a slit for communicating the inside of the ink tank to the outside.

As to the composition of the ink, the black ink used had excellent print quality on the so-called plain paper as commonly used, in which the character quality for the text was dense, and favorable in clearness. Also, the color ink used was less likely to blur the image at the boundary where the inks adjoin. The exemplary composition of each color ink is listed in Table 2.

TABLE 2

| Exemplary composition of color ink | |
|---|---|
| <Y ink> | |
| Y die | 2 parts |
| Thiodiglycol | 7 parts |
| Glycerine | 7 parts |
| Urea | 7 parts |
| Interfacial active agent | 1 part |
| PH conditioner | Slight amount |
| Water | Remainder |
| <M ink> | |
| M die | 3 parts |
| Thiodiglycol | 7 parts |
| Glycerine | 7 parts |
| Urea | 7 parts |
| Interfacial active agent | 1 part |
| PH conditioner | Slight amount |
| Water | Remainder |
| <C ink> | |
| C die | 4 parts |
| Thiodiglycol | 7 parts |
| Glycerine | 7 parts |
| Urea | 7 parts |
| Interfacial active agent | 1 part |
| PH conditioner | Slight amount |
| Water | Remainder |

Also, the color head 101 takes the configuration of having a black nozzle and three sorts of color nozzles (Y, M, C) arranged in the straight line. Specifically, the black comprises a group of 64 nozzles, with the discharge amount of ink droplets being designed to be about 90 ng/dot (1 ng=$1\times 10^{-9}$ g). Also, the color nozzle has a group of 24 nozzles for each of yellow, magenta and cyan, with the discharge amount of ink droplets being about 40 ng/dot. The spacing between each nozzle group is a distance equivalent to about 8 nozzles. The print driving frequency is 6 KHz which is equal to that of the BK head cartridge.

Figure 8:
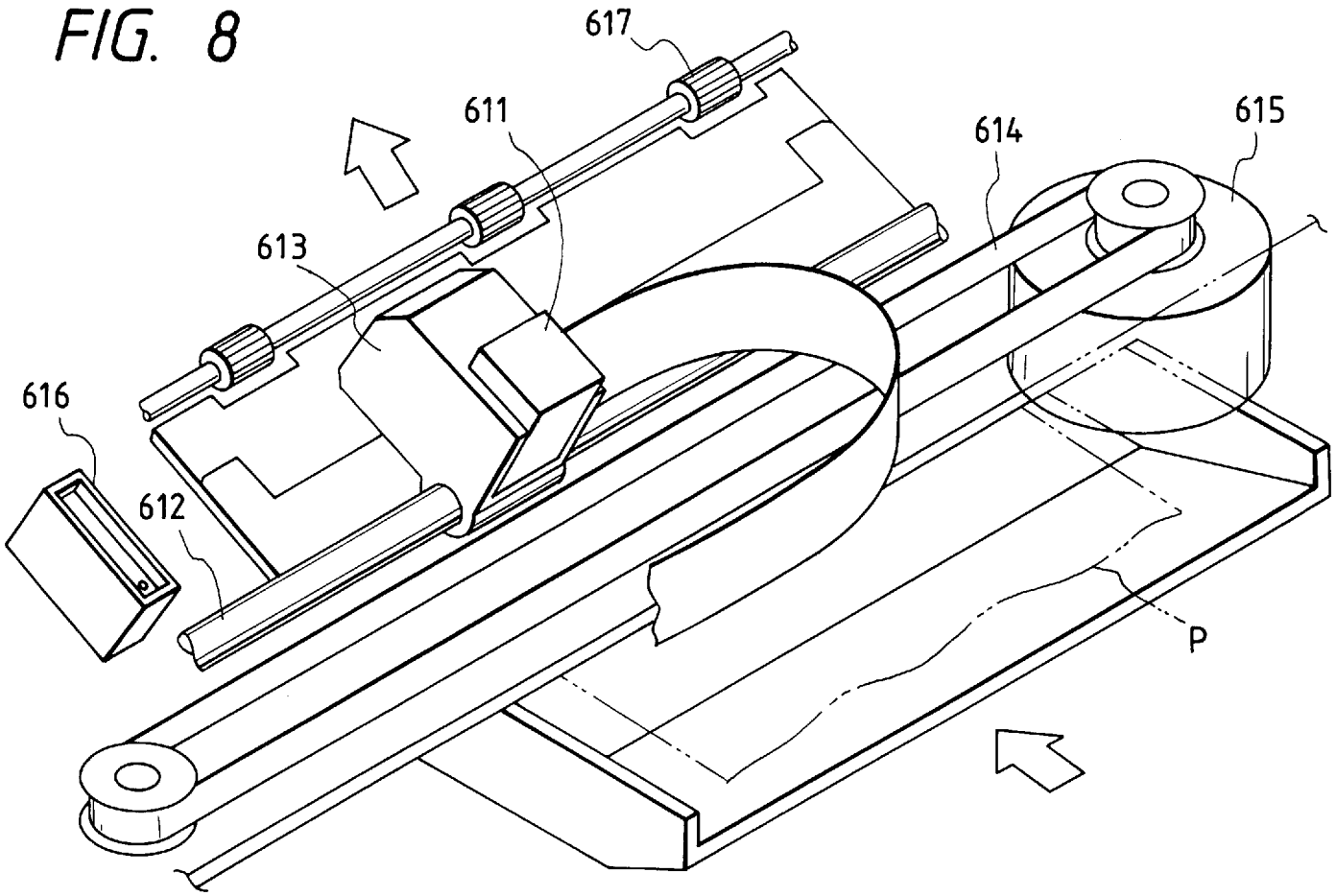
FIG. 8 is a perspective view exemplifying in essence another ink jet recording apparatus according to the present invention.

FIG. 8 is a perspective view exemplifying the essential construction of another ink jet recording apparatus according to the present invention. An ink jet unit 611 having an array of discharge ports for discharging the ink is installed on a carriage 613. The recording sheet P such as a paper or a plastic thin sheet is carried via a conveying roller (not shown) by sheet exhausting rollers 617, and fed in a direction of the arrow by the driving of the conveying motor not shown. The carriage 613 is guided and supported by a guide shaft 612 and an encoder (not shown). The carriage 613 is reciprocated along the guide shaft 612 via a driving belt 614 by the driving of a carriage motor 615.

In the inside (or a liquid channel) of each of the ink discharge ports for the ink jet unit (detailed later in FIGS. 9 and 10) is provided an heat generating element (electrothermal energy converter) for generating the heat energy for the ink discharge. The heat generating elements are driven in accordance with the read timing of the encoder (not shown) and based on a recording signal to cause ink droplets to be jetted and attached to the recording sheet P to form an image.

A recovery unit having a cap portion 616 is disposed at a home position (HP) of the carriage chosen outside the recording area. When the recording is performed, the carriage 613 is moved to the home position (HP) to enclose the ink discharge port formation face of the ink jet unit with the cap 616 to prevent fixing of the ink which is caused by evaporation of ink solvent or the clogging due to sticking of the foreign matter such as dust or paper powder.

Also, the capping function of the cap portion is utilized for a predischarge mode of discharging the ink into the cap portion 616 located away from the ink discharge port face to resolve discharge failure or clogging due to ink thickening or fixing at or around the ink discharge ports at low recording frequency, or employed for the discharge recovery of ink discharge ports having caused a discharge failure by activating a pump (not shown) in the capped state and sucking the ink from ink discharge ports. Also, it is possible to clean the ink discharge port formation face of the ink jet unit by disposing a blade adjacent the cap portion.

Figure 9:
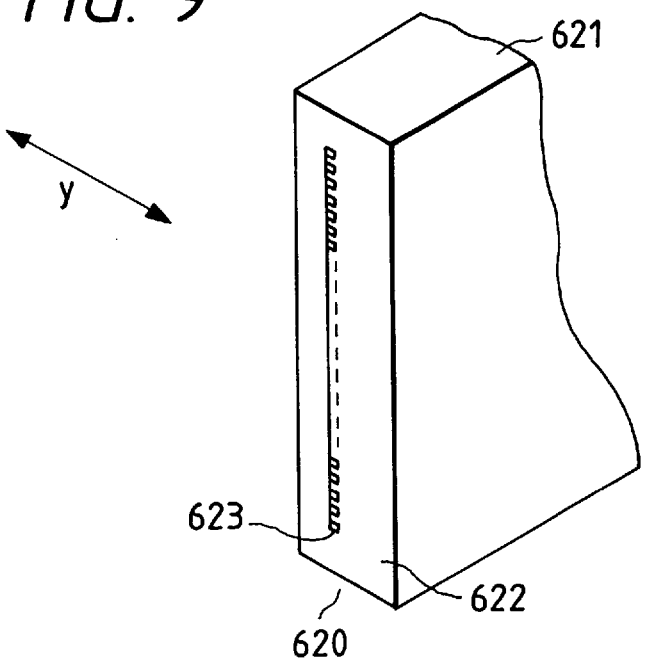
FIG. 9 is a typical perspective view showing in essence an ink jet recording head.
Figure 10:
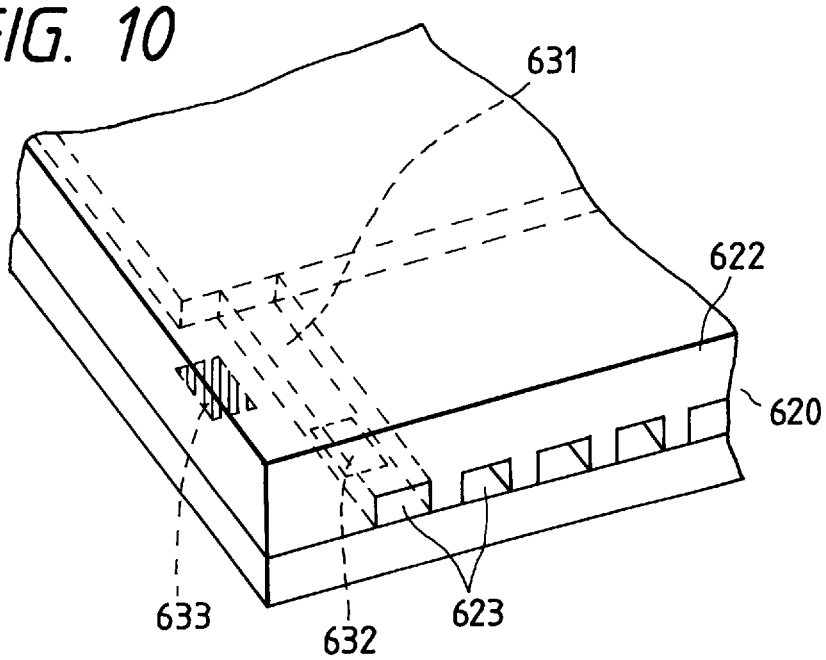
FIG. 10 is a partial perspective view schematically showing the structure of an ink discharge portion of the ink jet recording head.

FIG. 9 is a schematic perspective view of an array of ink discharge ports of the recording head as ink discharge means as looked from the recording sheet, and FIG. 10 is a partial perspective view schematically showing the structure of the ink discharge portion. This recording head has a discharge port face 622 having a plurality of discharge ports 623 opened, in which the discharge energy generating elements 632 for generating the energy necessary to discharge the ink are respectively arranged in the liquid channel portions 631 communicating to discharge ports 623. The arrow y points to a scanning direction of the carriage 613. 633 in FIG. 10 is a sensor for sensing the recording head temperature, and in this example, a thermistor 633 provided at either end of the array of discharge ports. The temperature sensing means is not limited to such sensor, but may be other sensors such as a diode sensor, and further the head temperature may be calculated from the duty of print dot.

Figure 11:
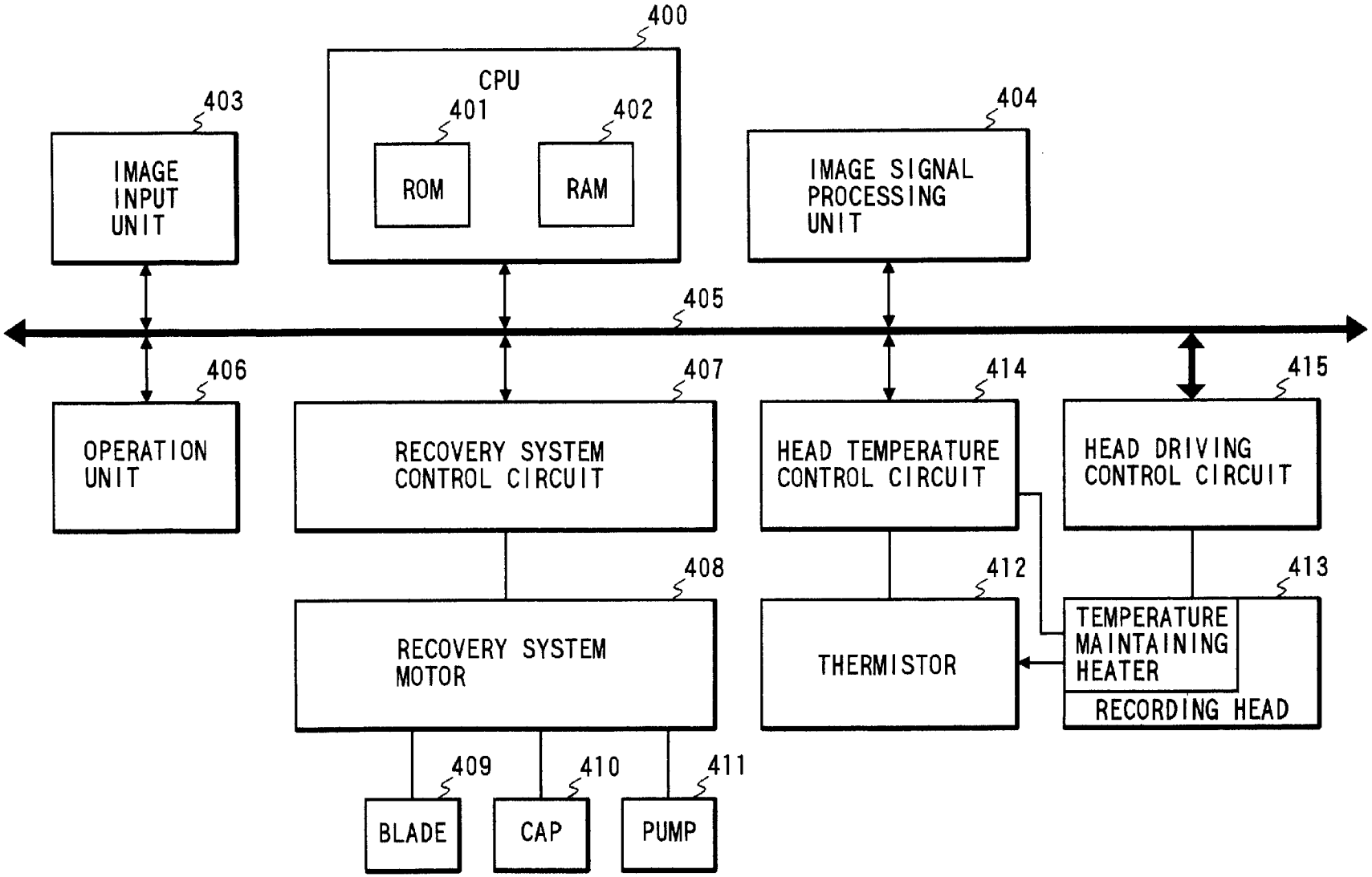
FIG. 11 is a block diagram of the ink jet recording apparatus according to the invention.

FIG. 11 is a block diagram of an ink jet recording apparatus according to the present invention. In FIG. 11, the apparatus is largely divided into software system processing means including an image input unit 403 for having access to a main bus line 405, an image signal processing unit 404 correspondingly provided, and a central control unit CPU 400, and hardware system processing means including an operation unit 406, a recovery system control circuit 407, an ink jet head temperature control circuit 414, and a head driving control circuit 415. The CPU 400 has normally a ROM 401 and a random memory (RAM) 402 for giving the proper recording condition to input information to drive the recording head 413 in effecting the recording. Also, a program for executing a recovery timing chart is prestored within the RAM 402, as required, to provide the recovery condition such as a predischarge condition to a recovery system control circuit 407, the recording head and a temperature maintaining heater. A recovery system motor 408 drives the recording head, the cleaning blade 409 facing this with a spacing, the cap 410 and the suction pump 411, as previously described. A head driving control circuit 415 controls the driving condition of thermoelectrical converters for the ink discharge from the thermal head, allowing the recording head to effect predischarge or ink discharge for recording.

On the other hand, the thermal head 413 has a temperature maintaining heater provided on a substrate where the thermoelectrical converters for ink discharge are disposed, to be able to raise or control the ink temperature within the thermal head to a desired set temperature. The thermistor 412 is also provided on the substrate to measure substantially the ink temperature inside the recording head. The thermistor 412 may be provided not on the substrate but outside the substrate, or may be disposed near or around the recording thermal head.

Figure 12:
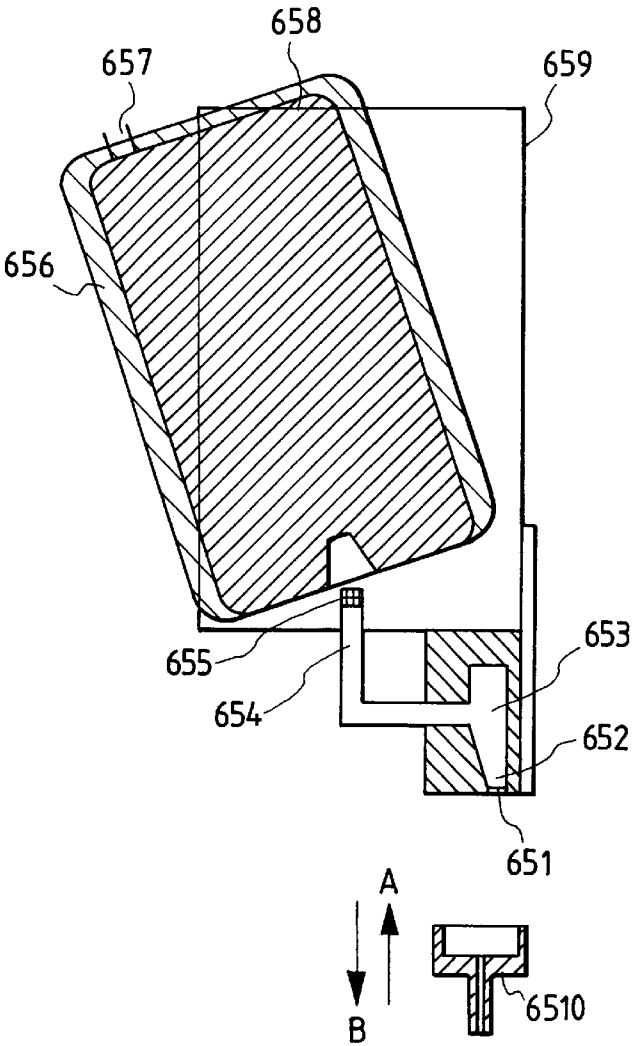
FIG. 12 is a typical view showing an ink jet unit and a suction cap according to the invention.

FIG. 12 is a schematic view illustrating an ink jet unit together with a suction cap of the recording head/ink tank integral type in which the ink tank is replaceable at will.

An ink tank 656 having an atmosphere communicating opening 657 for communicating the ink to the atmosphere and containing an absorbing member 658 holding the ink can be mounted along a tank guide 659 to a recording head. The ink supply into the recording head is made from the ink tank 656 to liquid channels 652 having discharging heaters disposed behind ink discharge ports 651 via a common liquid chamber 653 communicating to the liquid channels and through an ink supply passage 654 communicating to the common liquid chamber, with a filter 655. The suction cap 6501 is moved in a direction of the arrow A to enclose the ink discharge port formation face 651, so that the ink can be sucked by a suction pump not shown, and if the suction is completed, the suction cap is moved back in a direction of the arrow B to open the ink discharge port formation face 651.

Figure 13:
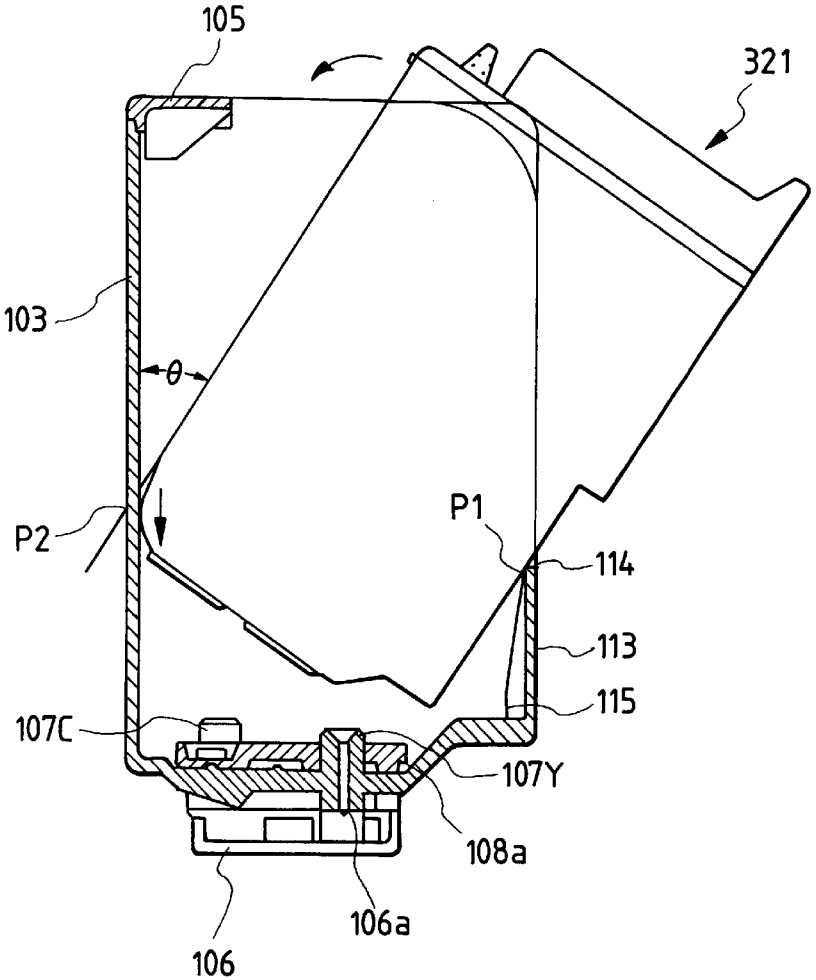
FIG. 13 is a view showing how to mount an ink tank to the color head.

FIG. 13 shows how the ink tank 321 is mounted rotationally on an upper portion 114 of the front plate 113 for the ink jet unit 101, with a part of the housing as the guide. In FIGS. 14A and 14B which are typical views illustrating how the replacement operation is conducted on the main unit, the mounting of an ink tank is schematically illustrated. 321*b* is a black ink tank and 321*c* is a color ink tank. Also, FIGS. 15A and 15B are schematic views showing the replacing operation of a head cartridge, in which the BK head cartridge 7 and the color head cartridge 101 can be also replaced.

FIGS. 15A and 15B representatively illustrate how to replace the color head cartridge 101 using a lever 101*a*.

As above described, this recording apparatus allows for the replacement of the black head cartridge 7 and the color head cartridge 101 at will on the main unit, in which the head type for every head cartridge 7, 101 can be identified on the main unit of the recording apparatus.

This application is directed to provide the stable printing with high image quality by discriminating the type of head or the kind of ink color to effect the optimal recovery operation at any time to enhance the head reliability. The specific recovery operation will be described below.

If a BK head cartridge 7 or a color head cartridge 101 is mounted on the recording apparatus, the contact point on the carriage and the PCB (wiring board) of head are electrically coupled to detect the ID (inherent information) which the head itself owns to determine the type of head within the recording apparatus main unit.

The recovery operation or recovery sequence optimal to the head is set from the discrimination information.

First, in detecting the BK head cartridge, the recovery operation I is set. This is utilized for an automatic recovery operation in replacing the head, a manual suction recovery operation of the user, a timer suction recovery operation for removing bubbles within the head after a predetermined time, and an automatic recovery operation in turning on the power.

The recovery operation I specifically consists of the following sequence of operations.

Recovery operation I (a) Suction operation A (b) Idle suction operation (c) Wiping operation (d) Predischarge A1

(e) Idle suction operation twice (f) Wiping operation twice (g) Predischarge B1

Suction operation A as above listed uses a pump as negative pressure generating means, the ink suction amount being set at about one to two times the total capacity of the supply system of BK head cartridge 7. Specifically, one suction operation can suck about 0.15 cc. Idle suction operation as subsequently performed is one for expelling the residual ink which is left within the cap by the previous suction operation, and the wiping is performed to remove ink droplets or the dirt adhering to the head face plane.

Predischarge A1 is performed to resolve the dirt by forcing ink droplets remaining on the face plane in wiping into the nozzles. Specifically, 50 shots are discharged from all the nozzles at a discharge frequency lower than the print driving maximum frequency to enable the stable discharge. The number of predischarge shots may be smaller because of the use of BK alone.

The reason why the idle suction operation is subsequently performed twice is to prevent the ink remaining within the pump which executes the suction operation.

Since the BK head cartridge 7 used in this application uses the good water-proof ink, it is necessary to prevent the ink fixing within the pump. Then, the wiping operation is performed to clean the head face plane, and predischarge B1 is performed. Specifically, 100 shots are discharged from all the nozzles. The driving frequency is equal to that of predischarge. The predischarge for the wiping is practiced under the same condition when cleaning the head face plane during or before the printing, and thus is set at slightly more shots to resolve the accumulation of thickened ink.

Then, when the color head cartridge 101 is replace, and a new head cartridge is mounted on the recording apparatus, the ID inherent to the head is detected, and the recovery operations II and III are set.

The recovery operation II is utilized for an automatic suction operation in exchanging the head, a manual suction recovery operation, and a timer suction operation to remove bubble banks after a predetermined time. Also, the recovery operation III is performed in the tank replacement task.

The color head cartridge 101 is of replaceable structure in which the head portion for discharging the ink and the ink tank are separable. The ink tank has detachably the BK ink tank 201 and the color ink tank 321 of three color integral type for Y, M, C, as previously described.

The recovery operation II will be described below. A sequence of performing the following operations is incorporated:

(a) Predischarge C2

(b) Suction operation B1

(c) Idle suction operation (d) Wiping operation (e) Predischarge A2

(f) Idle suction operation twice (g) Wiping operation twice (h) Predischarge B2

Each of the operations will be described below. Prior to the recovery operation II, predischarge C2 is performed. This is intended to perform the suction operation efficiently by increasing the negative pressure within the nozzles for the suction, wherein small bubbles residing internally can be merged together or expelled through the nozzles outside by predischarging the ink amount greater than the volume inside the nozzles and the liquid chamber, when bubbles remain within the nozzles and liquid chamber.

Subsequently, suction operation B1 is performed. The suction operation B1 is effected by sucking the nozzles of four colors BK, Y, M, C into one cap, the suction amount being designed to be twice or more the total volume from the top end of nozzles for each color (BK, Y, M, C) to the filter portion coupled to the ink tank. Further, the suction operation B1 draws the above-mentioned suction amount at three stages of suction, but not once, its suction amount being about 0.3 cc. The reason of performing the suction at three stages is to regulate the peak value of negative pressure at the time of suction, resulting in suppressed occurrence of bubbles in suction. This will be detailed later.

Subsequently, the idle suction operation for emptying the ink within the cap which is filled with the ink in the suction operation is performed. And predischarge A2 for resolving the color mixture is performed to prevent the mixture of color ink into other color nozzles at the time of suction. The predischarge A2 involves a special predischarge in view of efficiency, in which the maximum efficiency for color mixture can be attained with the least number of discharges by repeating a discharge from all nozzles simultaneously and a discharge from the nozzles at the end.

The predischarge A2 for expelling the mixed color ink out of the nozzles is performed because it is necessary to discharge the ink particularly from the nozzles at the end to remove the mixed color ink left on the wall surface at the end of the nozzles, i.e., at the end of the liquid chamber making up the nozzles. The nozzles in the central portion can be recovered with a relatively smaller number of discharges to provide the smooth flow of ink.

The predischarge operation A2 as above cited will be described in more detail.

First, the predischarge for only black is performed.

6 KH 300 shots all nozzles (64 nozzles)
Discharge driving A 300 shots all nozzles (64 nozzles)
Discharge driving B 300 shots all nozzles (64 nozzles)
Discharge driving C Secondly, the predischarge for the color nozzles (Y, M, C) is performed.

Figure 16:
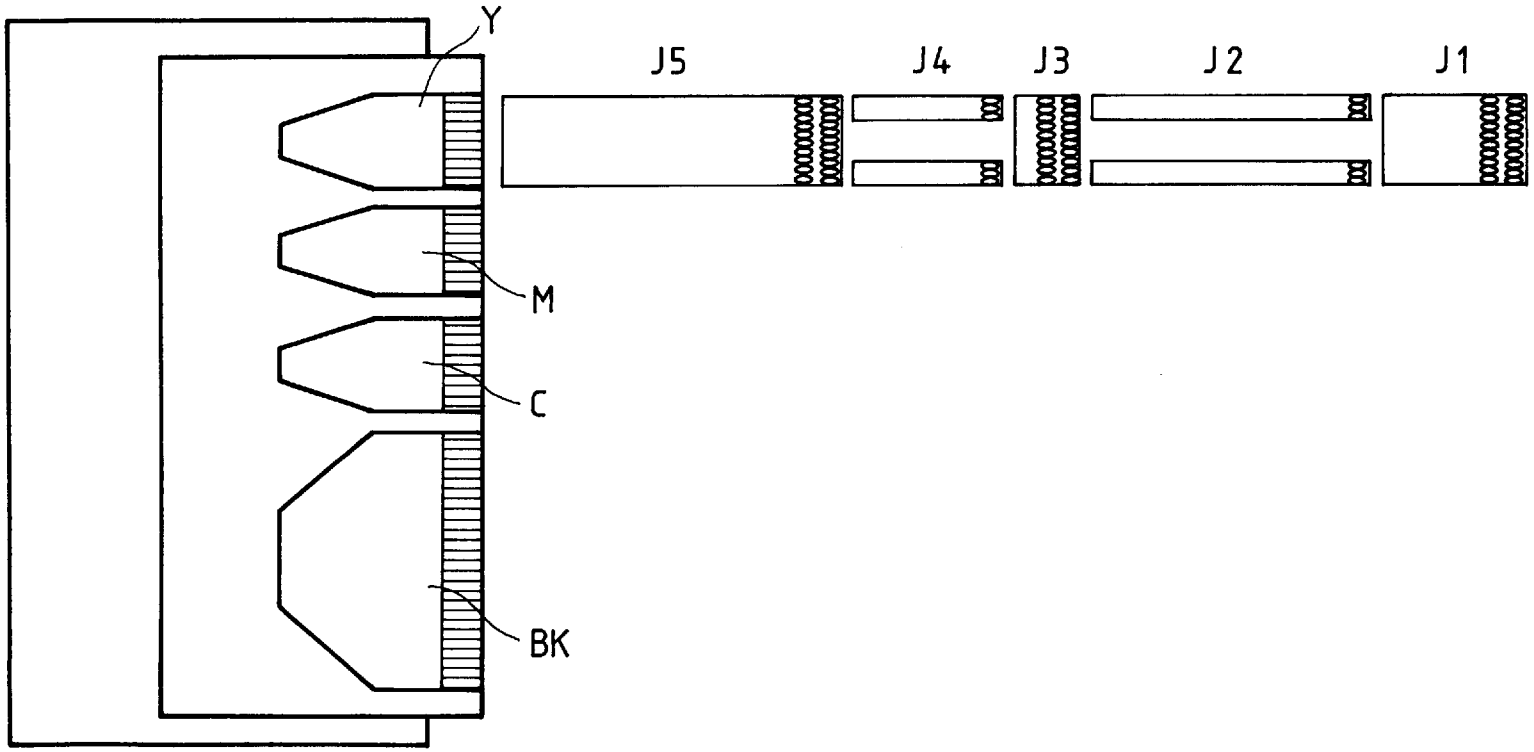
FIG. 16 is a typical view illustrating the pattern for the predischarge operation of the invention.

6 KHz 1000 shots all nozzles (24 nozzles)
Discharge driving C 2000 shots 6 nozzles at both ends
Discharge driving C 500 shots all nozzles
Discharge driving C 1000 shots 6 nozzles at both ends
Discharge driving C 2000 shots all nozzles
Discharge driving C A typical view of the discharge state is shown in FIG. 16, but will be described later.

Subsequently, the idle suction operation is performed twice, the wiping operation is made, and predischarge B2 for recovering the nozzles having slight color mixtures by wiping, including:

BK 2 KHz 100 shots all nozzles
Discharge driving A 100 shots all nozzles
Discharge driving B 100 shots all nozzles
Discharge driving C
Color (common for Y, M, C)
2 KHz 400 shots all nozzles
Discharge driving C
is performed.

Herein, a detail description of the discharge driving is given. It is already well known to control the discharge amount of ink droplets for a rise or drop in head temperature during the printing. In the recording apparatus of this application, since the setting is made to change at the appropriate time the voltage pulse of electrical signal to be applied to the heaters within the nozzles, for the set pulses to be applied, the discharge driving A relies on a voltage pulse for applying the lowest discharge energy in printing, the discharge driving C relies on a voltage pulse for applying the greatest discharge energy in printing, and the discharge driving B relies on a voltage pulse for applying the intermediate energy thereof.

Then, the recovery operation III in exchanging the ink tank will be described below:

(a) Predischarge C2
(b) Suction operation B2
(c) Suction operation B1
(d) Idle suction operation
(e) Wiping operation
(f) Predischarge A2
(g) Idle suction operation twice
(h) Wiping operation twice
(i) Predischarge B2

The recovery operation III is a suction operation to be performed in replacing the ink tank. If the replacement of ink tank can not be directly detected, the replacement operation may be carried out as predicted. Since the color head cartridge 101 is of a design to allow replacement of the ink tank, if the connection between the head and the ink tank is once separated in replacing the ink tank, bubbles may be entrained, in some cases, into the filter junction upon mounting a new ink tank again. Herein, since it is known that bubbles may enclose the ink flow passage on the filter surface to impede the flow of ink, the suction recovery is necessary to remove such bubbles.

As the suction condition, suction operation B2 is first performed to suck, at one stage or three stages, about twice or more the total volume from the top end of the nozzles for each color (BK, Y, M, C) to the filter portion to which the ink tank is coupled, drawing bubbles in the filter portion into the head/flow passage or liquid chamber. The suction amount is about 0.35 cc.

Subsequently, as the second suction condition, suction operation B1 is performed to remove bubbles having moved into the head/flow passage or liquid chamber out of the nozzles, wherein bubbles within the liquid chamber can be substantially minimized by sucking the ink amount almost equal to the above-noted suction amount. The suction operation occurs at three stages with the occurrence of bubbles suppressed in suction. The suction amount is about 0.3 cc. That is, the total of ink suction amount in replacing the tank is required to be about 0.65 cc to practice the two suction operations.

Subsequently, the idle suction operation is performed to empty the ink out of the cap which is filled with the ink in the suction operation. And at the time of suction, a color mixture resolving predischarge is performed to resolve the mixture of color into other color nozzles. This predischarge involves a special predischarge in view of the efficiency, wherein the maximum efficiency for the color mixture can be exhibited with the lease number of discharges by repeating a discharge for all the nozzles simultaneously and a discharge for only the nozzles at the end.

Specific predischarge operation A2 is described below. Like the recovery operation II, the predischarge only for black is first carried out.

6 KHz 300 shots all nozzles (64 nozzles)
Discharge driving A 300 shots all nozzles (64 nozzles)
Discharge driving B 300 shots all nozzles (64 nozzles)
Discharge driving C Secondly, a predischarge for the color nozzles (Y, M, C) is practiced.

6 KHz 1000 shots all nozzles (24 nozzles)
J1 Discharge driving C 2000 shots 6 nozzles at both ends
J2 Discharge driving C 500 shots all nozzles
J3 Discharge driving C 1000 shots 6 nozzles at both ends
J4 Discharge driving C 2000 shots all nozzles
J5 Discharge driving C A specific discharge state regarding J1 to J5 is shown in FIG. 16. Representatively, the predischarge from the nozzles of only one color (Y) is illustrated in the figure.

Subsequently, the idle suction operation is performed twice, the wiping operation is made, and predischarge B2 for resolving the nozzles having slight color mixture by wiping, including:

BK 2 KHz 100 shots all nozzles
Discharge driving A 100 shots all nozzles
Discharge driving B 100 shots all nozzles
Discharge driving C
Color (common for Y, M, C)
2 KHz 100 shots all nozzles
Discharge driving C
is performed.

Herein, the discharge driving can be performed in the same manner as the recovery operation II previously described, and will not be described.

Herein, the suction operations B1, B2 and A as heretofore mentioned will be described in detail.

Figure 27A:
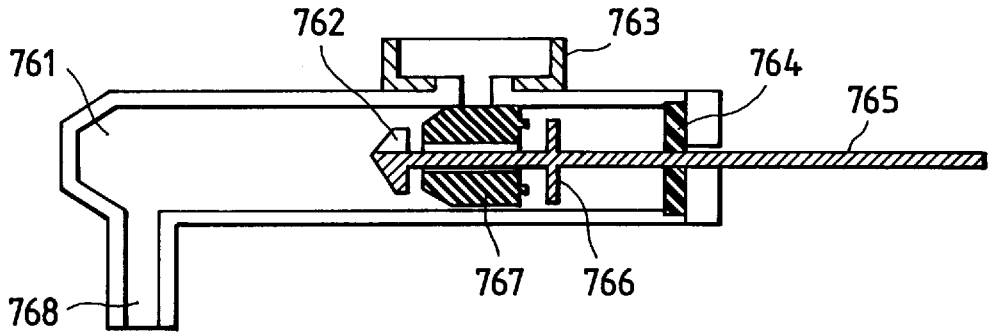
FIGS. 27A to 27C are views showing a suction pump of piston type.
Figure 27B:
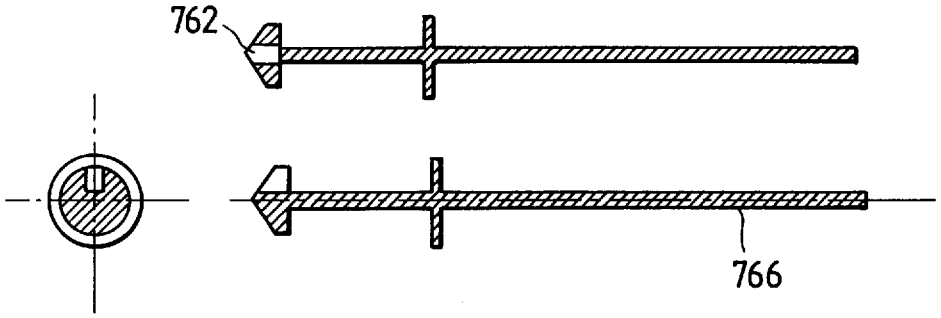
Figure 27C:
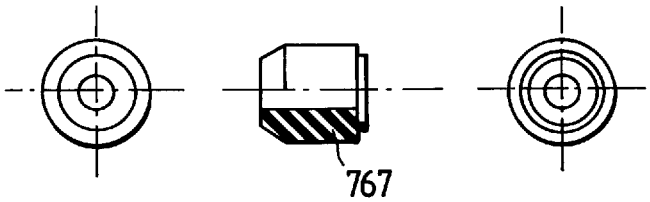

FIGS. 27A to 27C are cross-sectional views showing a suction pump for recovery which is used with the recording apparatus of the present invention. FIG. 27A is a cross-sectional view of the entire pump. In the figure, 761 is a cylinder, 765 is a piston shaft, and 763 is a cap for sucking the ink from the head.

FIG. 27B is a view illustrating the piston shaft 765, which is provided with a flange 766, and comprises a notch portion 762 at the top end. The notch portion 762 at the top end serves to move the ink left within the cylinder 761 after the suction operation via a central hole of a rubber member 767 in an opposite direction within the cylinder 761.

FIG. 27C shows the rubber member 767 which is placed in close contact with a cylinder inner wall, with a rib behind the rubber member 767 enclosed upon the flange 766 pressing it, and when the piston shaft is moved forward, the pressure in a space formed behind the flange can be made negative.

To provide better contact between the rubber member 767 and the inner wall of the cylinder 761, grease may be used.

Figure 28A:
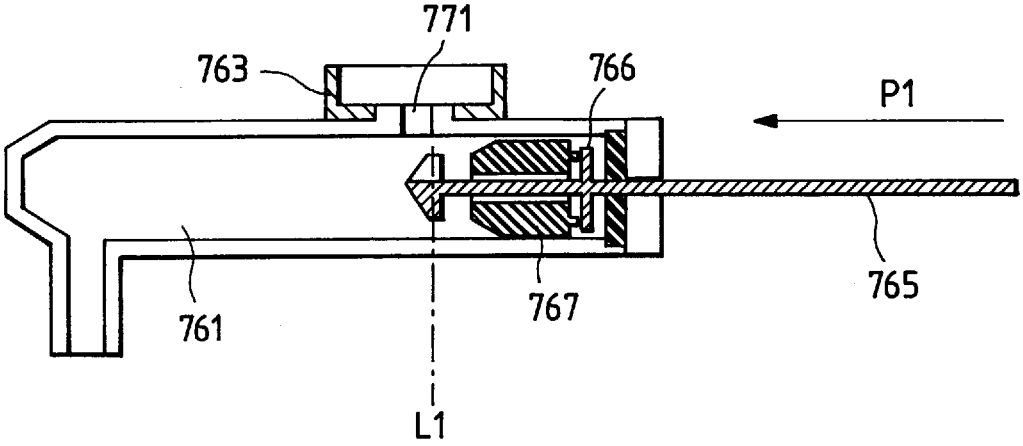
FIGS. 28A and 28B are views showing the operation of the suction of piston type.

Referring to FIG. 28A, the motion of the piston shaft 765 in making suction operation will be described below.

When the piston shaft 765 is moved in a direction of the arrow (P1) within the cylinder 761 to pass the notch portion 762 at the top end of the piston shaft 765 by a position L1 as shown, a negative pressure produced within the cylinder 761 is applied via a suction passage 771 provided on the cap 763 to the head (not shown).

Figure 28B:
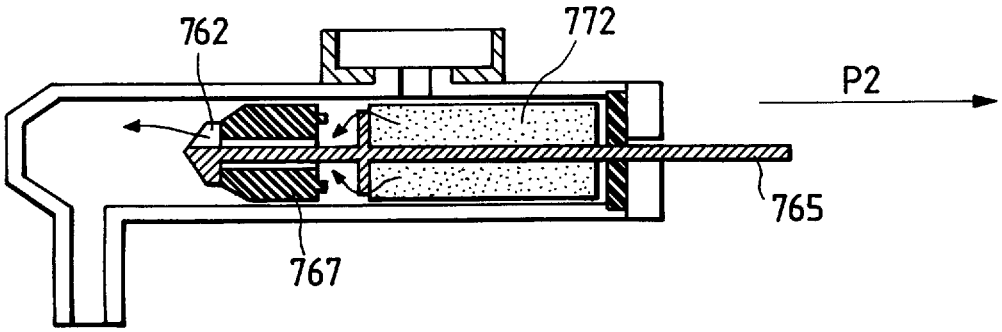

Referring to FIG. 28B, a way of expelling the waste ink produced by sucking the ink from the head (not shown) is described below. The ink sucked from the head is collected via the cap 763 into the cylinder 761. Herein, when pulling back the piston shaft 765 in a direction of the arrow (P2). The ink flows behind the rubber member 767 via a hole provided centrally in the rubber member 767, and further via the notch portion 762 of the piston shaft 765.

Thereafter, by repeating the operations of FIGS. 28A and 28B with the head released, the ink within the cylinder 761 is expelled through an ink exhaust port 768 out of the cylinder 761.

Figure 29:
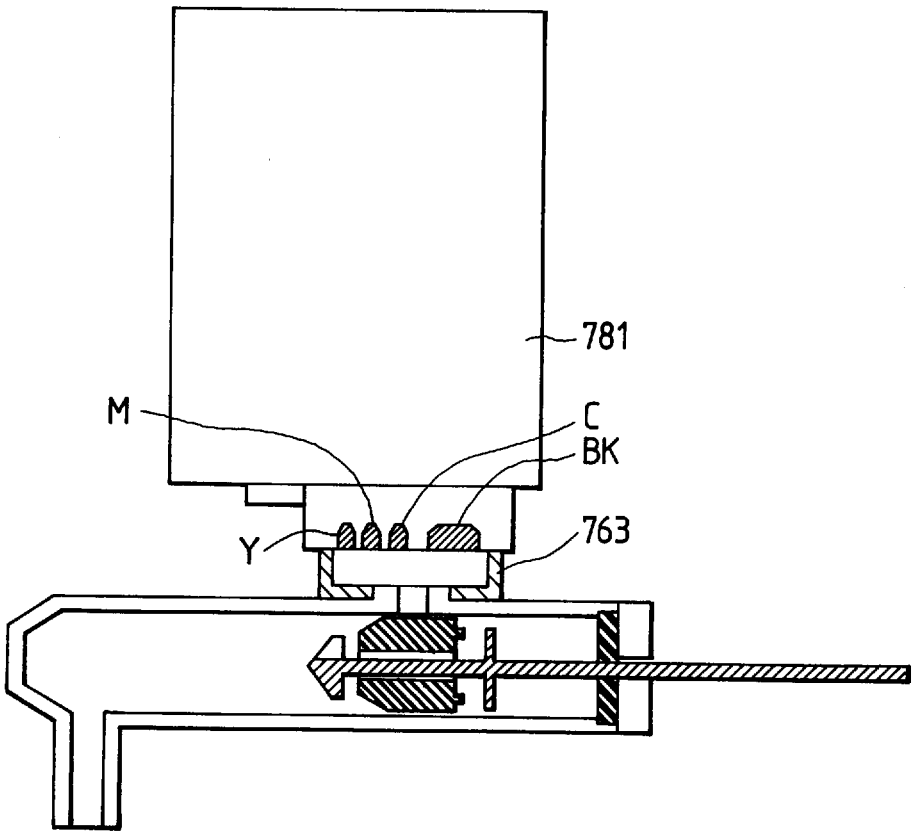
FIG. 29 is a view showing the state where the ink jet unit is capped.

FIG. 29 is a view showing the state where the color head 781 is capped. For reference, the nozzle position for each color in the head is schematically shown.

A specific suction operation will be described using FIGS. 30A to 30D.

First, a suction operation A for the recovery operation I of performing the suction recovery of BK head cartridge 7 will be described. In the suction operation A, the flange 766 of the piston shaft 765 is moved form position 0 to A in the figure and stopped.

In this state, after the cap is released from the BK head, no suction operation is performed and the remaining ink within the cap is sucked idly when the flange is moved to positions B, C. Herein, the suction amount is about 0.15 cc.

Next, a suction operation B in the recovery operation II, III of making suction recovery of the color head cartridge 101 will be described. The suction operation B1 is performed at three stages, as previously noted. The movement and pause of the piston shaft 765 in FIG. 30A will be described below.

First, the flange 766 of the piston shaft 765 is moved from position 0 to A and stopped for two seconds, and in the suction operation at the first state, about 0.15 cc is sucked.

Subsequently, secondly, the flange 766 of the piston shaft 765 is moved from position A to B and stopped for two seconds, and in the suction operation at the second stage, about 0.12 cc is sucked.

Subsequently, thirdly, the flange 766 of the piston shaft 765 is moved from position B to C to release the cap from the head. The suction amount is about 0.03 cc.

In this way, the suction operation at three stages is achieved while moving the piston shaft 765.

Figure 26:
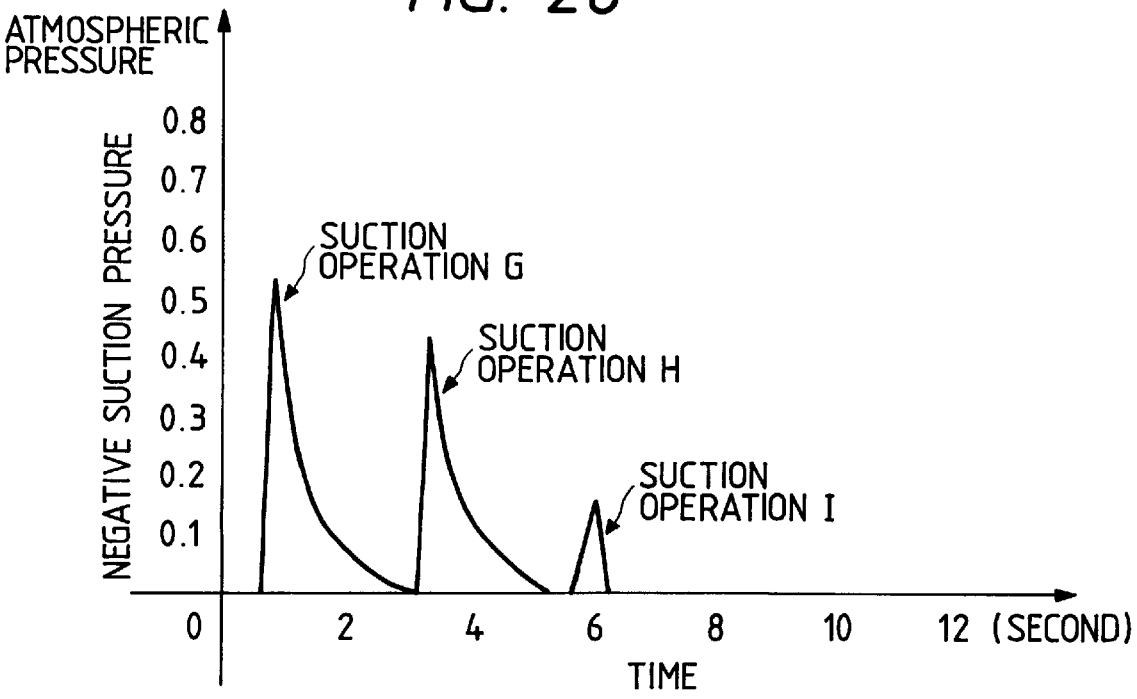
FIG. 26 is a graph representing the relation between the negative suction pressure and the time for plural suction operations with the suction recovery method according to the further embodiment of the invention.

FIG. 26 shows the suction waveforms applied to the head in practicing the three-stage suction operation, with the negative pressure indicated in the longitudinal axis and the time in the horizontal axis. The negative suction pressure occurs in a range from 0.4 to 0.6 atm.

Since the color ink used in this application has an ink composition having high permeability into the paper to allow for fast fixing onto the plain paper, fine bubbles are more likely to occur in the suction operation, whereby such bubbles can be reduced by sucking the ink stepwise, and removed through the ink supply passage out of the head.

Next, a suction operation B2 for use in the recovery operation III will be described below.

The suction operation B2 occurs when the piston shaft is not stopped at positions A, B which is a stop position of the flange 766 of the piston shaft 765, but is continuously moved to position C.

Figure 24:
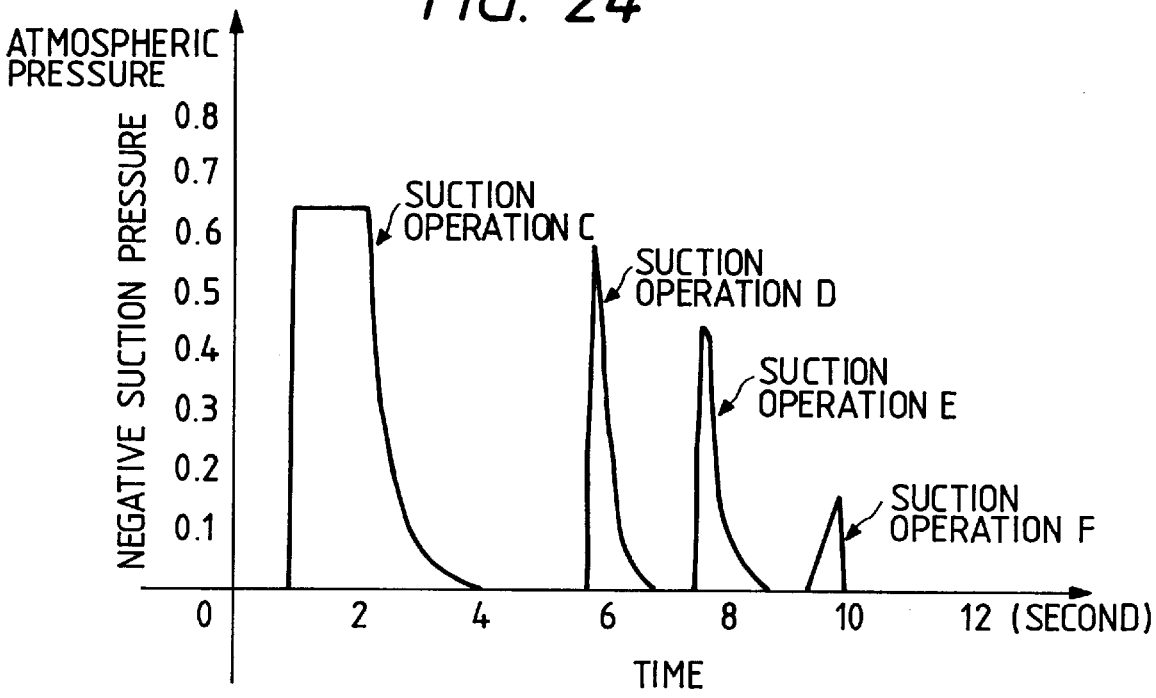
FIG. 24 is a graph representing the relation between the negative suction pressure and the time for plural suction operations with the suction recovery method according to another embodiment of the invention.

FIG. 24 shows the suction waveforms applied to the head in performing the suction operations B2, B1 in the recovery operation III. Since with the negative suction pressure above 0.8 atm, fine bubbles are more likely to occur from the ink tank or near the junction face between the ink tank and the filter, the negative suction pressure of the pump is set to 0.5 atm at the central value, and the pump can be activated in a range from 0.4 to 0.6 atm.

In replacing the ink tank, a slightly higher negative suction pressure should be applied to remove bubbles entrained into the junction face between the ink tank and the filter as previously noted. However, since this is less advantageous with regard to the occurrence of fine bubbles, the second suction operation (in the three stage suction) is performed to remove residual bubbles within the nozzles.

Herein, by repeating twice a suction operation B1 in the three stage suction operation, residual bubbles can be sufficiently removed and suppressed to the minimum, and therefore the same operation may be repeated.

Figure 17:
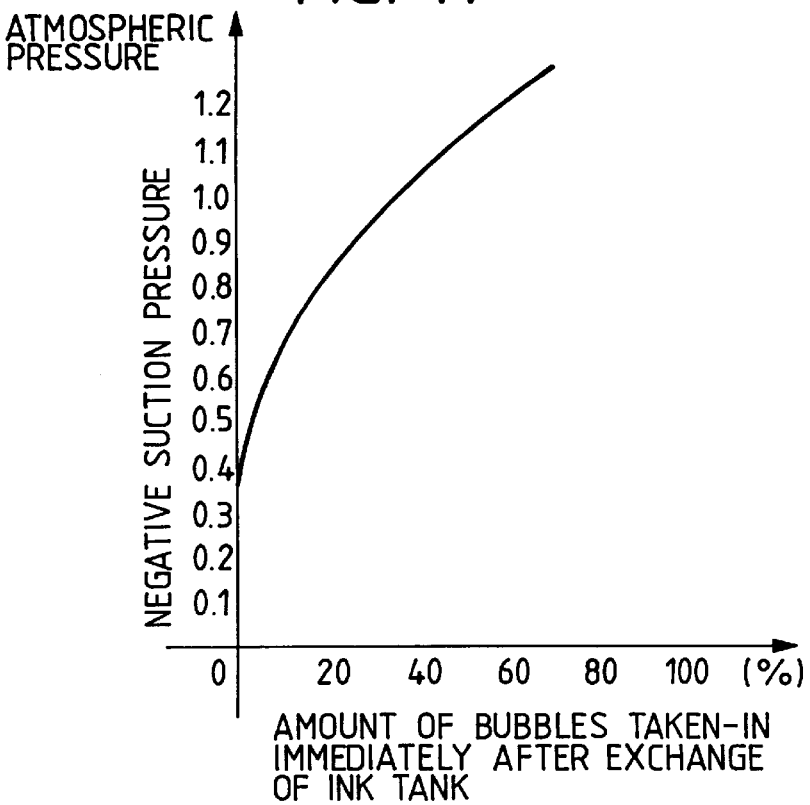
FIG. 17 is a graph representing the relation between the suction negative pressure and the amount of bubbles taken from the ink tank into the recording head, immediately after exchange of the ink tank.

Next, another embodiment of the present invention will be described below. FIG. 17 is a graph representing the relation between the negative suction pressure and the amount of bubbles taken in from the ink tank or the junction with the ink tank immediately after exchange of the ink tank. It can be found that immediately after exchange of the ink tank, bubbles are taken from the ink tank into the recording head if the negative suction pressure is 0.3 atm or greater.

Figure 18:
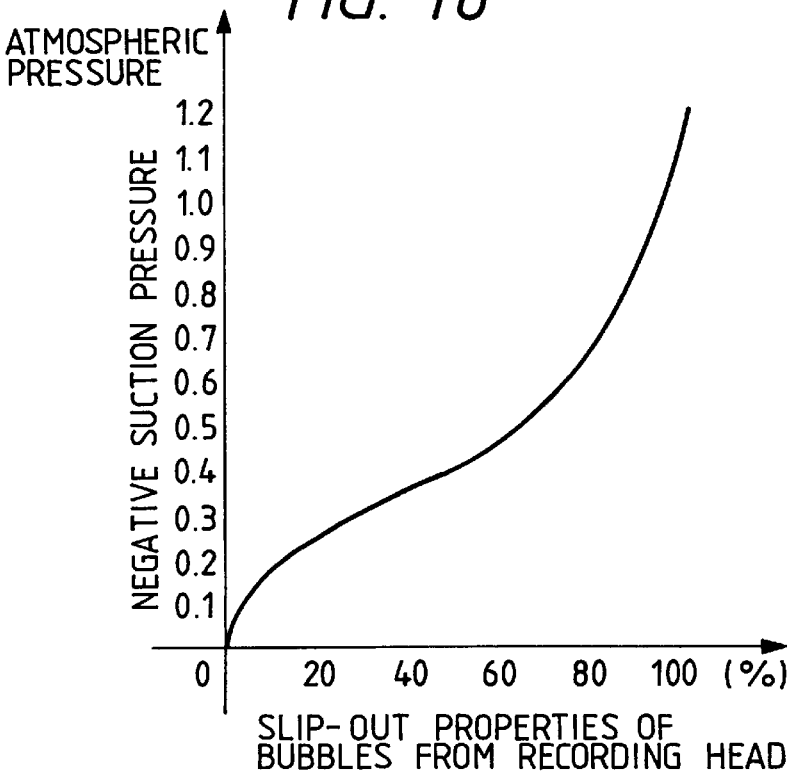
FIG. 18 is a graph representing the relation between the suction negative pressure and the slip-out properties of bubbles from the recording head.

FIG. 18 is a graph representing the relation between the negative suction pressure and the slip-out properties of floating bubbles or stationary bubbles remaining within the recording head. It can be seen that a higher negative suction pressure is preferable to remove bubbles residing within the recording head.

Figure 19:
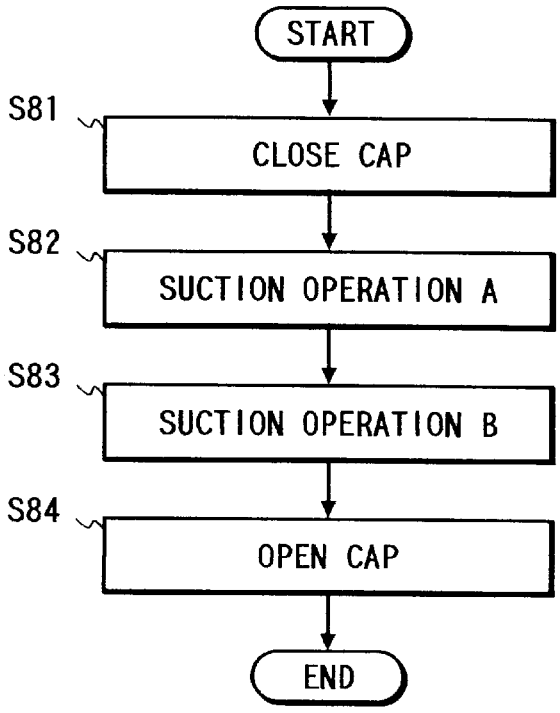
FIG. 19 is a flowchart showing a suction recovery method according to one embodiment of the present invention.

FIG. 19 is a flowchart showing a suction recovery method in replacing the ink tank in this example, the suction operation consisting of suction operation A and suction operation B.

First, the formation face of ink discharge ports 651 for an ink jet unit is enclosed with a suction cap 6510 of FIG. 12 (step S81), the suction recovery is achieved by making two types of suction operations consisting of the suction operation A (step S82) and the suction operation B (step S83), and the suction cap 6510 of FIG. 12 is released from the formation face of ink discharge ports 651 (step S84).

Figure 20:
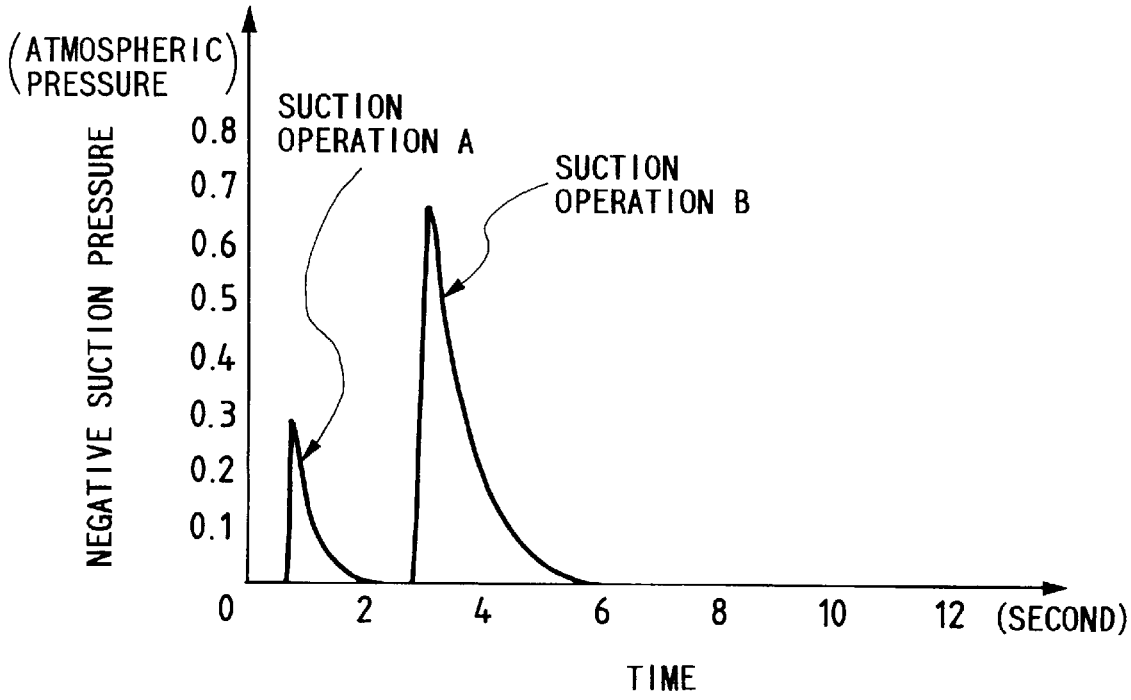
FIG. 20 is a graph representing the relation between the negative suction pressure and the time for plural suction operations with the suction recovery method according to one embodiment of the present invention.

FIG. 20 is a graph representing the relation between the negative suction pressure for the suction operation A and the suction operation B and the time. The suction operation A involves sucking to prevent bubbles from being taken in from the ink tank, wherein the maximum negative suction pressure within the suction cap 6510 of FIG. 12 is set to a negative suction pressure as low as below 0.3 atm. The suction operation B involves sucking to remove bubbles residing within the recording head, wherein the maximum negative suction pressure within the suction cap 6510 of FIG. 12 is set to a negative suction pressure as high as 0.3 atm or greater.

The suction amount is set to be equal to or more than the total volume of the ink supply passage 654, the common liquid chamber 653 and the liquid channels 652, which can supply the ink via the filter 655 from the ink tank 656 of FIG. 12 to the ink discharge ports 651, for two types of suction operations consisting of the suction operation A and the suction operation B.

Although the no bubble state within the recording head can be created by performing two types of suction operations of the suction operation A and the suction operation B in which the negative suction pressures are different, these different two types of suction operations should be consecutively made in a short time interval.

Figure 21:
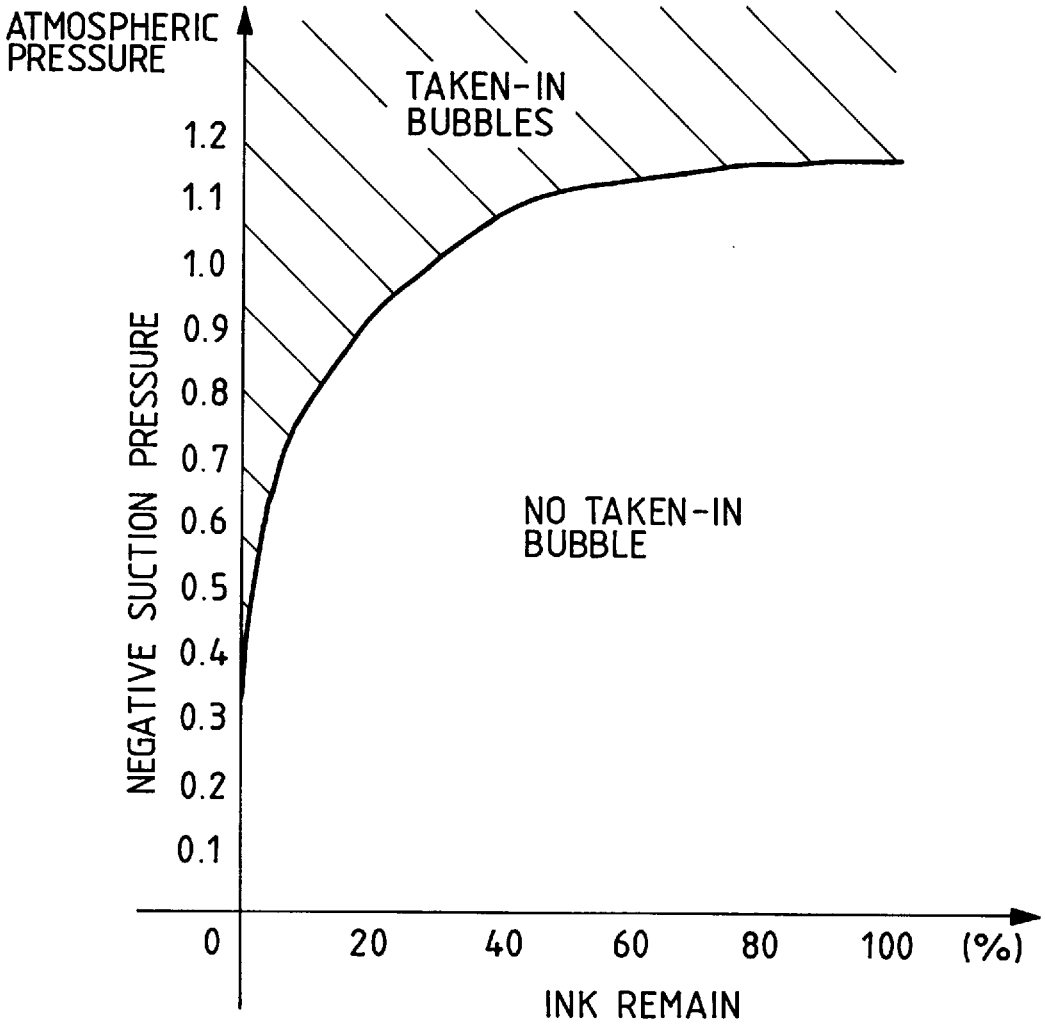
FIG. 21 is a correlational graph representing how bubbles are taken from the ink tank into the recording head, in relation between the negative suction pressure and the ink remain within the ink tank.

FIG. 21 is a correlational diagram of the taken-in bubbles according to the relation between the negative suction pressure and the ink remain within the ink tank. The slash portion is a region of taken-in bubbles, whereby it can be seen that as the ink remain decreases, bubbles are taken in at higher negative suction pressures. Therefore, as the ink remain within the ink tank decreases, the suction operation should be changed by lowering the maximum negative suction pressure to prevent bubbles from being taken in, thereby securely extinguishing residual bubbles to make the ink supply stabler.

Therefore, in this example, by using the suction recovery method of FIG. 19, as above described, the ink can be supplied without bubbles within the recording head, even when the ink is undischarged due to bubble banks in the ink supply passage, the common liquid chamber and the liquid channels provided with discharging heaters within the recording head, or when the ink is undischarged due to broken meniscus on the ink discharge ports, or when significant ink fixing occurs near the ink discharge ports or within the recording head, whereby the always stable recording can be effected without causing any print failure due to bubbles after the suction recovery.

In this example, the suction operation is performed by controlling the negative pressure, but because the slip-out properties may be caused by the flow rate within the liquid channels, the common liquid chamber and the ink supply passage, the flow rate should be controlled. For example, if the negative suction pressure is 0.5 atm, the flow rate within the ink supply passage is about 0.05 cc/sec.

Figure 22:
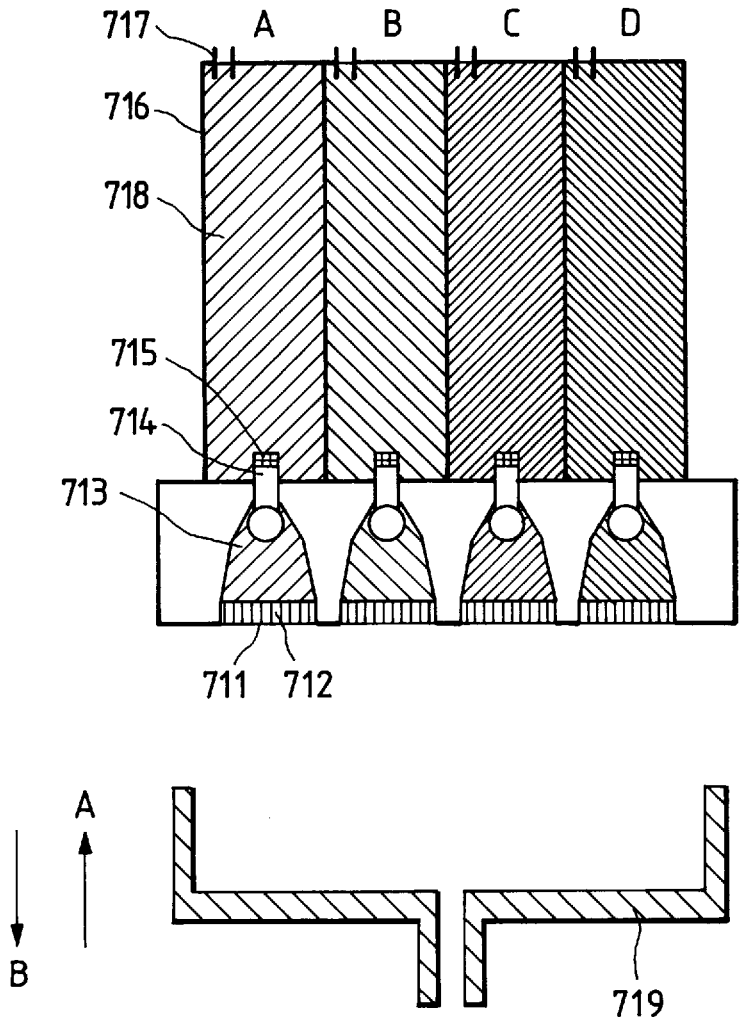
FIG. 22 is a typical view showing an ink jet unit and a suction cap according to another embodiment of the present invention.

FIG. 22 is a view illustrating a further embodiment of the present invention, or a schematic view showing an ink jet unit comprising a color recording head having a plurality of discharge ports capable of discharging different color inks arranged on the same plane or straight line, and a plurality of ink tanks for storing said different color inks to be supplied to said color recording head, which are constructed replaceably at will, and a suction cap.

An ink tank 716 is provided with an atmosphere communicating port 717 for communicating the ink to the atmosphere, and containes an absorbing member 718 holding the ink. The ink supply into the recording head occurs from the ink tank 716 to the liquid channels 712 provided internally with the discharging heaters to the ink discharge ports 711, through a common liquid chamber 713 communicating to the liquid channels, and through an ink supply passage 714 communicating to the common liquid chamber, via a filter 714 for trapping the dirt in the ink, these being provided for each of four colors from A color to D color. The suction cap 719 is moved in a direction of the arrow A to enclose the formation face of ink discharge ports 711 for the suction by a suction pump, not shown, and moved back in a direction of the arrow B to open the formation face of ink discharge ports 711 if the suction is completed.

Figure 23:
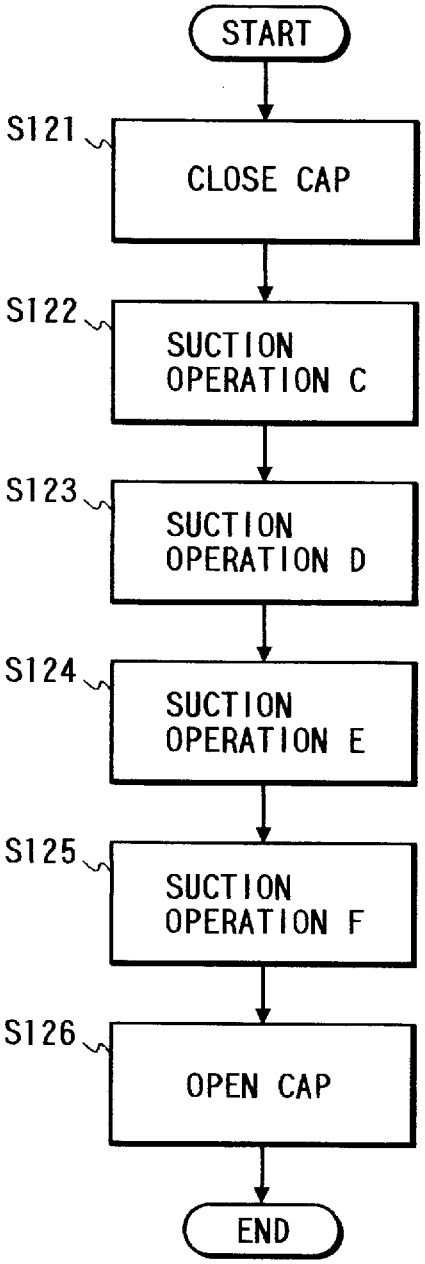
FIG. 23 is a flowchart showing a suction recovery method according to another embodiment of the present invention.

FIG. 23 is a flowchart showing a suction recovery method in a further embodiment of the present invention, which is executed by a CPU 400 of FIG. 11.

In FIG. 23, the formation face of ink discharge ports 711 for the ink jet unit is enclosed by the suction cap 719 of FIG. 22 (step S121), the suction recovery is performed by four types of suction operations, that is, a suction operation C (step S122), a suction operation D (step S123), a suction operation E (step S124) and a suction operation F (step S125), and the suction cap 719 of FIG. 22 is released from the formation face of ink discharge ports 711 (step S126).

FIG. 24 is a graph representing the relation between the negative suction pressure for the suction operation C, suction operation D, suction operation E and suction operation F and the time.

The suction operation C is one in which the maximum negative suction pressure within the suction cap is maintained at as high as 0.6 atm or greater. As can be seen from FIG. 17, if the negative suction pressure immediately after replacement with a new ink tank having greater amount of ink remain is 0.3 atm or greater, bubbles are taken from the ink tank into the recording head, but by maintaining a high negative suction pressure, as can be seen from FIG. 18, bubbles taken into the recording head can be removed, whereby the ink within the absorbing member evenly holding the ink is brought near the filter at a time and passed therethrough to have better contact between the absorbing member holding the ink within the ink tank and the filter.

The suction operation D is one in which the maximum negative suction pressure is 0.5 atm or greater, which is lower than the maximum negative suction pressure of the suction operation C, and the suction operation E is one in which the maximum negative suction pressure is set at a negative suction pressure lower than the maximum negative suction pressure of the suction operation D. By changing continuously the suction operation from higher to lower negative suction pressure, the ink supply from the ink tank into the recording head can be stabilized while bubbles residing within the recording head are removed.

The suction operation F is one in which the maximum negative suction pressure is set to a negative suction pressure as low as below 0.2 atm, wherein the ink of the color having more ink remain and with the absorbing member holding the ink having lower negative suction pressure flows toward the ink of the color having less ink remain and with the absorbing member holding the ink having higher negative pressure, that is, through ink discharge ports, to the liquid channels, to the common liquid chamber, and further to the ink supply chamber, thereby removing the color mixed ink.

From FIG. 21, it can be seen that by changing the suction operation to that with the lower maximum negative suction pressure in accordance with the least amount of ink remain among the four-color ink tanks, residual bubbles can be securely removed to make the ink supply stabler.

The suction amount is set to equal to or more than the total volume of the ink supply passage within the recording head capable of supplying the ink via the filter from the ink tank for each of four colors from A color to D color to the ink discharge ports, the common liquid chamber, and the liquid channels, and the total suction amount of three suction operations including suction operation D, suction operation E and suction operation F is set to the same as that of suction operation C. By performing suction recovery with the suction amount set at twice or more the volume within the recording head for four colors from A color to D color with these four types of suction operations, the ink can be securely supplied into the recording head, without remaining bubbles. As shown in FIG. 23, these different four types of suction operations should be continuously performed, but three types of suction operations including suction operation D, suction operation E and suction operation F may be continuously performed in such a way that the suction cap 719 of FIG. 22 is released from the formation face of ink discharge ports 711 between the suction operation C (step S122) and the suction operation D (step S123), and after once forming the meniscus on the ink discharge ports 711, the formation face of ink discharge ports 711 is enclosed again with the suction cap 719 of FIG. 22.

Four colors from A to D may be cyan, magenta, yellow and black, or the variable-density ink of the same color with different densities.

In this way, according to this embodiment, the use of the suction recovery method of FIG. 23 as above described allows the supply of ink in the state having no bubbles in the recording head, when the ink tank is replaced with a new ink tank having more ink remain due to exhaustion of the ink within the ink tank, or when the ink is undischarged due to the state of each color ink, or even when severe fixing occurs near the ink discharge ports or within the recording head, whereby no print failure occurs due to bubbles after the suction recovery, with the color mixture after suction prevented, thereby effecting the stable recording at all times.

The state of negative pressure within the ink tank, which is related to the ink remain, can be controlled inexpensively and effectively, using what is called dot count remain detecting means for managing the used ink amount by counting the number of ink droplets discharged for every color or the number of suction recovery operations.

Figure 25:
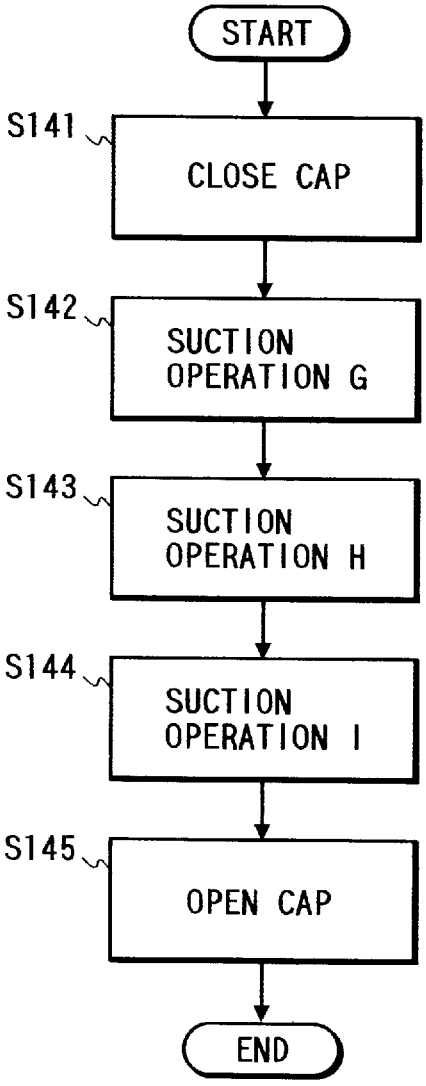
FIG. 25 is a flowchart showing a suction recovery method according to a further embodiment of the present invention.

FIG. 25 is a flowchart showing a suction recovery method in a further embodiment of the present invention for performing suction recovery of the ink jet unit of FIG. 22, except when exchanging the tank.

In FIG. 25, the formation face of ink discharge ports 711 for the ink jet unit is enclosed with the suction cap 719 of FIG. 22 (step S141), the suction recovery is performed by three types of suction operations, that is, suction operation G (step S142), suction operation H (step S143), suction operation I (step S144), and the suction cap 719 of FIG. 22 is released from the formation face of ink discharge ports 711 (step S145).

FIG. 26 is a graph representing the relation between the negative suction pressure for the suction operation G, suction operation H, and suction operation I and the time.

Since this ink jet unit has the ink tank attached to the recording head, the contact between the absorbing member holding the ink in the ink tank and the filter is already enhanced. Hence, the suction operation G is one in which the maximum negative suction pressure is set to a negative suction pressure as high as from 0.3 atm to 1.0 atm, and the suction operation H is one in which the maximum negative suction pressure is set to lower than the maximum negative suction pressure of suction operation G. By successively changing the suction operation from higher to lower negative suction pressure, the ink supply from the ink tank into the recording head can be stabilized, while removing bubble banks arising within the recording head due to the non-service for long term or temperature elevation caused by the printing.

The suction operation I is one in which the maximum negative suction pressure is set to a negative suction pressure as low as below 0.2 atm, wherein the ink of the color with less ink consumption and for which the absorbing member holding the ink has lower negative suction pressure flows toward the ink of the color with more ink consumption and for which the absorbing member holding the ink has higher negative pressure, that is, through ink discharge ports, to the liquid channels, to the common liquid chamber, and further to the ink supply chamber, thereby removing the color mixed ink.

The suction amount is set to slightly greater than the total volume of the ink supply passage within the recording head capable of supplying the ink via the filter from the ink tank for each of four colors from A color to C color to the ink discharge ports, through the common liquid chamber and the liquid channels, and by continuously performing these three types of suction operations having different negative suction pressures, bubbles residing within the recording head can be securely removed without needing large amounts of suction, and the ink supply can be effected without having remaining bubbles.

And from FIG. 21, by changing the suction operation to that with the lower maximum negative suction pressure corresponding to the least amount of ink remain among the four color ink tanks, the stable ink supply without having remaining bubbles can be securely effected.

FIGS. 27A to 27C are views of a suction pump of piston type, wherein FIG. 27A is a view in cross section of the overall pump, FIG. 27B is a view illustrating a piston shaft 765, and FIG. 27C is a view illustrating a rubber member 767.

The suction cap 763 for sucking the ink from the head is connected to the cylinder 761 provided with an ink exhaust port 768 to exhaust the sucked ink. Provided within the cylinder 761 are a piston shaft 765, a rubber member 767, and a sealing rubber 764. The piston shaft 765 is provided with a flange 766 and a notch portion 762. The notch portion 762 has a role of moving the ink within the cylinder 761 left after the suction operation via a central hole in an opposite direction within the cylinder 761. The rubber member 767 is closely contacted with the inner wall of cylinder, with a rib behind the rubber member 767 enclosed by the flange pressing it, and when the rib is moved forward, the pressure of a space formed behind it can be made negative. To enhance the contact between the cylinder and the inner wall of cylinder 761, a grease may be used. The piston shaft 765 is connected to a driving source of the recovery unit, not shown, and can be moved left and right on the straight line.

FIGS. 28A and 28B are views showing the operation of a suction pump of the piston type.

As shown in FIG. 28A, in pushing the piston shaft in a direction of the arrow P1, the flange of the piston shaft is brought into close contact with the rib provided on the back side of the rubber portion moving in close contact with the circumference of the cylinder. In this state, if the piston shaft is pushed, a negative pressure occurs within the cylinder. When the piston shaft comes to a position L1 on a suction passageway 771, a negative pressure is applied to the inside of the suction cap to be able to suck the ink through the discharge ports of the ink jet unit.

FIG. 28B illustrates a way of exhausting the waste ink produced in sucking the ink from the head (not shown). The ink 772 sucked from the head is collected within the cylinder via the cap. Herein, in pulling the piston shaft 765 in a direction of the arrow P2 back to the original position, the ink 772 flows behind the rubber member 767 via a hole provided centrally in the rubber member 767 and further through the notch portion 762 of the piston shaft 765.

FIG. 29 is a view showing an ink jet unit 781 having a four color ink tank having a plurality of discharge ports capable of discharging the inks of four colors (Yellow, Magenta, Cyan, Black) arranged on the same plane or straight line, with the ink jet unit being capped.

Figure 30A:
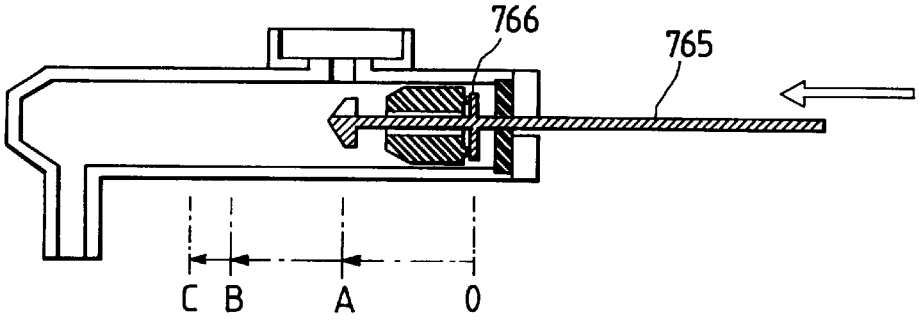
FIGS. 30A to 30D are views showing the suction operation according to the further embodiment of the invention, using the operation of the suction pump of piston type.
Figure 30B:
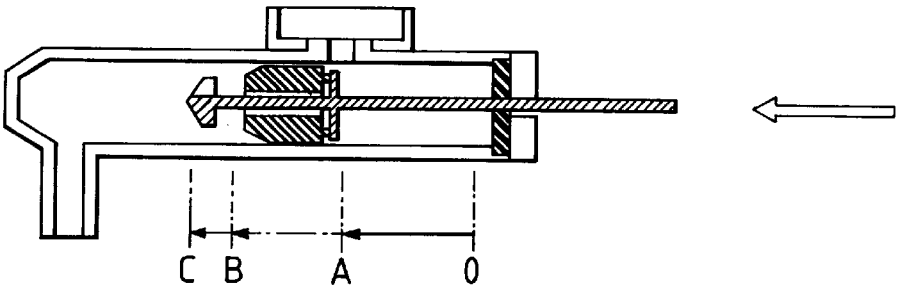
Figure 30C:
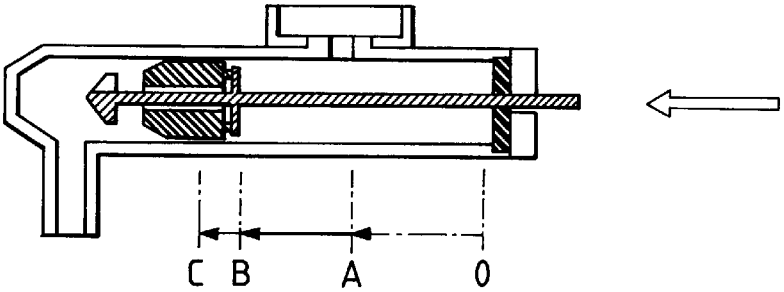
Figure 30D:
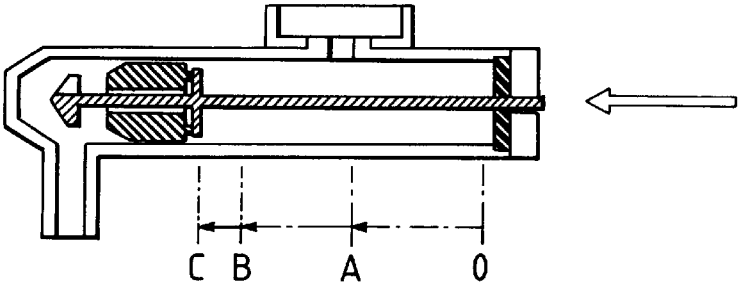

FIGS. 30A to 30D are views showing a further suction operation of the invention using a suction pump of the piston type. FIG. 30A is a view of the initial state where the piston shaft is in an initial position 0. As shown in FIG. 30B, the piston shaft is moved in a direction of the arrow up to the position A and stopped for several seconds to perform the suction operation G of FIG. 26, subsequently, the piston shaft is moved in the direction of the arrow up to the position B and stopped for several seconds to perform the suction operation of FIG. 26, as shown in FIG. 30C, and finally, the piston shaft is moved in the direction of the arrow up to the position C to perform the suction operation I of FIG. 26, as shown in FIG. 30D.

In this way, in this example, in order to prevent beforehand the print failure caused by bubble banks produced due to the non-service for long term where the ink tank is attached to the recording head or temperature elevation in printing, at the time of turning on the power where the ink jet unit is attached to the main body, at the time of replacing the head where the ink jet unit of replaceable type is attached to the main body, or when the count number of ink dots discharged from the ink jet unit reaches a predetermined value, the use of the suction recovery method of FIG. 26 as above described allows efficient removal of bubbles residing in the ink supply passage, the common liquid chamber and the liquid channels provided with discharging heaters without needing great amounts of suction, without causing a print failure due to bubbles after suction recovery, and with the color mixture after suction prevented, so that the stable recording is always assured.

A further embodiment of the present invention will be described below.

In mounting a head cartridge to the recording apparatus main body, the suction recovery operation is changed to set the sequence of the optimal condition in accordance with the type of head, thereby eliminating the wasteful ink consumption, as already described. In this embodiment, the wiping operation during the printing will be described below.

To secure the stabilization of image during the printing, it is necessary to periodically wipe out ink droplets sticking to the head face plane, or the dirt entering from the outside. Principally, this is to avoid the malfunction in which the ink mist in the midst of printing sticks to the face plane to cause the periphery of discharge ports to be wet with the ink, degrading the impinging point accuracy of main shots for printing to make the printing worse.

In mounting the BK head cartridge 7, the face plane of the head is relatively less liable to ink wetting by virtue of the material of the ink, because the ink with good printing quality on the plain paper is adopted, as previously noted, but since the ink used for the color head cartridge 101, in particular the color ink is treated to enhance the permeability on the paper, such ink has a tendency of having lower surface tension, and wetting the periphery of discharge ports.

Accordingly, in practicing the wiping operation during the printing, it is necessary to accord to the material of the ink. Further, since the number of nozzles for the head is much varied, the degree of ink wetting may be different depending on the number of discharges per unit nozzle. The ink wetting may also vary depending on the number of discharge pulses used during the printing or the head temperature in printing.

Furthermore, a specific example is presented below.

First, when the recording apparatus main unit detected a BK head cartridge 7, the wiping condition was practiced based on either the total number of discharges during the printing or the time management during printing, which takes place earlier. The counting of the number of discharges during the printing is controlled by detecting the print mode, the head temperature, and the difference between the head temperature and the ambient temperature, and adding those values multiplied by the weighting coefficients.

The total number of discharges during the printing is counted, and upon its total number exceeding a predetermined value, the wiping operation is performed. The information from a) to c) is obtained and added, as described below.

1) Set value at BK head cartridge

The number of discharges is set to a value corresponding to 9 digits for all discharges, with a reference value of 3,317,760. (128 nozzles×36 columns×80 digits×9 rows=3317760)

2) Set values at color head cartridge

In printing with BK nozzle

The number of discharges is set to a value corresponding to 9 digits for all discharges, with a reference value of 1,658,880. (64 nozzles×36 columns×80 digits×9 rows=1658880)

In printing with color nozzle, the count value is added for three colors to make judgement.

The number of discharges is set to a value corresponding to 7 digits for all discharges, with a reference value of 483,840. (24 nozzles×36 columns×80 digits×7 rows=483840)

a) <Weighting coefficients> in the print mode

One pass: 1

Two pass: 0.5

Four pass: 0.25

The number of discharges is multiplied by the above coefficient and added, and if the number of discharges used for printing (including predischarge) reaches a predetermined set number, the wiping is performed.

b) <Weighting coefficients> at head temperature

Head temperature up to 10° C.: 0.5 from 10° to 20° C.: 0.8 from 20° to 30° C.: 1 from 30° to 40° C.: 1.3 from 40° to 50° C.: 1.5

50° C. or higher: 2

The number of discharges is multiplied by the above coefficient and added, and if the number of discharge used for printing (including predischarge) reaches a predetermined set number, the wiping is performed.

c) Weighting is made based on the difference ΔT (degrees) between the head temperature and the ambient temperature.

<Weighting coefficients>

Temperature difference up to 10° C.: 1 from 10° to 20° C.: 1.2 from 20° to 30° C.: 1.3 from 30° to 40° C.: 1.5 from 40° to 50° C.: 1.8

50° C. or higher: 2

The number of discharges is multiplied by the above coefficient and added.

The above-cited weighting coefficient is not fixed, but is of course varied if the discharge performance of head or the ink material is different.

Next, the time management during the printing is practiced. The time management is made for the wiping after elapse of a predetermined time, because ink droplets adhering to the head face plane by performing the printing may fix and is difficult to remove.

The set time was the same for both the BK head and the color head. However, because of the difference between ink materials, it is desirable to change the weighting coefficient depending on the type of head or the kind of ink.

<Set time>

The reference for judgement was based on an elapse of 60 seconds.

However, the condition may change with the following weighting coefficients.

1) BK head cartridge a) <Weighting coefficients> with head temperature

Head temperature up to 10° C.: 0.5 from 10° to 20° C.: 0.8 from 20° to 30° C.: 1

30° C. or higher: 2

The timer count value is multiplied by the above coefficient and added, and if the print time reaches a predetermined value, the wiping is performed.

c) Weighting is made based on the temperature difference ΔT (degrees) between the head temperature and the ambient temperature.

<Weighting coefficients>

Temperature difference up to 10° C.: 1 from 10° to 20° C.: 1.2 from 20° to 30° C.: 1.4 from 30° to 40° C.: 1.6

40° C. or higher: 2

The timer count value is multiplied by the above coefficient and added.

2) Color head cartridge Common for BK, color a) <Weighting coefficients> with head temperature Head Temperature up to 10° C.: 0.6 from 10° to 20° C.: 0.8 from 20° to 30° C.: 1

30° C. or higher: 1.2

The timer count value is multiplied by the above coefficient and added, and if the print time reaches a predetermined value, the wiping is performed.

b) Weighting is made based on the temperature difference ΔT (degrees) between the head temperature and the ambient temperature.

<Weighting coefficients>

Temperature difference up to 10° C.: 0.8 from 10° to 20° C.: 1 from 20° to 30° C.: 1.2 from 30° to 40° C.: 1.4

40° C. or higher: 1.6

The timer count value is multiplied by the above coefficient and added.

In this way, by making the proper wiping operation by discriminating the BK head cartridge and the color head cartridge, as above described, it is possible to avoid the unstable discharge or undischarge during the printing and provide for the reliable image as well as the printing system.

Next, an automatic suction operation to prevent the undischarge due to residual bubbles during the printing will be described. In an ink jet head, particularly a head of jetting ink droplets by applying an electrical signal to the heater provided within the nozzles to generate the heat with the heater to cause film boiling in the ink on the heater, the dissolved air within the ink produces residual bubbles in the liquid chamber or flow passage of the ink supply system, due to temperature elevation within the nozzles or within the ink liquid chamber during the printing, while the printing is continued.

When such residual bubbles grow gradually to fill up the liquid chamber, or grow to some extent but not fully, the ink supply may be insufficient if the print duty is raised, resulting in the ink missing.

Thus, in this example, the setting of the automatic suction operation for removing bubble banks during the printing can be optimized in accordance with the type of head or the kind of ink to enhance the reliability without making wasteful suction operation.

As a result of observation of how residual bubbles are accumulated when the printing is repeated with the BK head and the color head, we have found that it greatly depends on the shape volume of the liquid chamber for the head, the head temperature and the ink material. Accordingly, we have also found that it is preferable to detect the head temperature to be managed and multiply it by the weighting coefficient to effect the operation.

Regarding the ink material, such a problem can be resolved by changing the initial set value.

1) BK head cartridge

When the total number of print pulses being discharged reached a certain value as below, the printing is stopped to perform the bubble removal automatic suction operation. Or in the case of the cut sheet, the printing is paused at the page being printed upon detecting a predetermined value as follows, and the wiping may be performed after exhausting the sheet and before entering the next printing.

The head temperature during the printing is monitored to measure the number of ink droplets being discharged, i.e., the number of applied pulses, which number is multiplied by the weighting coefficient as presented below and added.

Set value of the number of applied pulses: A reference for judgement was 200,000,000 pulses. (the number of applied pulses corresponding to 400 sheets in 5% duty image)

a) Weighting coefficients at head temperature

Head temperature up to 10° C.: 0.8 from 10° to 20° C.: 1 from 20° to 30° C.: 1.2 from 30° to 40° C.: 1.5 from 40° to 50° C.: 1.8 from 50° to 60° C.: 2

60° C. or higher: 2.5

The number of applied pulses is multiplied by the above coefficient and added, and if its total number reaches a predetermined value, the automatic suction operation is performed.

2) Color head cartridge i) BK nozzle part

Set value of the number of applied pulses: A reference for judgement was 100,000,000 pulses. (the number of applied pulses corresponding to 200 sheets in 5% duty image)

Weighting coefficients at head temperature

Head temperature up to 10° C.: 0.8 from 10° to 20° C.: 1 from 20° to 30° C.: 1.2 from 30° to 40° C.: 1.5 from 40° to 50° C.: 1.8 from 50° to 60° C.: 2

60° C. or higher: 2.5

The number of applied pulses is multiplied by the above coefficient and added, and if its total number reaches a predetermined value, the automatic suction operation is performed.

ii) Color nozzle part

Set value of the number of applied pulses: A reference for judgement was 66,000,000 pulses. (the number of applied pulses corresponding to 20 sheets in 30% duty image)

Weighting coefficients at head temperature

Head temperature up to 10° C.: 0.4 from 10° to 20° C.: 0.6 from 20° to 30° C.: 0.8 from 30° to 40° C.: 1.0 from 40° to 50° C.: 1.4 from 50° to 60° C.: 1.8

60° C. or higher: 2.2

The number of applied pulses is multiplied by the above coefficient and added, and if its total number exceeds a predetermined value, the automatic suction operation is performed.

The automatic suction operation for removing bubbles during the printing performs the recovery operation I with the BK head cartridge, or the recovery operation II with the color head cartridge.

By doing so, the least suction operation as necessary is permitted without having wasteful ink consumption, and without causing undischarge during the printing, so that the stable printing or image can be always obtained with higher reliability.

The predischarge C2 which is performed prior to the above-mentioned suction operation will be described in detail below.

The following example is an ink jet recording apparatus comprising ink droplet discharge means for discharging the ink to recording the image, and suction means having a cap and a suction pump for sucking and exhausting the ink out of the ink droplet discharge means, characterized by comprising a prior-to-suction predischarge recovery mode for continuously operating suction means after completion of discharging ink droplets onto the non-image area.

More preferably, this example is characterized in that the ink predischarge is performed in the amount ranging from the volume of head nozzles to the total volume of the common liquid chamber in addition to the nozzles. In a more preferable form, the non-image area for discharging ink droplets is placed in the cap in communication with suction means.

Also, the feature of this variation is summarized methodologically as a suction recovery method for an ink jet head having the nozzles in communication with the orifices for discharging the ink and a liquid chamber communicating to said nozzles, characterized by removing ink meniscus between said nozzles by performing the predischarge prior to suction recovery of said ink jet head, or forming an air region having a capacity that said ink meniscus can be removed by suction action owing to said suction recovery within said liquid chamber.

Figure 31:
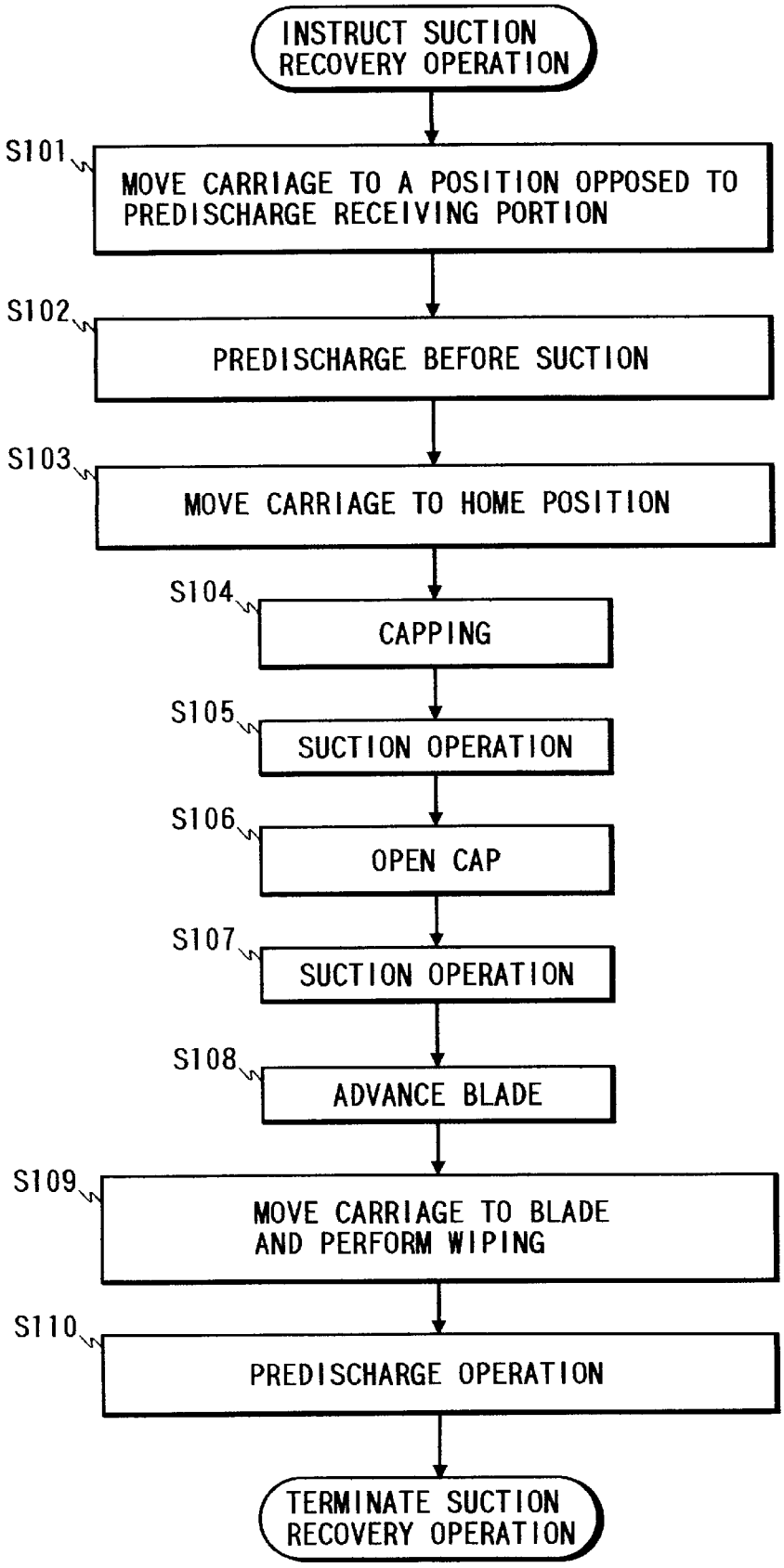
FIG. 31 is a flowchart showing the sequence of suction recovery operation according to the further embodiment of the invention.
Figure 36:
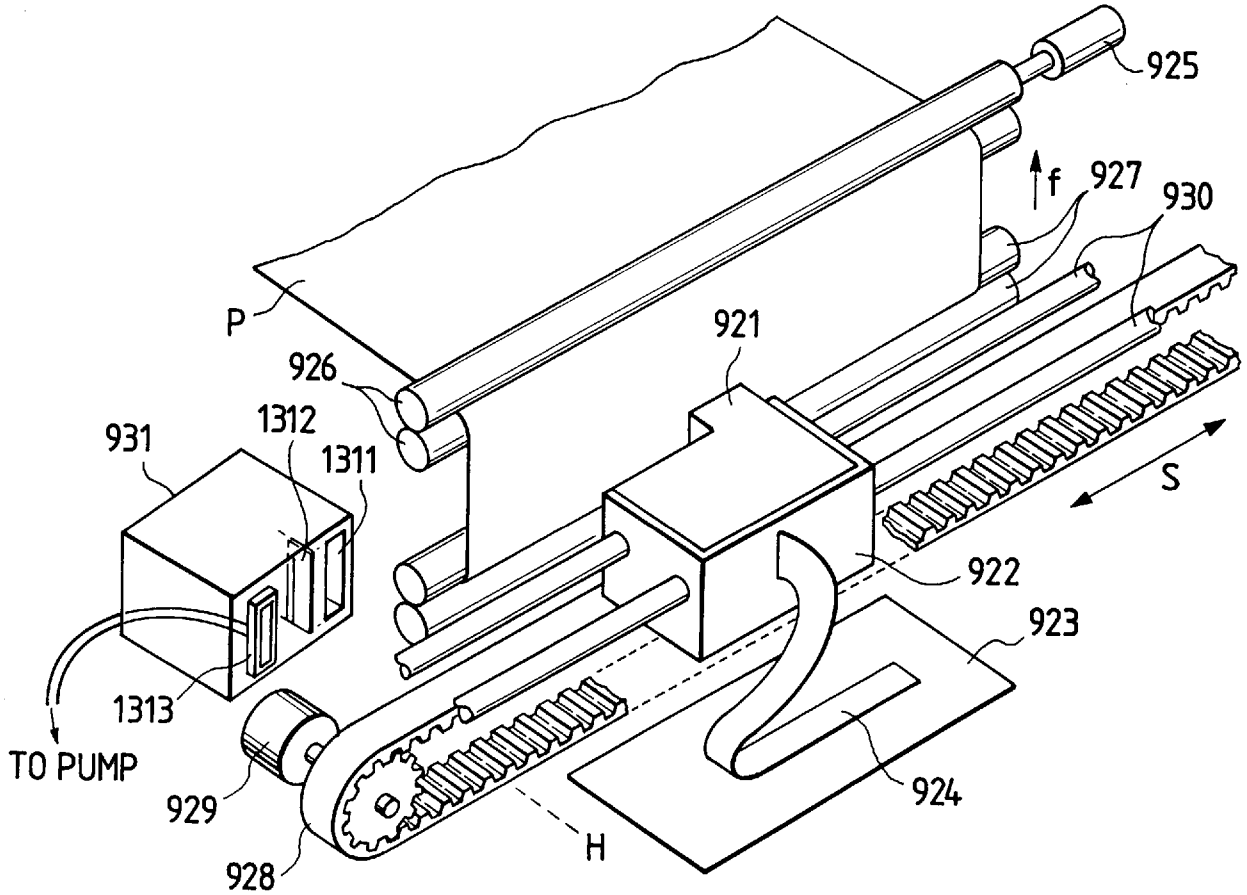
FIG. 36 is a perspective view showing the constitution of a main portion of an ink jet recording apparatus.
Figure 37:
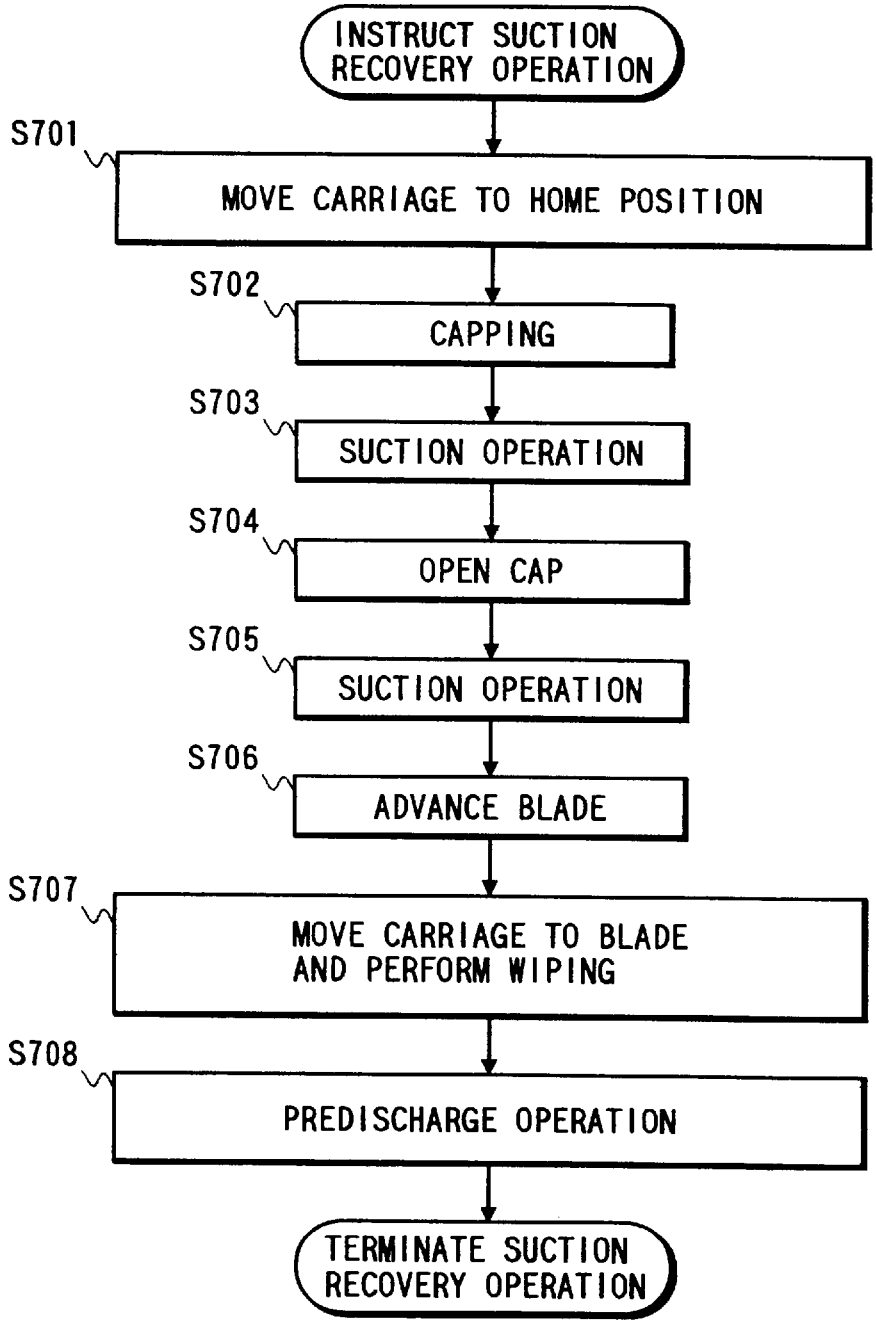
FIG. 37 PRIOR ART
FIG. 37 is a flowchart exemplifying a sequence of conventional suction recovery operation.
Figure 38A:
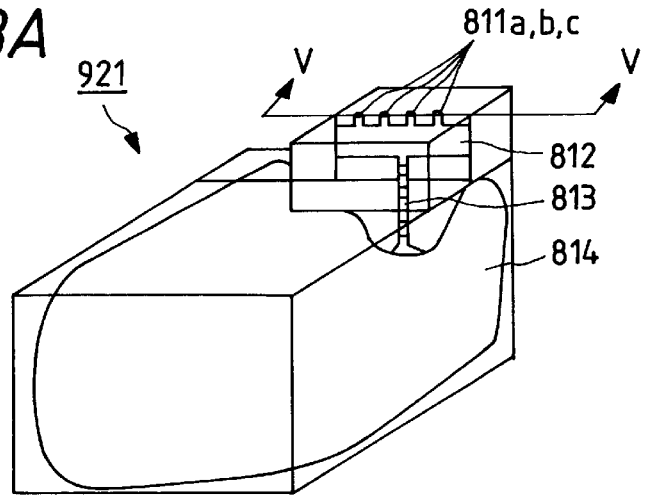
FIGS. 38A and 38B are typical views showing the constitution of a head cartridge.
Figure 38B:
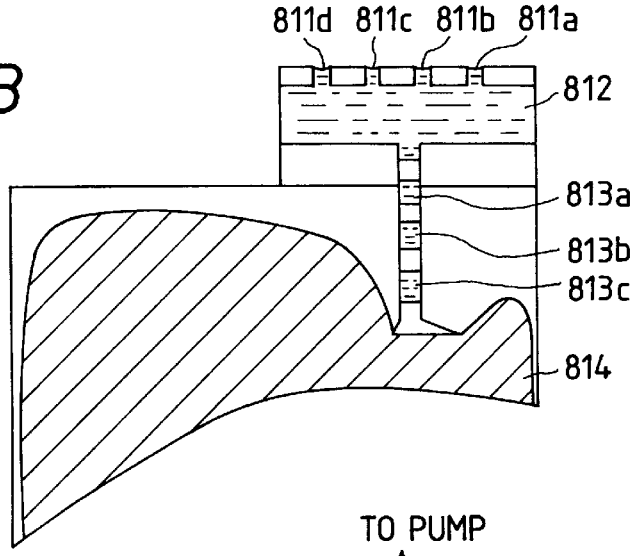

FIG. 31 shows a flowchart of the operation sequence for showing the suction recovery method in a further embodiment of the present invention. If the suction recovery operation is instructed, the carriage 922 (see FIG. 36) is moved to a position at which the discharge ports are opposed to the predischarge receiving portion (step S101), and the predischarge is performed into the predischarge receiving portion (step S102).

Then, the carriage 922 is moved to a home position (HP) (step S103), and the capping is completed by capping means covering the discharge port face (step S104). Then, the suction pump is activated to generate a negative pressure within the cap to suck the ink from the discharge ports to effect suction operation, and the pump is stopped in a predetermined time to complete the suction operation (step S105). Then, the cap of capping means is separated away from the discharge port face so that the inside of the cap is in communication with the atmosphere (step S106).

Then, the suction pump is activated again to remove the ink within the pump, the tube and the cap (step S107). Then, a wiping blade advances toward the discharge port face (step S108). The carriage is further moved toward the blade so that the wiping blade are rubbed against the discharge port face to effect wiping to remove the ink adhering to the discharge port face (step S109). Further, the carriage continues to be moved in the same direction, and upon reaching a position where the discharge ports are opposed to the predischarge receiving portion, the predischarge is executed (step S110) to expel the unnecessary ink and fine bubbles out of the nozzles.

Figure 32A:
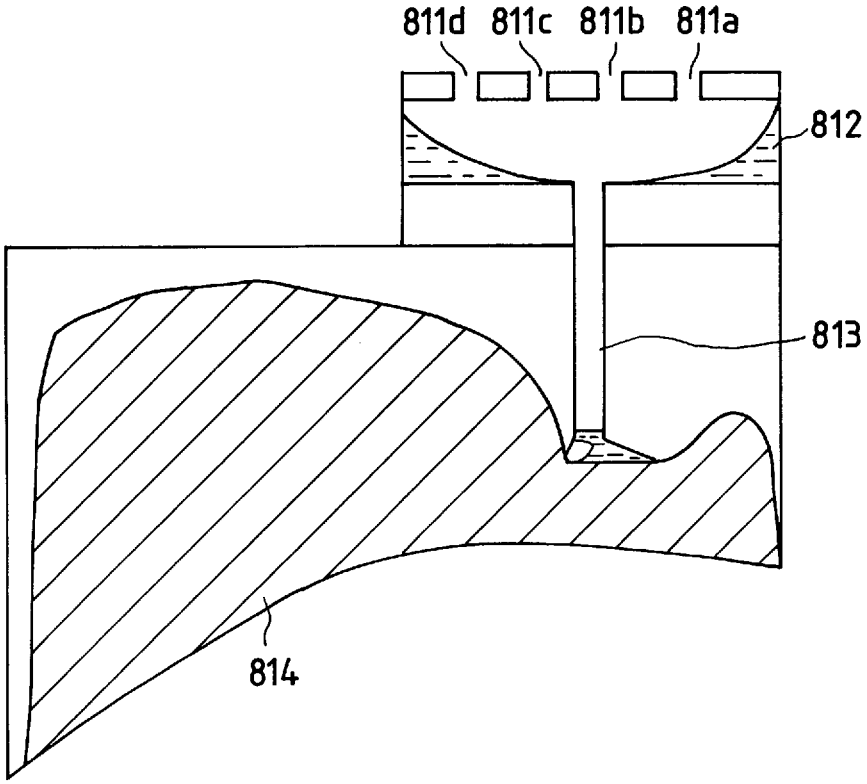
FIGS. 32A and 32B are views showing the ink filled state according to the further embodiment of the invention.
Figure 39:
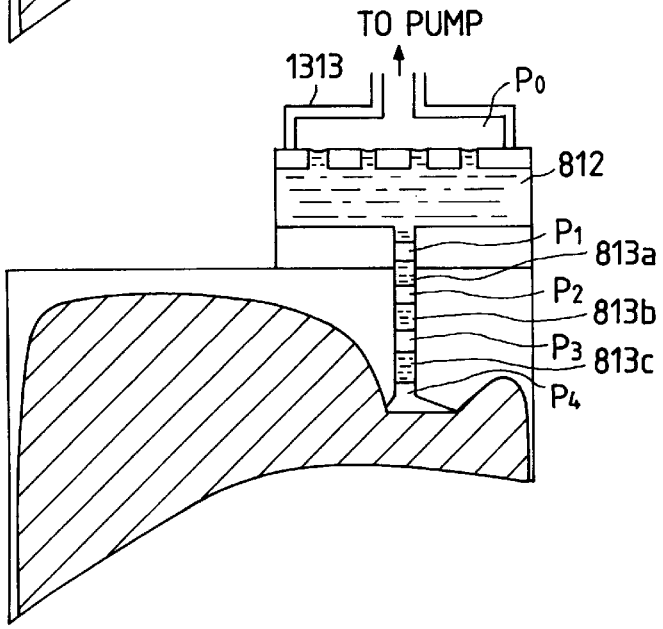
FIG. 39 is a typical view showing the state of the head cartridge at the time of starting the suction.

In this way, if the predischarge is performed before suction in the ink split state as in the conventional example and shown in FIG. 39, one of the following situations may occur:

(a) The ink meniscus on the discharge ports may be broken so that most of the ink within the common liquid chamber 812 and the flow passage flows back to the tank, owing to negative pressure within the ink tank (FIG. 32A).

Figure 32B:
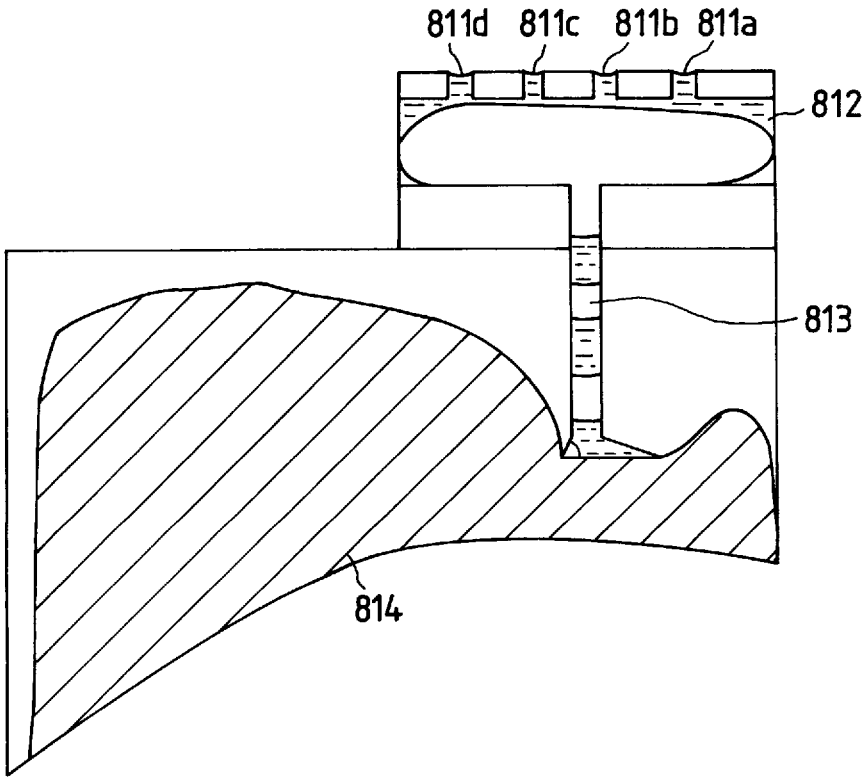

(b) The ink within liquid chamber decreases by the amount of ink droplets discharged, so that large voids are formed within the common liquid chamber 812 (FIG. 32B).

Then, if the suction is performed, in case of (a), a negative suction pressure is directly applied to the ink within the flow passage, which ink is pulled by a stronger force than in the conventional example, because of no pressure loss in the nozzles 811/common liquid chamber 812, so that the ink split state can be effectively resolved.

Also, in case of (b), the ink near the nozzles can be removed at the initial time of suction, and thereafter, like the case of (a), negative suction pressure is directly applied to the ink within the flow passage, which ink is pulled by a stronger force than in the conventional example, so that the ink split state can be resolved effectively. In this way, in either case, the suction method of this invention which involves performing predischarge prior to suction is remarkably effective in resolving the ink split state over the conventional suction method.

Further, the number of predischarges performed at this time is desirably set such that when all the predischarges are completely executed without causing undischarge, the total volume of ink droplets is set to more than the volume of all the nozzles and almost equal to the sum of the volume of all the nozzles and that of the common liquid chamber. This is because if the total volume of ink droplets is less than the volume of all the nozzles, the probability of inducing the breakage of ink meniscus as previously mentioned is extremely reduced, resulting in less effective recovery, while if the total volume of ink droplets is significantly greater than the sum of the volume of all the nozzles and that of the common liquid chamber, the ink discharge driving is effected without having the ink within the nozzles, resulting in higher probability of damaging the recording elements due to heat.

Figure 33:
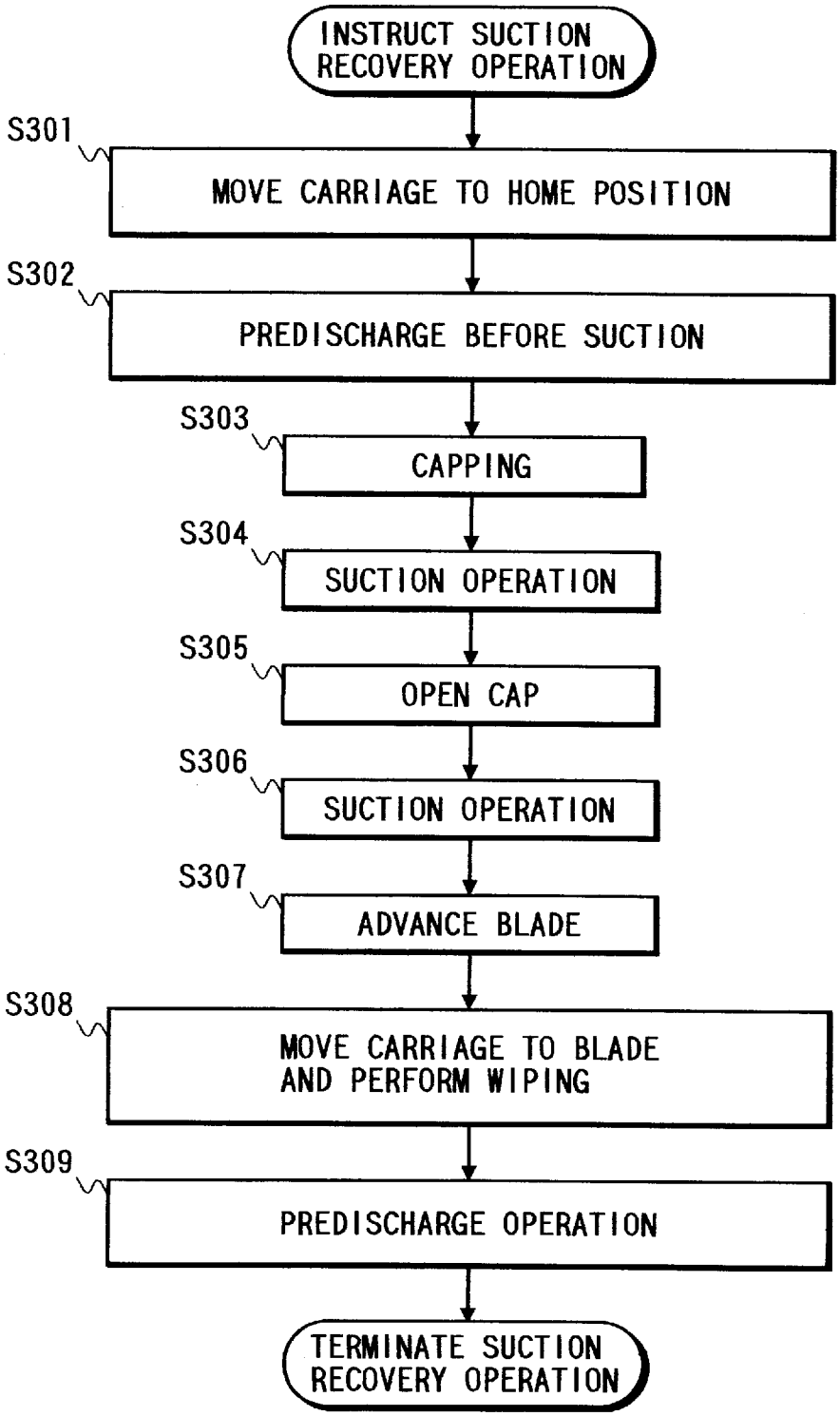
FIG. 33 is a flowchart showing a sequence of suction recovery operation according to the further embodiment of the invention.

FIG. 33 shows a flowchart of operation sequence for showing the suction recovery method in a further embodiment of the present invention. If the suction recovery operation is instructed, the carriage is moved to a home position (step S301), and the predischarge is performed (step S302). Then, the capping is completed by capping means covering the discharge port face (step S303). Then, the suction pump is activated to generate a negative pressure within the cap to suck the ink from the discharge ports to effect suction operation, and the pump is stopped in a predetermined time to complete the suction operation (step S304). Then, the cap of capping means is separated away from the discharge port face so that the inside of the cap is in communication with the atmosphere (step S350). Then, the suction pump is activated again to remove the ink out of the pump, the tube and the cap (step S306).

Then, a wiping blade advances toward the discharge port face (step S307), and the carriage is further moved toward the blade so that the wiping blade are rubbed against the discharge port face to effect wiping to remove the ink adhering to the discharge port face (step S308). Further, the carriage continues to be moved in the same direction, and upon reaching a position where the discharge ports are opposed to the predischarge receiving portion, the predischarge is executed (step S309) to expel the unnecessary ink and fine bubbles out of the nozzles.

In this way, if the predischarge is performed into the cap before suction, the volume within the cap at the time of suction is reduced by the amount of ink droplets predischarged, and the initial volume of suction can be decreased, so that the effectively higher negative pressure (negative pressure within cap) is generated by the pump. Therefore, the effect of higher negative suction pressure adds to those as previously described in the first embodiment, bringing about greater effect of resolving the ink split state.

Figure 34:
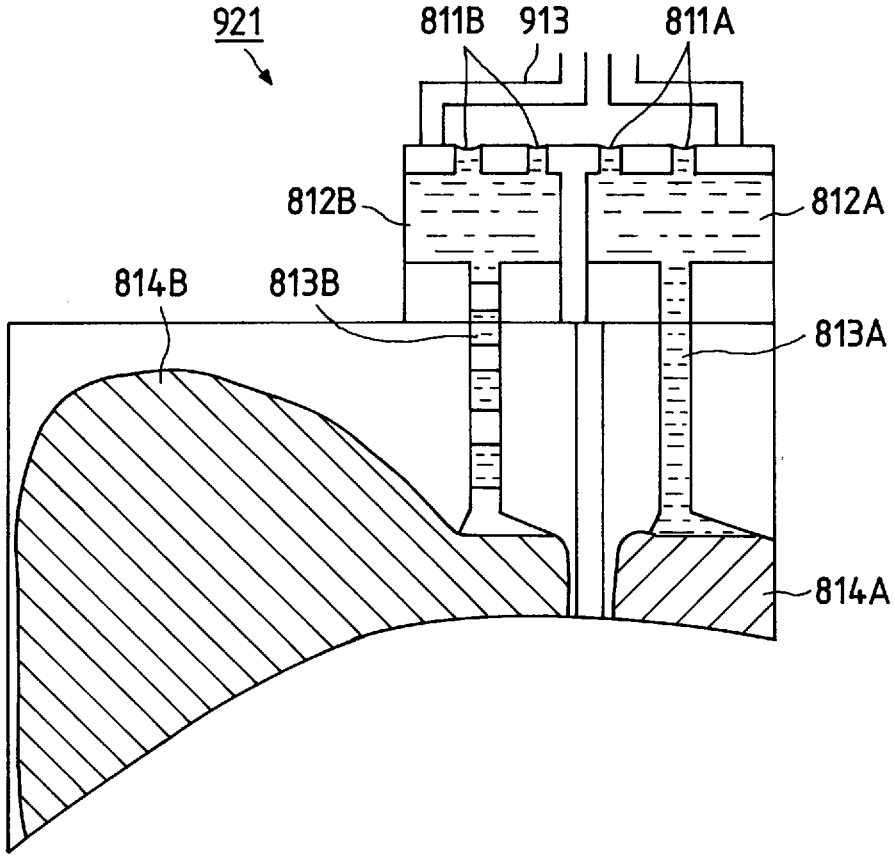
FIG. 34 is a view illustrating the ink split state of a multi-color integral cartridge according to the further embodiment of the invention.

A further embodiment in which the present invention is applied to the cartridge (referred to as a multi-color integral cartridge) having means for discharging multi-color inks for the recording will be described below. In FIG. 34, a schematic view showing the ink split state of multi-color integral cartridge (a two-color integral cartridge illustrated in this figure).

In FIG. 34, 811A, 811B are nozzles which are ink discharge ports at the end, internally provided with driving means for the ink discharge. 812A, 812B is a liquid chamber common to each nozzle (referred to as a common liquid chamber), and 813A, 813B is an ink flow passage for connecting an absorbing member 814A, 814B to the common liquid chamber 812A, 812B, respectively.

Recording means 811A, 812A, 813A, 814A for discharging the ink of ink color A (referred to as recording means A) and recording means 811B, 812B, 813B, 814B for discharging the ink of ink color B (referred to as recording means B) are separated by a partition and provided within the cartridge, with the discharge ports 811A, 811B opened on the same discharge port face.

In FIG. 34, the solid painted portion shows the ink filled state, wherein recording means A is in the ink non-split state, and recording means B is in the ink split state in the figure. In FIG. 34, 913 is capping means for enclosing the discharge port face containing the discharge ports 811A, 811B as a whole to effect suction recovery of recording means A, B together.

The recording means B in the ink filled state as shown in FIG. 34 can not continue printing, and needs suction recovery, but with such integral suction method as above stated, it is easier to suck the ink from the recording means A in the ink non-split state so that the in-cap negative pressure due to suction begins to be resolved by the ink A, and thereby less sufficient negative pressure is applied to recording means B, resulting in a situation where the ink split state of recording means B can not be resolved at all.

Particularly, the four-color integral full-color cartridge for recording four colors of cyan (C), magenta (M), yellow (Y), and black (BK) uses (a) C, M, Y inks having lower surface tension and higher drying rate to prevent the blur of color, (b) BK ink having higher surface tension to make much of the density with greater ink droplet volume and larger discharge port than the C, M, Y inks, whereby the ink split state is more likely to occur with C, M, Y ink recording means, but not with the BK ink as shown in FIG. 34, and further the pressure loss in the discharge ports is smaller in the BK ink discharge means, thereby allowing the BK ink to be more easily sucked, but the ink split state for Y, M, C inks is very difficult to resolve.

Figure 35:
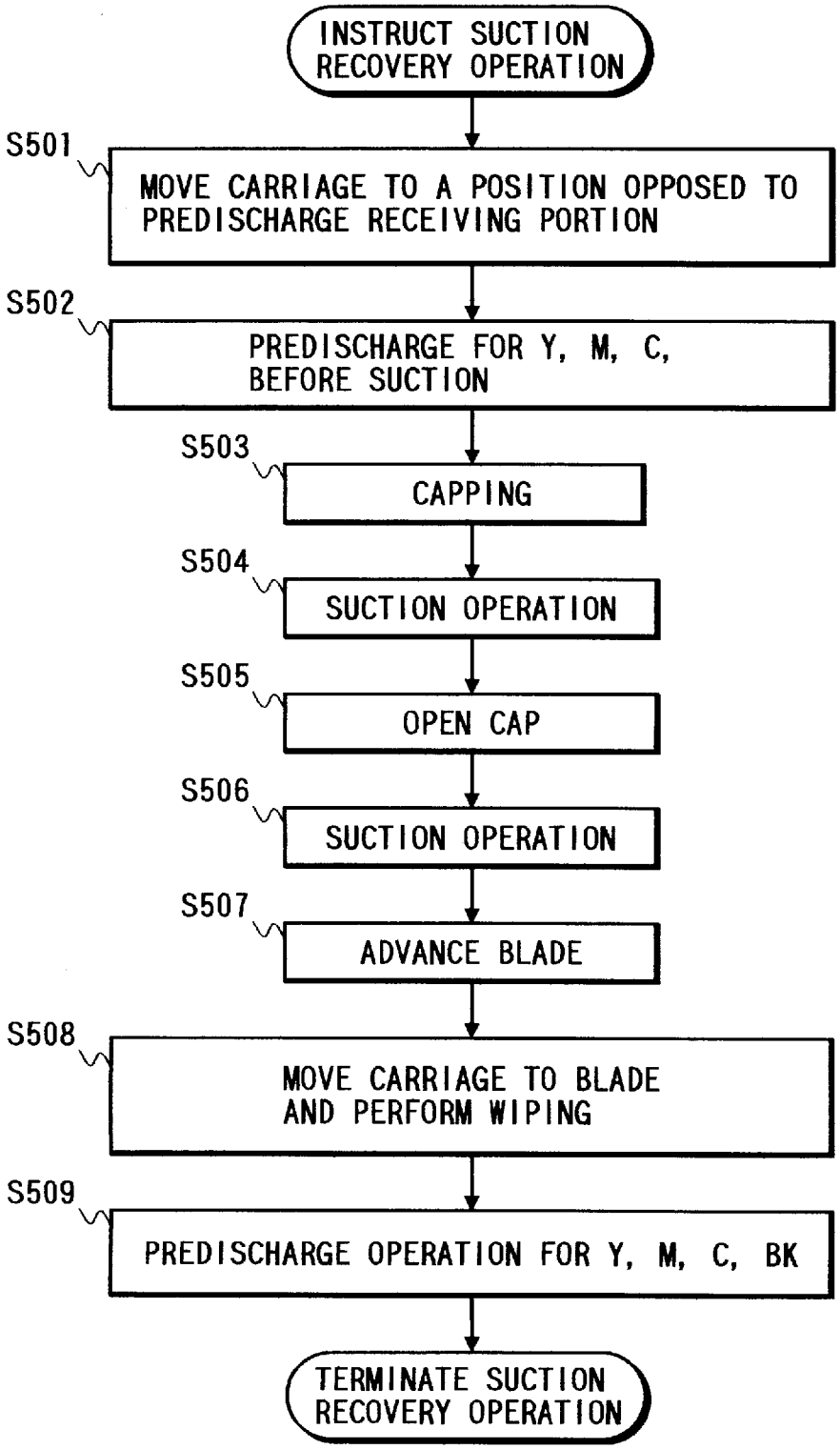
FIG. 35 is a flowchart showing a sequence of suction recovery operation according to the further embodiment of the invention.

FIG. 35 shows a flowchart of operation sequence for showing the suction recovery method wherein the present invention is applied to the four-color integral cartridge.

If the suction recovery operation is instructed, the carriage is moved to a position where the discharge ports are opposed to the predischarge receiving portion (step S501), and the predischarge is performed into the predischarge receiving portion by recording means for Y, M, C inks (step S502). Then, the carriage is moved to a home position (HP) (step S503), and the capping is completed by capping means covering the discharge port face (step S504).

Then, the suction pump is activated to generate a negative pressure within the cap to suck the ink from the discharge ports to effect suction operation, and the pump is stopped in a predetermined time to complete the suction operation (step S505). Then, the cap of capping means is separated away from the discharge port face so that the inside of the cap is in communication with the atmosphere (step S506). Then, the suction pump is activated again to remove the ink out of the pump, the tube and the cap (step S507).

Then, a wiping blade advances toward the discharge port face (step S508), and the carriage is further moved toward the blade so that the wiping blade is rubbed against the discharge port face to effect wiping to remove the ink adhering to the discharge port face (step S509). Further, the carriage continues to be moved in the same direction, and upon reaching a position where the discharge ports are opposed to the predischarge receiving portion, the predischarge with Y, M, C, BK recording means is executed (step S510) to expel the unnecessary ink and fine bubbles out of the nozzles.

In this way, if the predischarge of only Y, M, C inks is performed before suction, the ink split state can be effectively resolved, or less likely to occur, due to the effect as described in the first embodiment, so that there is the advantage that the effect of suppressing the ink consumption is enhanced because the BK ink having greater ink droplet volume is not predischarged.

In each of the embodiments as previously described, the suction operation is performed immediately after prior-to-suction predischarge, whereas the suction operation may be performed in a predetermined waiting time after predischarge. In this way, owing to this waiting time, the time for which the ink returns to the tank can be sufficiently preserved, resulting in higher probability that the ink split state within the flow passage is less than without providing the waiting time, and making it possible to enhance the effect of suction.

By the way, the feature of the ink jet recording apparatus of the embodiment as shown in FIG. 16 can be summarized as a recovery method of the recording head having the discharge portions for a plurality of kinds of inks, wherein the predischarge from the discharge portions of the ink (or more preferably at least relatively thin ink) involves the predischarge operation including a predischarge from all the discharge ports, a predischarge from only discharge ports near the end of each discharge portion, and a predischarge from all the discharge ports. More preferably, the predischarge operation with the above feature is performed after the suction recovery.

Specifically, using a recording head having the discharge portions for discharging at least yellow, magenta, and cyan inks, a predischarge from all the color nozzles (yellow, magenta, cyan), a predischarge from only the discharge ports near the end of each color discharge portion, a predischarge from all the color nozzles, a predischarge from only the discharge ports near the end of each color discharge portion, and a predischarge from all the color nozzles are performed after suction.

The technical background of the present invention will be briefly described below. In making suction of the recording head of multi-color integral type, the problem may arise irregularly that because of uncontrollable factors such as irregular flow of the ink within the cap, the ink sucked from the nozzles enters other color nozzles. After the suction, to remove the ink remaining on the discharge port face of head, it is common to wipe the discharge port face with an elastic wiper, but this wiping also forces the mixed ink inside. This mixed ink will appear on the image as the discoloration (hereinafter referred to as color mixture) in the writing start portion for each color after the recovery.

Accordingly, to prevent this color mixture, it is desirable to reduce the predischarge as much as possible, and as a result of examining means for resolving the color mixture after the suction of the multi-color integral recording head with smaller ink consumption amount, based on this aspect, we have found that it is effective to repeatedly perform the combination of predischarge from all the nozzles and predischarge from only some nozzles at the end.

Thereby, it is possible to provide an ink jet recording apparatus which involves resolving the discoloration in the writing start portion for each color after the recovery with smaller ink consumption amount.

FIG. 22 is a typical cross-sectional view of an ink jet recording head which is mounted on the ink jet recording apparatus to which the present invention can be applied as previously described.

The 24 nozzles for discharging the yellow ink (hereinafter referred to as a yellow nozzle array), 24 nozzles for discharging the magenta ink (hereinafter referred to as a magenta nozzle array), 24 nozzles for discharging the cyan ink (hereinafter referred to as a cyan nozzle array), and 64 nozzles for discharging the black ink (hereinafter referred to as a black nozzle array) are arranged linearly, with the interval between each color nozzle array corresponding to 8 nozzles.

This recording head allows continuous discharging of an ink droplet of about 40 ng for color, or about 80 ng for black at a frequency of 6.25 kHz at maximum.

Figure 40:
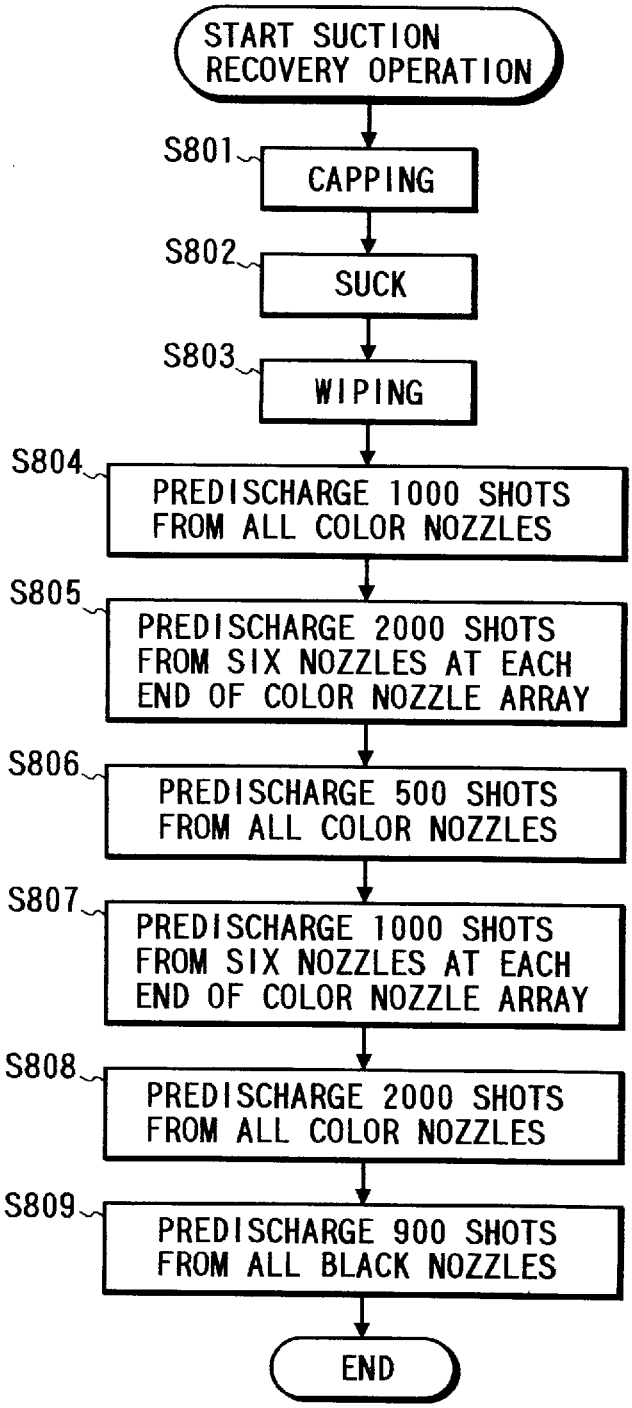
FIG. 40 is a flowchart showing a recovery sequence according to the further embodiment of the invention.

A suction recovery sequence of a recording apparatus according to a further embodiment of the present invention is shown in FIG. 40. After capping (S801), suction (S802), and wiping (S803), 1000 shots are predischarged at 6.25 kHz from all the color nozzles (yellow, magenta, cyan) (S804), then 2000 shots are predischarged at 6.25 kHz from six nozzles at the end of each color nozzle array (S805), 500 shots are predischarged at 6.25 kHz from all the color nozzles (S806), then 1000 shots are predischarged at 6.25 kHz from six nozzles at the end of each color nozzle array (S807), and 2000 shots are predischarged at 6.25 kHz from all the color nozzles (S808), thereby terminating the predischarge operation of color after the suction.

Figure 42:
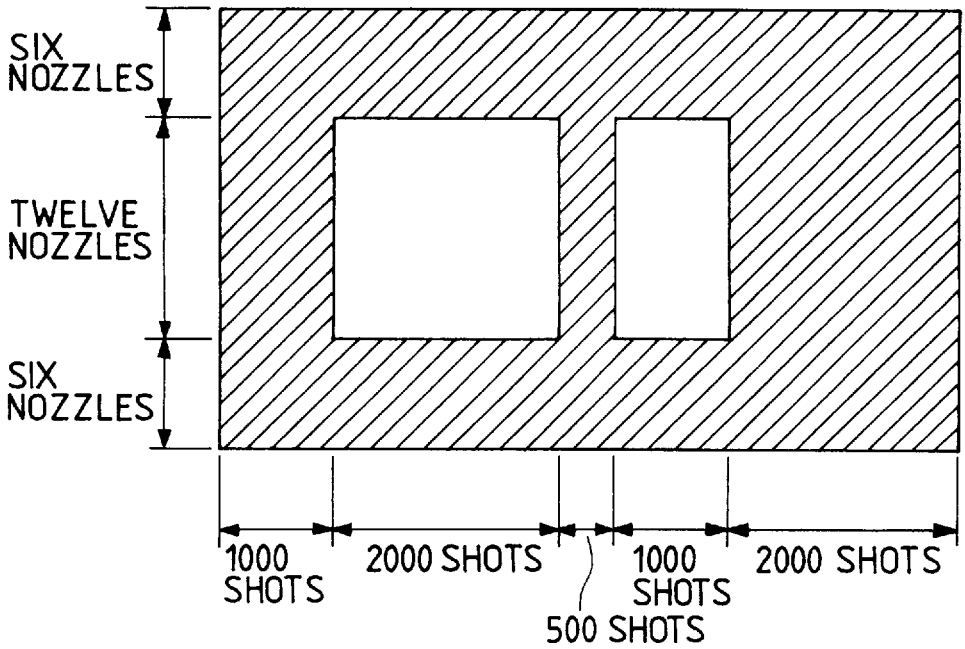
FIG. 42 is a view showing a predischarge pattern according to the further embodiment of the invention.

For the better understanding, a predischarge pattern for color as above described is shown in FIG. 42.

For black, 900 shots are predischarged at 6.25 kHz from all the nozzles (S809), thereby terminating the predischarge after suction. While in this embodiment, the predischarge for black is performed after terminating the predischarge for color, it will be appreciated that the predischarge for black may be performed at the same time with the predischarge for color as above described.

According to the examinations of the present inventions, the degree of color mixture is more remarkable at the end of each color nozzle array than in the central portion thereof. This is probably due to two reasons that more ink enters the nozzles at the end located adjacent other color nozzles, and the ink close to the wall of common liquid chamber is less movable than the ink centrally of the common liquid chamber, impeding other color ink which has mixed from being expelled.

Thus, by providing greater amounts of predischarge from the nozzles at the end of each color nozzle array than from the nozzles near the center thereof, the color mixture can be resolved with less ink consumption amount. This mechanism is not necessarily apparent, but the manner of the ink flowing within the common liquid chamber for each color may be different depending whether to use all the nozzles or use the nozzles at the end, and it is believed that by repetition of this operation, the color mixture can be resolved more efficiently.

Further, to afford the greater effect to the predischarge for only the nozzles at the end, a driving condition of using greater discharge amount in the predischarge for only the nozzles at the end may be employed.

Also, for the color, the predischarge condition is not the same for all colors, but may be varied depending on the color. For example, the predischarge amount of yellow which is more conspicuous in the color mixture may be raised over that of other colors.

Using a recording apparatus of this embodiment, a test of printing on the recording sheet after suction recovery operation is repeated 1000 times, with the result that no occurrence of discoloration (color mixture) in the writing start portion was observed even once.

Also, in the cases where the predischarge using all the nozzles as a suction recovery sequence is performed at 2 kHz, and other predischarges are performed in the same way as in the previous embodiments, a test of printing on the recording sheet after suction recovery operation is repeated 100 times, with the result that no occurrence of discoloration (color mixture) in the writing start portion was observed even once.

Figure 41:
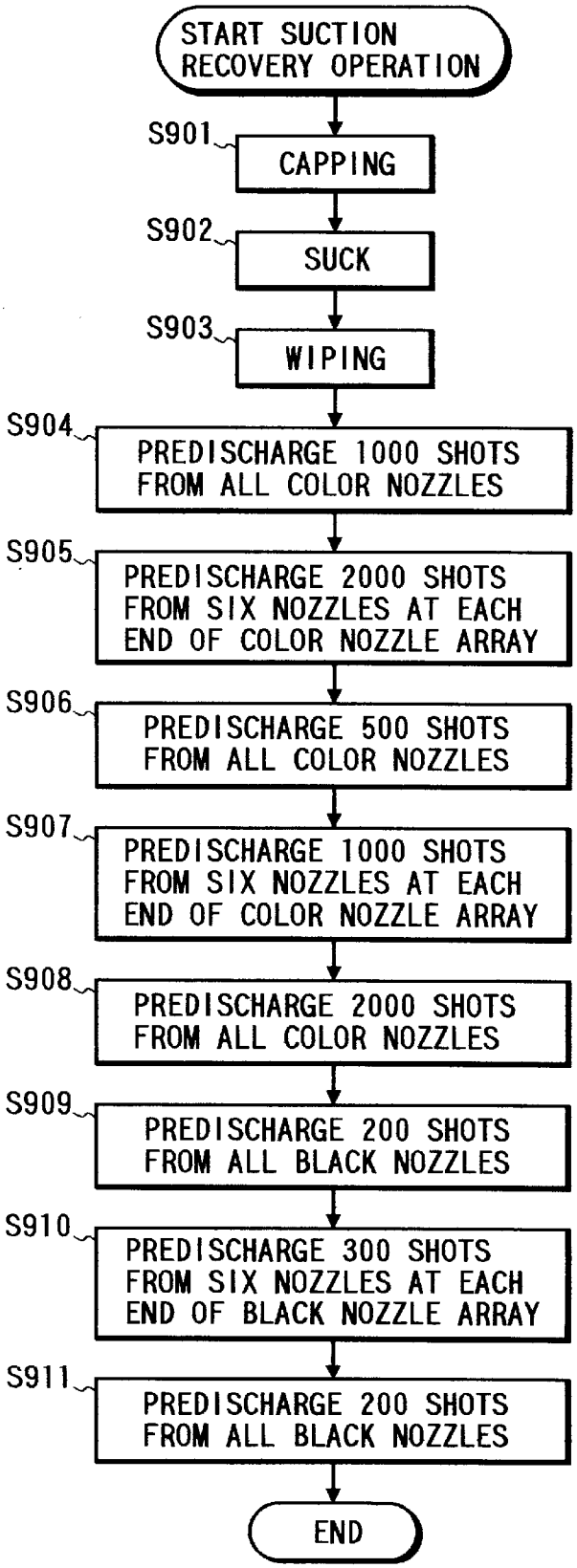
FIG. 41 is a flowchart showing another recovery sequence according to the further embodiment of the invention.

Furthermore, as a variation of the above embodiment, capping (S901), suction (S902), and then wiping (S903) were performed, as a suction recovery sequence, as shown in FIG. 41, and as in the previous examples, the color predischarge was performed (S904 to S908), and then the black predischarge was performed (S909 to S911).

For the black predischarge, 200 shots were predischarged at 6.25 kHz from all the nozzles (S909), 300 shots were predischarged at 6.25 kHz from six nozzles at the end (S910), and 200 shots were predischarged at 6.25 kHz from all the nozzles (S911).

Using this recording apparatus, a test of printing on the recording sheet after suction recovery operation is repeated 100 times, with the result that no occurrence of discoloration (color mixture) in the writing start portion was observed even once.

As above described, according to the present invention, there is provided an ink jet recording apparatus wherein, in performing the suction recovery of an ink jet recording head of the multi-color integral type, it is possible to securely prevent discoloration in the writing start portion for each color after recovery operation with smaller ink consumption amount.

What is claimed is:

1. An ink jet recording apparatus, comprising a color recording head having a plurality of discharge ports capable of discharging different color inks arranged on the same plane or straight line, a plurality of ink tanks for storing the inks of different colors to be supplied to said color recording head, and suction recovery means for sucking the ink with a single cap to stabilize the ink discharge from said color recording head, characterized in that said suction recovery means performs the suction by dividing the motion of piston stroke for the suction operation into plural sections to repeat the motion and stop.

2. An ink jet recording apparatus as in claim 1, wherein said suction recovery means has a plurality of suction operations, which can be selected in accordance with the content of said discharge stabilization.

3. An ink jet recording apparatus according to claim 2, characterized in that said plurality of suction operations for said suction recovery means has different pressures in sucking the ink from the discharge ports.

4. An ink Jet recording apparatus according to claim 2 or 3, characterized in that said plurality of suction operations for said suction recovery means involve two or more types of different suction operations performed consecutively.

5. An ink jet recording apparatus according to claim 2 or 3, characterized in that said plurality of suction operations for said suction recovery means is continuously changed in sequence from higher to lower negative suction pressure.

6. An ink jet recording apparatus according to any of claims 2 or 3, characterized in that said plurality of suction operations for said suction recovery means are changed in accordance with the ink remain within said ink tank.

7. An ink jet recording apparatus according to any of claims 2 or 3, comprising a color recording head having a plurality of discharge ports capable of discharging different color inks arranged on the same plane or straight line, a plurality of ink tanks for storing the inks of different colors to be supplied to said color recording head, and suction recovery means for sucking the ink with a single cap to stabilize the ink discharge from said color recording head, characterized in that the suction operation of said suction recovery means is made different depending on the condition of each color ink.

8. An ink jet recording apparatus according to claim 7, characterized in that the suction operation of said suction recovery means is set in accordance with the least ink remain among said plurality of ink tanks of different colors.

9. An ink jet recording apparatus according to claim 7, characterized in that the ink jet recording apparatus uses an ink jet unit of the recording head/ink tank integral type in which said recording head and said ink tank are replaceable at will.

10. An ink jet recording apparatus according to any of claims 2, 3 or 9, characterized in that said recording head comprises a plurality of discharge portions for discharging the ink, and heat energy generating means, provided for every corresponding discharge portion, for causing state changes in the ink due to heat to discharge the ink from said discharge portion based on said state changes to form liquid droplets to be jetted.

11. An ink jet recording apparatus as in claim 1, further comprising an ink droplet discharging means for discharging ink droplets to record, wherein said suction recovery means comprises a cap and a suction pump for sucking and expelling the ink out of said ink droplet discharge means, characterized by having a prior-to-suction predischarge recovery mode of operating said suction recovery means after discharging ink droplets into a non-image area.

12. An ink jet recording apparatus according to claim 11, characterized in that the non-image area to which ink droplets are discharged is located within said cap of said suction recovery means.

13. An ink jet recording apparatus according to claim 11 or 12, characterized in that said ink droplet discharge means is a set of ink droplet discharge means for discharging multiple different inks, and said suction recovery means performs suction for said set of ink droplet discharge means together.

14. An ink jet recording apparatus according to claim 13, characterized in that ink discharge means not involving this prior-to-suction predischarge is provided in said prior-to-suction predischarge recovery mode.

15. An ink jet recording apparatus according to any of claims 11 or 12, characterized in that a recording head of said ink jet recording apparatus comprises a plurality of discharge portions for discharging the inks, and heat energy generating means, provided for every corresponding discharge portion, for causing state changes in the ink due to heat to discharge the ink from said discharge portion based on said state changes to form liquid droplets to be jetted.

16. A recording apparatus as in claim 1, further comprising, on at least one replacement position set along a main scan direction, mounting/demounting means for mounting and dismounting the recording head for forming an image by discharging the ink onto the recording medium at a predetermined position on a carriage, electrical contact means for feeding an electrical signal to said recording head installed on said carriage when said head is mounted by the operation of said mounting/demounting means, and a wiper blade for rubbing against the surface of head, wherein a distinction between a black head and a color head of multi-color integral type is made by electrical information which is obtained through said electrical contact portion when said recording head is mounted on said carriage, to vary suction operation condition based on said information, wherein when the color head is identified, the ink equal to or more than the volume of a liquid chamber within the head for every color is predischarged prior to said suction operation, and the predischarge of relatively thin ink from the discharge portion after said suction operation is effected by the combination of a predischarge from all the nozzles, a predischarge from only the nozzles at the end, and a predischarge from all the nozzles.

17. A recording apparatus according to claim 16, wherein a distinction is made between a monochrome head having an ink discharge head portion and an ink tank integrated, and a color head having a color head portion having a group of ink discharge nozzles for multiple colors integrated and an ink tank which are separable, and wherein a suction recovery operation I is performed when the monochrome head is detected, or a suction recovery operation II is performed when the color head is detected, or a suction recovery operation III is performed when the color head and an ink tank replacement operation are detected or predicted.

18. A recording apparatus according to claim 16, characterized in that a predischarge to be performed prior to suction operation for the color head of multiple colors integrally, including black, and a predischarge to be performed after suction operation are effected only for each group of color nozzles.

19. A recording apparatus according to any of claims 16 or 18, characterized in that the color head is of an integral type in which nozzle groups of black, magenta, cyan and yellow inks are arranged on the same plane or straight line.

20. A recording apparatus as in claim 1, further comprising, on at least one replacement position set along a main scan direction, mounting/demounting means for mounting and dismounting the recording head for forming an image by discharging the ink onto the recording medium at a predetermined position on a carriage, electrical contact means for feeding an electrical signal to said recording head installed on said carriage when said head is mounted by the operation of said mounting/demounting means, and a wiper blade for rubbing against the surface of head, wherein a distinction between a black head and a color head of multi-color integral type is made by electrical information which is obtained through said electrical contact portion when said recording head is mounted on said carriage, to vary suction operation condition based on said information, wherein when the color head is identified, a combination of plural suction forces or negative suction pressures for suction operation is applied to said plurality of nozzle portions, the ink equal to or more than the volume of a liquid chamber within the head for each color is predischarged prior to said suction operation, and the predischarge of at least relatively thin ink from the discharge portion after said suction operation is effected by the combination of a predischarge from all the nozzles, a predischarge from only the nozzles at the end, and a predischarge from all the nozzles.

21. A recording apparatus according to claim 20, characterized in that the color head is of an integral type in which nozzle groups of magenta, cyan and yellow inks or nozzle groups of black, magenta, cyan and yellow inks are arranged on the same plane or straight line, said suction operation involving continuously performing two or more different suctions.

22. A recording apparatus as in claim 1, further comprising, on at least one replacement position set along a main scan direction, mounting/demounting means for mounting and dismounting the recording head for forming an image by discharging the ink onto the recording medium at a predetermined position on a carriage, electrical contact means for feeding an electrical signal to said recording head installed on said carriage when said head is mounted by the operation of said mounting/demounting means, and a wiper blade for rubbing against the surface of head, wherein a distinction between a monochrome head for black and a color head of four-color integral type of black, cyan, magenta and yellow is made by electrical information which is obtained through said electrical contact portion when said recording head is mounted on said carriage, wherein based on said information, a suction operation I is set for the black head, a suction operation II is set when head replacement with the color head is identified, and a suction operation III is set when tank replacement with the color head is identified or predicted, said suction operations II, III consisting of division suctions in which one suction operation is divided into three stages, an operation of predischarging the ink equal to or more than the volume of liquid chamber within the head from each color nozzle group prior to said suction operation, and an operation of performing predischarge from each color nozzle group after said suction operation in combination of a discharge from all the nozzles, a discharge from only the nozzles at the end, and a discharge from all the nozzles.

23. A recording apparatus according to any of claims 18, 20 or 22, characterized in that when a distinction between the black head and the color head is made, the different wiping operation condition is selected by the type of head based on said information.

24. A recording apparatus according to claim 23, characterized in that the wiping operation condition comprising the information of head temperature, ambient temperature, the difference between the ambience and head temperatures, and the print mode which is added to a predetermined set value based on said information.

25. A recording apparatus as in claim 1, further comprising, on at least one replacement position set along a main scan direction, mounting/demounting means for mounting and dismounting the recording head for forming an image by discharging the ink onto the recording medium at a predetermined position on a carriage, electrical contact means for feeding an electrical signal to said recording head installed on said carriage when said head is mounted by the operation of said mounting/demounting means, and a wiper blade for rubbing against the surface of head, wherein the type of head is identified by electrical information obtained through said electrical contact portion, when said recording head is mounted on said carriage, wherein the recovery operation and wiping conditions are set based on said information.

26. A recording apparatus according to claim 25, wherein a distinction is made between a monochrome head and a color head for multiple colors integrally, and wherein a suction recovery operation I is performed when the monochrome head is detected, or a suction recovery operation II is performed when the color head is detected, or a suction recovery operation III is performed when the color head is detected and an ink tank replacement operation is detected or predicted.

27. A recording apparatus according to claim 26, characterized in that the color head is of an integral type in which nozzle groups of black, magenta, cyan and yellow inks are arranged on the straight line, ink droplets being discharged by a predetermined amount from a color nozzle group prior to performing the suction recovery operations II, III.

28. A recording apparatus according to claim 26, characterized in that the color head is of an integral type in which nozzle groups of black, magenta, cyan and yellow inks are arranged on the straight line, wherein a color mixture prevention predischarge in practicing the suction recovery operations II, III is performed by the combination of a discharge from all the nozzles, a discharge from only the nozzles at the end, and a discharge from all the nozzles for the nozzles for each color.

29. An ink jet recording apparatus according to claim 13, characterized in that a recording head of said ink jet recording apparatus comprises a plurality of discharge portions for discharging the inks, and heat energy generating means, provided for every corresponding discharge portion, for causing state changes in the ink due to heat to sequentially the negative suction pressure from higher to discharge the ink from said discharge portion based on said state changes to form liquid droplets to be jetted.

30. An ink jet recording apparatus according to claim 14, characterized in that a recording head of said ink jet recording apparatus comprises a plurality of discharge portions for discharging the inks, and heat energy generating means, provided for every corresponding discharge portion, for causing state changes in the ink due to heat to discharge the ink from said discharge portion based on said state changes to form liquid droplets to be jetted.

31. A recording apparatus according to claim 19, characterized in that when a distinction between the black head and the color head is made, the different wiping operation condition is selected by the type of head based on said information.

32. A recording apparatus according to claim 19, characterized in that said recording head has a plurality of discharge portions for discharging the ink, and heat energy generating means, provided for every corresponding discharge portion, for causing state changes in the ink due to heat to discharge the ink from said discharge portion based on said state changes to form liquid droplets to be jetted.

33. A recording apparatus according to claim 23, characterized in that said recording head has a plurality of discharge portions for discharging the ink, and heat energy generating means, provided for every corresponding discharge portion, for causing state changes in the ink due to heat to discharge the ink from said discharge portion based on said state changes to form liquid droplets to be jetted.

34. An ink jet recovery method for performing the recovery and the maintenance of the ink discharge condition by sucking from a discharge port for discharging ink through a cap when said cap caps said discharge port, said method comprising the steps of:

a first suction process for performing said suction; and a second suction process for performing said suction with a suction force smaller than the suction force of said first suction process.

35. A suction recovery method as in claim 34, further comprising the steps of:

providing an ink jet recording apparatus comprising ink droplet discharging means for discharging ink droplets to make image recording and suction means having a cap and a suction pump for sucking and expelling the ink out of said ink droplet discharge means; and activating said suction means after discharging ink droplets into the non-image area.

36. A suction recovery method for an ink jet recording apparatus according to claim 35, characterized in that the ink is discharged into the cap which said suction means has.

37. A suction recovery method for an ink jet recording apparatus according to claim 35 or 36, characterized in that said ink droplet discharge means is a set of ink droplet discharge means for discharging multiple different inks, said suction means performing the suction for said set of ink droplet discharge means together.

38. A suction recovery method for an ink jet recording apparatus according to claim 37, characterized in that ink discharge means not involving this prior-to-suction predischarge is provided in said prior-to-suction predischarge recovery mode.

39. A suction recovery method as in claim 34, further comprising the steps of:

providing an ink jet recording apparatus having an ink jet head provided with the nozzles communicating to orifices for discharging the ink and a liquid chamber communicating to the nozzles; and doing away with the ink meniscus within said nozzles by performing a predischarge prior to suction recovery of said ink jet head, or forming an air region having a capacity by which said ink meniscus can be removed by suction action with said suction recovery within said liquid chamber.

40. A recording apparatus according to claim 26, characterized in that the color head is of an integral type in which nozzle groups of black, magenta, cyan and yellow inks are arranged on the straight line, wherein in practicing the suction recovery operations II, III, a multistage suction operation is performed at least once in the recovery operations II, III.

41. A method according to claim 34, wherein said second suction process is performed after the pressure in said cap restores a normal condition in said first suction process.

42. A method according to claim 34, further comprising a third suction process for performing said suction with a suction force smaller than the suction force of said second suction process after said second suction process.

43. A method according to claim 34, wherein ink is discharged through said discharge ports by utilizing thermal energy.

44. An ink jet recording method according to claim 34, wherein said suction is performed in a state such that all of a plurality of discharge ports discharging different inks are covered together by said cap.

45. An ink jet recording method according to claim 44, wherein said different inks are of different colors.

46. An ink jet recording method, comprising the steps of:

providing a recording apparatus having a color recording head having a plurality of discharge ports capable of discharging different color inks arranged on the same plane or straight line, a plurality of ink tanks for storing the inks of different colors to be supplied to said color recording head, and sucking the ink with a single cap to stabilize the ink discharge from said color recording head, wherein the sucking is performed by dividing the motion of piston stroke for the sucking into plural sections to repeat the motion and stop.

47. An ink jet recording method according to claim 46, wherein that said recording head comprises a plurality of discharge portions for discharging the ink, and heat energy generating means, provided for every corresponding discharge portion, for causing state changes in the ink due to heat to discharge the ink from said discharge portion based on said state changes to form liquid droplets to be jetted.

48. An ink jet recording apparatus comprising:

a discharge port for discharging an ink, suction recovery means for performing a suction recovery operation, the suction recovery means including a cap;

wherein the suction recovery means performs a first suction process for performing suction, and a second suction process for performing suction with a suction force smaller than the suction force of the first suction process.

49. An ink jet recording apparatus according to claim 48, wherein said second suction process is performed after the pressure in said cap restores a normal condition in said first suction process.

50. An ink jet recording apparatus according to claim 48, wherein the suction recovery means performs a third suction process for performing suction with a suction force smaller than the suction force of said second suction process, after said second suction process.

51. An ink jet recording apparatus according to claim 48, wherein ink is discharged through said discharge ports using thermal energy.

52. An ink jet recording apparatus according to claim 48, wherein said suction is performed in a state such that all of a plurality of discharge ports discharging different inks are covered together by said cap.

53. An ink jet recording apparatus according to claim 48, wherein said different inks are of different colors.

54. A recording apparatus comprising, on at least one replacement position set along a main scan direction, mounting/demounting means for mounting and dismounting a recording head for forming an image by discharging the ink onto the recording medium at a predetermined position on a carriage, electrical contact means for feeding an electrical signal to said recording head installed on said carriage when said head is mounted by the operation of said mounting/demounting means, suction recovery means coupled to a cap for sucking the ink from the nozzles of said head, and a wiper blade for rubbing against the surface of head, characterized in that wherein a distinction between a black head and a color head of multi-color integral type is made by electrical information which is obtained through said electrical contact portion when said recording head is mounted on said carriage, to vary suction operation condition based on said information, wherein when the color head is identified, a combination of plural suction forces or negative suction pressures for suction operation is applied to said plurality of nozzle portions, the ink equal to or more than the volume of a liquid chamber within the head for each color is predischarged prior to said suction operation, and the predischarge of at least relatively thin ink from the discharge portion after said suction operation is effected by the combination of a predischarge from all the nozzles, a predischarge from only the nozzles at the end, and a predischarge from all the nozzles, wherein said plurality of different suctions for said suction operation is consecutively changed in sequence from higher to lower negative suction pressure.

55. A recording apparatus comprising, on at least one replacement position set alone a main scan direction, mounting/demounting means for mounting and dismounting a recording head for forming an image by discharging the ink onto the recording medium at a predetermined position on a carriage, electrical contact means for feeding an electrical signal to said recording head installed on said carriage when said head is mounted by the operation of said mounting/demounting means, suction recovery means coupled to a cap for sucking the ink from the nozzles of said head, and a wiper blade for rubbing against the surface of head, characterized in that a distinction between a black head and a color head of multi-color integral type is made by electrical information which is obtained through said electrical contact portion when said recording head is mounted on said carriage, to vary suction operation condition based on said information, wherein when the color head is identified, a combination of plural suction forces or negative suction pressures for suction operation is applied to said plurality of nozzle portions, the ink equal to or more than the volume of a liquid chamber within the head for each color is predischarged prior to said suction operation, and the predischarge of at least relatively thin ink from the discharge portion after said suction operation is effected by the combination of a predischarge from all the nozzles, a predischarge from only the nozzles at the end, and a predischarge from all the nozzles, wherein the color head is of an integral type in which nozzle groups of magenta, cyan and yellow inks or nozzle groups of black, magenta, cyan and yellow inks are arranged on the same plane or straight line, said suction operation involving continuously performing two or more different suctions, and wherein the motion of piston stroke for a pump which is suction means for effecting a plurality of different suctions in said suction operation is divided into plural sections to repeat the motion and stop to effect suction.

56. A recording apparatus according to claim 55, characterized in that the motion of piston stroke for a pump which is suction means for effecting a plurality of different suctions in said suction operation is divided into three stages to repeat the motion and stop to change sequentially the negative suction pressure from higher to lower negative pressure, the suction amount being decreased at stages.

57. A recording apparatus according to any of claims 18, 20, 21, 55, 56, 22 or 25, 40 characterized in that said recording head a plurality of discharge portions for discharging the ink, and heat energy generating means, provided for every corresponding discharge portion, for causing state changes in the ink due to heat to discharge the ink from said discharge portion based on said state changes to form liquid droplets to be jetted.

58. A recording apparatus according to claim 54, characterized in that the motion of piston stroke for a pump which is suction means for effecting a plurality of different suctions in said suction operation is divided into plural sections to repeat the motion and stop to effect suction.

59. A recording apparatus according to claim 58, characterized in that the motion of piston stroke for a pump which is suction means for effecting a plurality of different suctions in said suction operation is divided into three states to repeat the motion and stop to change sequentially the negative suction pressure from higher to lower negative pressure, the suction amount being decreased at stages.

* * * * *

UNITED STATES PATENT AND TRADEMARK OFFICE

CERTIFICATE OF CORRECTION

PATENT NO. : 5,805,180

DATED : Sept. 8, 1998

INVENTOR(S) : ISAO EBISAWA, ET AL.

It is certified that error appears in the above-identified patent and that said Letters Patent is hereby corrected as shown below:

On the title page,

AT [56], Attorney, Agent or Firm

"Fitzpatrick Cella Harper & Scinto" should read --Fitzpatrick, Cella, Harper & Scinto--.

IN THE DRAWINGS

Figure 21, "remain" should read --remaining--.

COLUMN 1

Line 48, "is" should read --are--.

COLUMN 2

Line 23, "is" should read --are--.
Line 44, "advance" should read --advances--.
Line 60, "allows" should read --allow--.

COLUMN 4

Line 27, "not" should read --not to--.
Line 42, "inform" should read --in from--.
Line 37, "charged" should read --charge--.
Line 58, "undischarged" should read --undischarge--.

UNITED STATES PATENT AND TRADEMARK OFFICE

CERTIFICATE OF CORRECTION

PATENT NO. : 5,805,180

DATED : Sept. 8, 1998

INVENTOR(S) : ISAO EBISAWA, ET AL.

It is certified that error appears in the above-identified patent and that said Letters Patent is hereby corrected as shown below:

COLUMN 5

Line 12, "the" should be deleted.
Line 36, "not" should be deleted.
Line 46, "color" should read --colors--.
Line 52, "provided" should read --provide--.

COLUMN 8

Line 14, "therefrom" should read --therefrom,--.
Line 17, "portion" should read --portion,--.

COLUMN 13

Line 11, "an" should read --a--.

COLUMN 15

Line 54, "replace" should read --replaced--.

COLUMN 18

Line 10, "lease" should read --least--.

UNITED STATES PATENT AND TRADEMARK OFFICE

CERTIFICATE OF CORRECTION

PATENT NO.: 5,805,180

DATED : Sept. 8, 1998

INVENTOR(S): ISAO EBISAWA, ET AL.

It is certified that error appears in the above-identified patent and that said Letters Patent is hereby corrected as shown below:

COLUMN 19

Line 15, "(P2)." should read --(P2),--.
Line 31, "form" should read --from--.

COLUMN 21

Line 47, "containes" should read --contains--.

COLUMN 25

Line 4, "operation" should read --operation H--.

COLUMN 26

Line 38, "discharge" should read --discharges--.
Line 60, "is" should read --are--.

COLUMN 27

Line 11, "c)" should read --b)--.

COLUMN 29

Line 21, "recording" should read --record--.
Line 66, "are" should read --is--.

UNITED STATES PATENT AND TRADEMARK OFFICE

CERTIFICATE OF CORRECTION

PATENT NO. : 5,805,180

DATED : Sept. 8, 1998

INVENTOR(S) : ISAO EBISAWA, ET AL.

It is certified that error appears in the above-identified patent and that said Letters Patent is hereby corrected as shown below:

COLUMN 30

Line 8, "and" should read --as--.
Line 65, "(step S350)." should read --(step S305).--.

COLUMN 31

Line 3, "are" should read --is--.

COLUMN 35

Line 18, "Jet" should read --jet--.
Line 29, "remain" should read --remaining--.
Line 43, "remain" should read --remaining--.
Line 51, "claims 2,3, or 9," should read --claims 1, 2, or 3,--.

COLUMN 36

Line 65, "or" should read --to--.

UNITED STATES PATENT AND TRADEMARK OFFICE

CERTIFICATE OF CORRECTION

PATENT NO. : 5,805,180

DATED : Sept. 8, 1998

INVENTOR(S) : ISAO EBISAWA, ET AL.

It is certified that error appears in the above-identified patent and that said Letters Patent is hereby corrected as shown below:

COLUMN 38

Line 2, "claims 18," should read --claims 16-18 or--.
Line 3, "or" should read --to--.
Line 60, "sequentially" should be deleted.
Line 61, "the negative suction pressure from higher to" should be deleted.

COLUMN 41

Line 1, "claim 48," should read --claim 52,--.

COLUMN 42

Line 33, "18," should read --16--.
Line 34, "20, 21, 55, 56, 22 or 25, 40" should read --18, 20 to 22, 24 to 28, 40, 55 and 56--.

Signed and Sealed this

Fourteenth Day of September, 1999

*Attest:*

Q. TODD DICKINSON

*Attesting Officer*

*Acting Commissioner of Patents and Trademarks*